US012716686B2

(12) United States Patent
Smith et al.

(10) Patent No.: US 12,716,686 B2
(45) Date of Patent: Aug. 25, 2026

(54) VERTICALLY ADJUSTABLE BELT LOOP

(71) Applicant: Vista Outdoor Operations LLC, Anoka, MN (US)

(72) Inventors: Paul N. Smith, Bozeman, MT (US); Christopher J. Michael, Belgrade, MT (US); Daniel D. Sereday, Belgrade, MT (US); Rory Erhard, Bozeman, MT (US)

(73) Assignee: Revelyst Operations LLC, Irvine, CA (US)

( * ) Notice: Subject to any disclaimer, the term of this patent is extended or adjusted under 35 U.S.C. 154(b) by 187 days.

(21) Appl. No.: 18/813,499

(22) Filed: Aug. 23, 2024

(65) Prior Publication Data

US 2024/0426571 A1 Dec. 26, 2024

Related U.S. Application Data

(63) Continuation of application No. PCT/US2023/014334, filed on Mar. 2, 2023.

(60) Provisional application No. 63/396,927, filed on Aug. 10, 2022, provisional application No. 63/315,967, filed on Mar. 2, 2022.

(51) Int. Cl.
*F41C 33/04* (2006.01)
*F41C 33/02* (2006.01)

(52) U.S. Cl.
CPC ..... *F41C 33/041* (2013.01); *F41C 33/0209* (2013.01)

(58) Field of Classification Search
CPC .... F41C 33/041; F41C 33/043; F41C 33/045; F41C 33/048; F41C 33/0209
USPC ..... 224/192–193, 198, 238, 243, 911–912
See application file for complete search history.

(56) References Cited

U.S. PATENT DOCUMENTS

| | | | | |
|---|---|---|---|---|
| 5,421,497 | A | 6/1995 | Gilmore | |
| 6,010,045 | A * | 1/2000 | Rogers | F41C 33/045 224/198 |
| 6,161,741 | A | 12/2000 | French | |
| 6,478,202 | B1 | 11/2002 | Glock | |
| 6,588,639 | B2 | 7/2003 | Beletsky et al. | |
| 6,685,067 | B2 | 2/2004 | French | |
| 7,690,541 | B2 * | 4/2010 | Pellegrini | A45F 5/02 224/198 |

(Continued)

FOREIGN PATENT DOCUMENTS

| | | |
|---|---|---|
| IT | FI20010090 | 11/2022 |

OTHER PUBLICATIONS

International Search Report and Written Opinion dated Sep. 13, 2023 for PCT/US2023/014334.

(Continued)

*Primary Examiner* — Scott T McNurlen
(74) *Attorney, Agent, or Firm* — Reed Smith LLP; Matthew P. Frederick; Cheryl L. Gastineau

(57) ABSTRACT

A holster support assembly for supporting a holster configured for receiving and withdrawing a handgun. The holster support assembly is configured for supporting a holster on a user's belt and comprises a belt engaging member comprising: a column portion and at least one belt loop portion; wherein the holster attachment portion comprises: a central slot; a plurality of pairs of diametrically opposed recesses on the rear face, defining a plurality of ride height positions.

20 Claims, 68 Drawing Sheets

(56) References Cited

U.S. PATENT DOCUMENTS

| | | | | |
|---|---|---|---|---|
| 7,866,515 | B1 * | 1/2011 | Buis, III | F41C 33/041 224/198 |
| 10,782,094 | B2 * | 9/2020 | Rogers | F41C 33/045 |
| 10,883,795 | B2 * | 1/2021 | Rogers | F41C 33/0209 |
| 10,996,024 | B2 | 5/2021 | Smith et al. | |
| 11,320,237 | B2 | 5/2022 | Tedder et al. | |
| 2002/0148865 | A1 | 10/2002 | French | |
| 2009/0165262 | A1 | 7/2009 | Shimamura et al. | |
| 2012/0298705 | A1 | 11/2012 | Gregory et al. | |
| 2018/0010885 | A1 * | 1/2018 | Tedder | F41C 33/0209 |
| 2021/0262754 | A1 | 8/2021 | Smith et al. | |
| 2021/0302125 | A1 | 9/2021 | Reich et al. | |

OTHER PUBLICATIONS

"Alien Gear ShapeShift Ankle Holster—Custom Fit to Your Gun (Select Pistol Size)—Concealed Carry—Adjustable Retention and Ride Height—Made in the USA" https://www.amazon.com/Alien-Gear-holsters-ShapeShift-Holster/dp/B07MC26QQD (Accessed Jun. 15, 2022).

"Low Ride Belt Loop" https://www.cytacstore.com/platforms/low-ride-belt-loop.html (Accessed Jun. 15, 22).

* cited by examiner

FIG. 35C
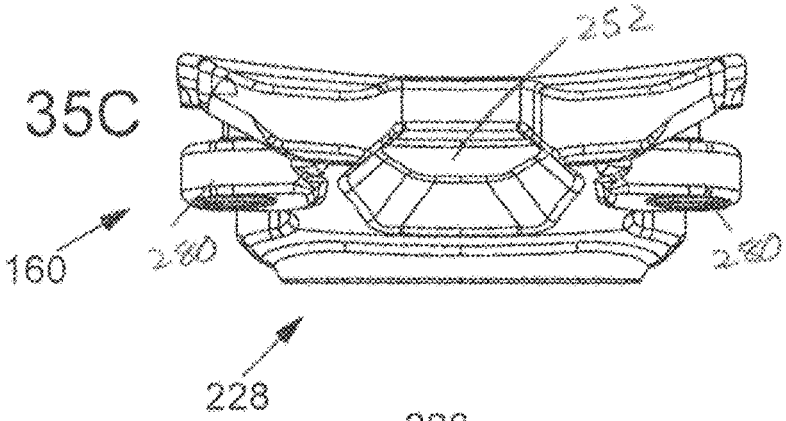
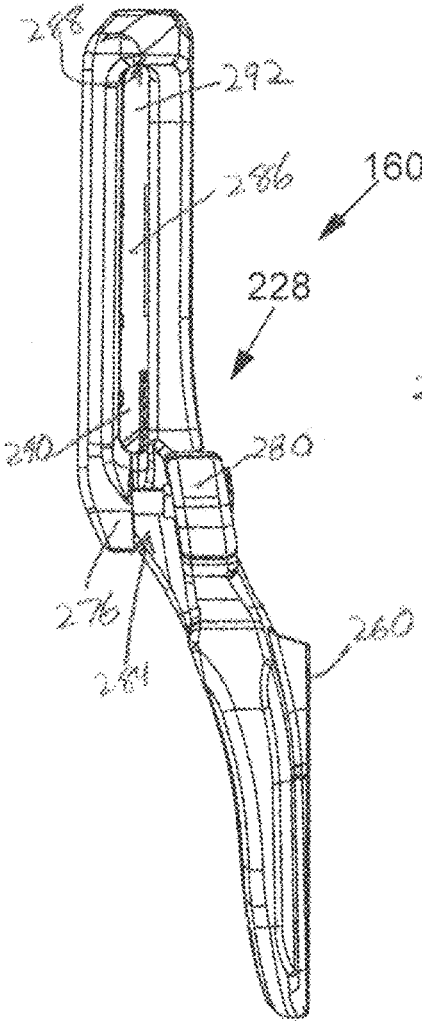
FIG. 35A
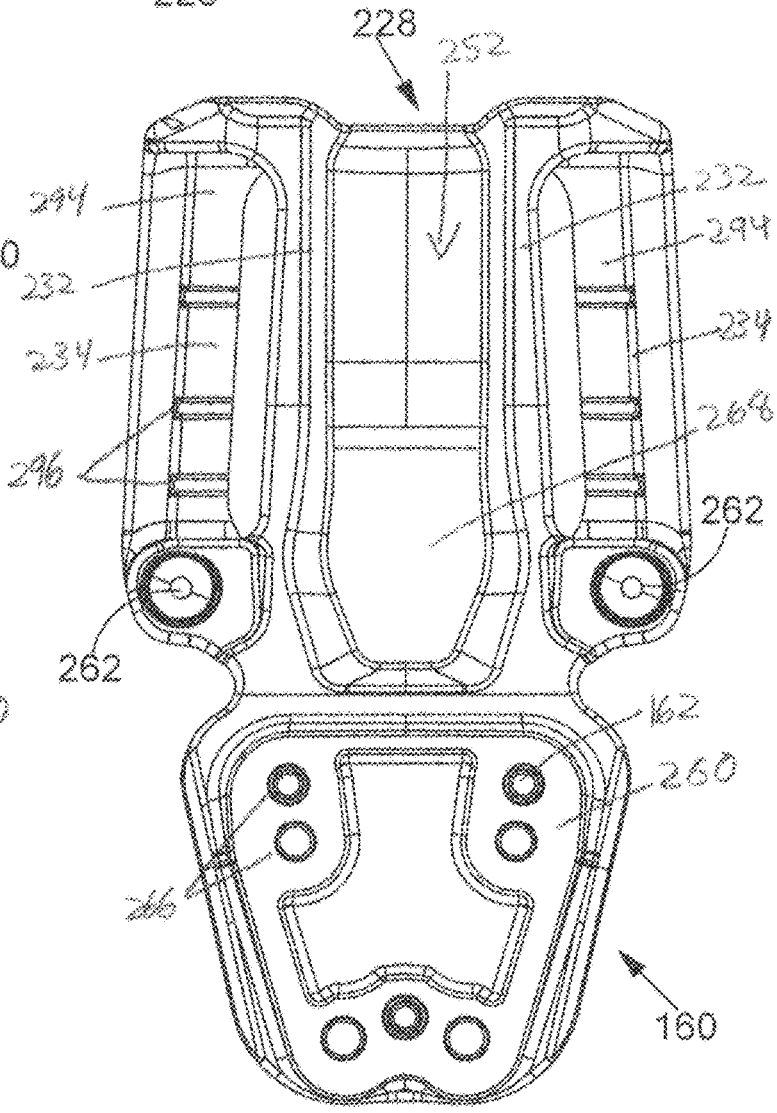
FIG. 35B

FIG. 39C
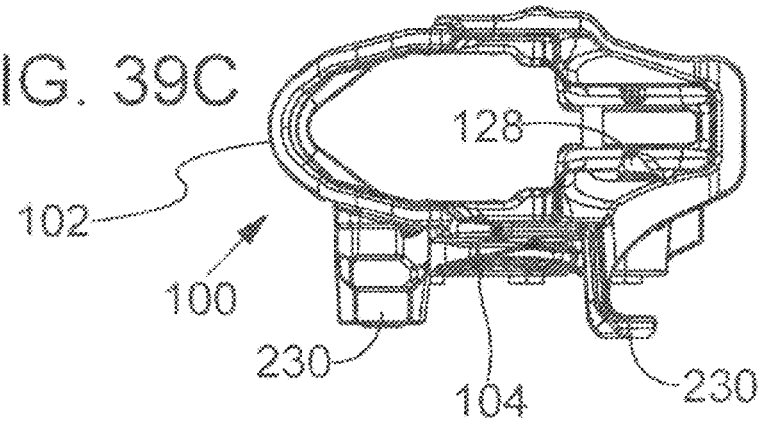
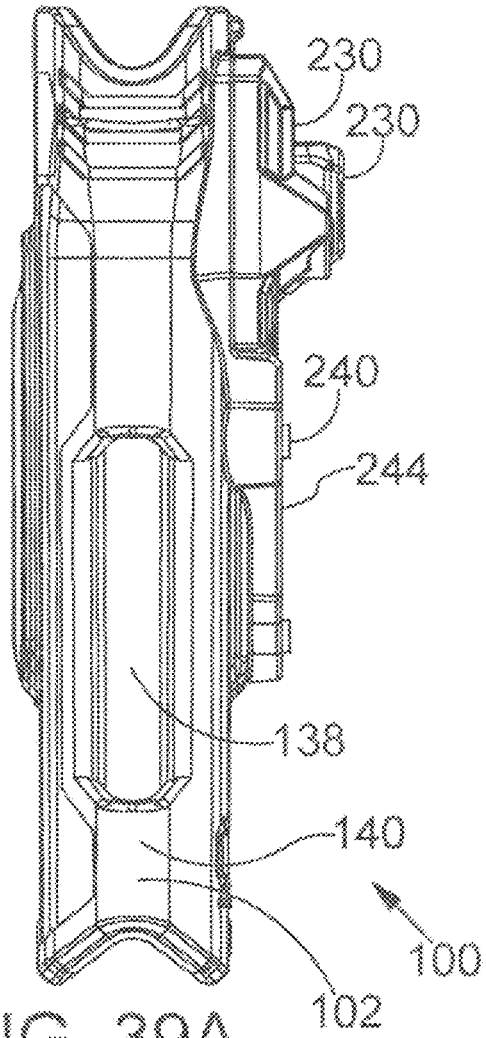
FIG. 39A
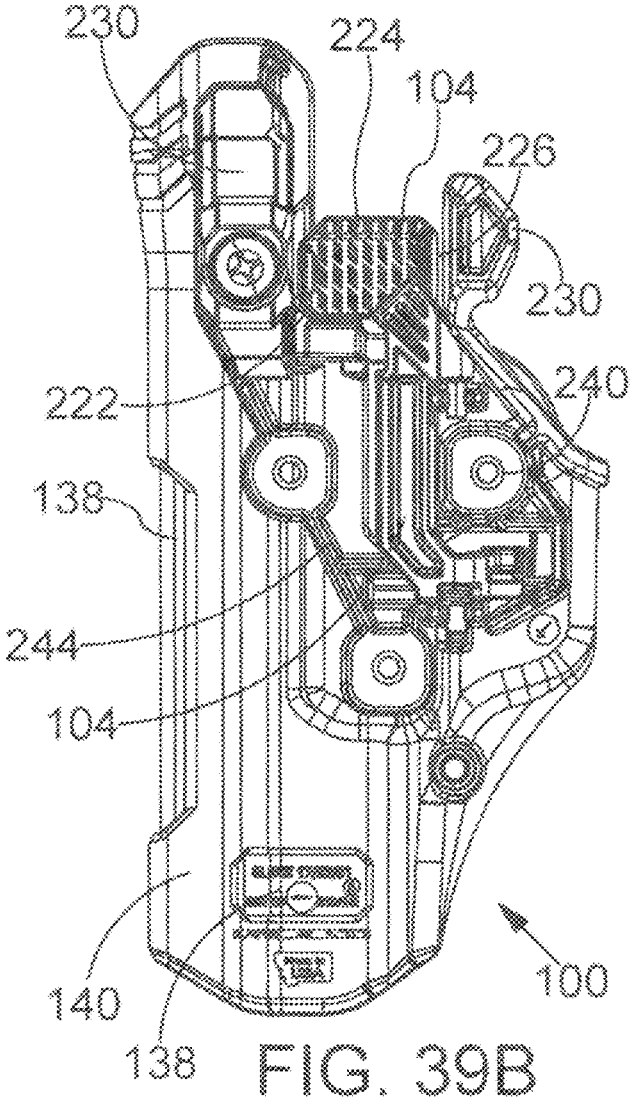
FIG. 39B

VERTICALLY ADJUSTABLE BELT LOOP

CROSS-REFERENCE TO RELATED APPLICATIONS

This application is a continuation application of International Patent Application No. PCT/US23/14334 filed Mar. 2, 2023 which claims the benefit of priority to U.S. Provisional Application No. 63/315,967 filed Mar. 2, 2022 and U.S. Provisional Application No. 63/396,927, filed Aug. 10, 2022, the disclosures of which are hereby incorporated by reference herein in their entirety.

BACKGROUND OF THE DISCLOSURE

In many countries (e.g., Germany, Poland and the United States) law enforcement officers often carry a handgun in an openly visible manner while on duty. The handgun is typically carried in a holster designed to protect the handgun and hold it securely. The holster may include a belt loop that allows it to be hung from a wide belt, for example, a police officer's service belt. The holster may also include a locking mechanism to prevent an assailant from drawing the holster user's weapon and prevent the handgun from inadvertently falling out of the holster, for example, when the holster user is running, climbing over a fence, etc. It is important that the retention mechanisms are secure in such challenging situation.

In addition to having the handgun be secure in the holster in challenging situations, ease of withdrawal when urgently needed by the user is an important feature. That is, easy actuation of release mechanisms in stressful situations.

A holster that securely retains a handgun and that provides improvement in ease of use when the handgun is urgently needed would be welcomed by the industry.

To have holsters be commercially viable, they need to be priced to meet expectations of the consuming populace. So any improvement of assembly and cost efficiencies by minimizing the number of parts and minimizing the number of assembly steps would also be welcomed by the industry.

SUMMARY

In various embodiments of the disclosure a holster support assembly is configured for supporting a holster on a user's belt. The holster support assembly may include a belt engaging member comprising: a column portion comprising: a front face configured to face the holster; a rear face configured to face the user; and a holster attachment portion; and at least one belt loop portion extending from the rear face of the column portion and configured to engage the user's belt; wherein the holster attachment portion comprises: a central slot, a plurality of pairs of diametrically opposed slots on the rear face, defining a plurality of ride height positions, wherein the slots of each pair of diametrically opposed slots are on opposite sides of the central slot; a holster carrier comprising: a front face configured to be mounted to the holster; and a rear face configured for sliding movement relative to the front face of the column portion; a slider slideably mounted to the rear face of the holster carrier and comprising: a carrier sled; at least two sliding elements forwardly projecting from the carrier sled and configured for sliding movement within the central slot and preventing torque between the slider and the holster carrier; at least two sliding element fasteners configured for joining the slider to the holster carrier; a leaf spring attached to the carrier sled and having first and second ends configured to be selectively engageable with and disengageable with the pairs of diametrically opposed slots, wherein the leaf spring is configured to be disposed between the rear face of the column portion and the user; and a detent recess disposed near each end of the leaf spring and configured to be engageable with a detent projection disposed in each recess or slot; wherein the holster support assembly further comprises a backing plate attached to the rear face of the belt engaging member and configured for encapsulating the carrier sled.

In embodiments, the front face of the column portion further includes at least one pair of parallel rails, wherein the at least one pair of parallel rails is disposed parallel to and on opposite sides of the central slot wherein the at least one pair of rails is configured for providing clearance for sand or other debris between the front face of the column portion and the rear face of the holster carrier.

In embodiments, a first one of the at least two sliding element fasteners extends through a first one of the sliding elements within the central slot, through the spacer block and engages a T-nut disposed in a central recess of the spacer block, and a second one of the at least two sliding element fasteners extends through a second one of the sliding elements within the central slot, through the spacer block and engages the holster.

In embodiments, a finger tray on each end of the leaf spring is configured to deflect the ends of the leaf spring to lock and unlock the detent recesses or holes from the detent projections to adjust the holster vertically to a desired location.

In embodiments, the finger trays are each configured to extend beyond respective sides of the backing plate such that they are not encapsulated by the backing plate encapsulating carrier sled.

In embodiments, the at least one fastener extending between the slider and the holster carrier includes at least two fasteners each having a fastener head; wherein the backing plate comprises a front face comprising a central groove configured to provide clearance for the fastener heads when the at least one fastener moves within the central slot.

In embodiments, the backing plate further includes at least one ramped rib on the front face on either side of the central groove.

In embodiments, the at least one ramped rib on the front face on either side of the central groove is provided, wherein each ramped rib is sloped such that each ramped rib forms a sloped surface configured to slope away from the central groove and comprising an inner edge having a forwardly measured thickness greater than a forwardly measured thickness of an outer edge of the ramped rib, the ramped ribs are configured to prevent user from over bending and yielding the leaf spring.

In embodiments, each ramped rib includes a central groove.

In embodiments, the holster attachment portion further includes diametrically opposed ramps on the rear face of the belt engaging member on opposite sides of the central slot, wherein at least two the ramps on one side of the central slot define at least one of the slots there between, wherein each ramp forms a sloped surface comprising an inner edge having a rearwardly measured thickness less than a rearwardly measured thickness of an outer edge of the ramp.

In embodiments, the plurality of pairs of diametrically opposed slots includes three pairs of diametrically opposed slots.

In embodiments, the at least one sliding element is configured to slide within the central slot only when both finger trays on the leaf spring are depressed away from the holster to deflect the ends of the leaf spring away from the slots.

In embodiments, the sloped surfaces of the ramps and ramped ribs provide clearance for the ends of the leaf spring when the ends are deflected away from the slots and the at least one sliding element is slid within the central slot.

In embodiments, the leaf spring is configured to auto-lock the slider relative to the belt engaging member upon release of the finger trays when aligned with one of the pairs of diametrically opposed slots.

In embodiments, at least two fasteners engaging upper portions of belt loops and an upper portion of belt engaging member, and at least two fasteners engaging lower portions of belt loops a middle portion of belt engaging member and an upper portion of the backing plate and, wherein the holster carrier further comprises at least one aperture configured for receiving at least one threaded fastener for attachment to the holster body.

In embodiments, the a front face and the rear face of the holster carrier define a holster carrier depth; wherein the holster is offset from the belt engaging member a distance equal to the holster carrier depth; wherein the slider does not contribute to the offset.

In embodiments, the holster carrier includes a rear holster carrier member and a forward carrier member; wherein the rear carrier member is configured to be mounted to the slider; wherein the forward carrier member is configured to be mounted to the holster; and wherein the forward holster carrier member is configured to be rotatable relative to the rear carrier member to adjust the cant of the holster.

In embodiments, the central slot defines upper and lower limits of travel of the slider, wherein the lower limit of travel is further defined by a contoured stop projection extending rearwardly from the rear face of the belt engaging member.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 29A and 28B are perspective views showing an assembly including a hood assembly and a thumb receiving tab.

In FIG. 32C, the U-shaped shroud, the bracket and the finger receiving tab are shown from a different viewpoint.

FIG. 35A is a front view of the belt engaging member shown in FIGS. 34A and 34B.

FIG. 35B is a right side view of the belt engaging member shown in FIGS. 34A and 34B.

FIG. 35C is a top view of the belt engaging member shown in FIGS. 34A and 34B.

FIG. 39A is a front view of the holster shown in FIGS. 38A and 38B.

FIG. 39B is a right side view of the holster shown in FIGS. 38A and 38B.

FIG. 39C is a top view of the holster shown in FIGS. 38A and 38B.

Figure 1:
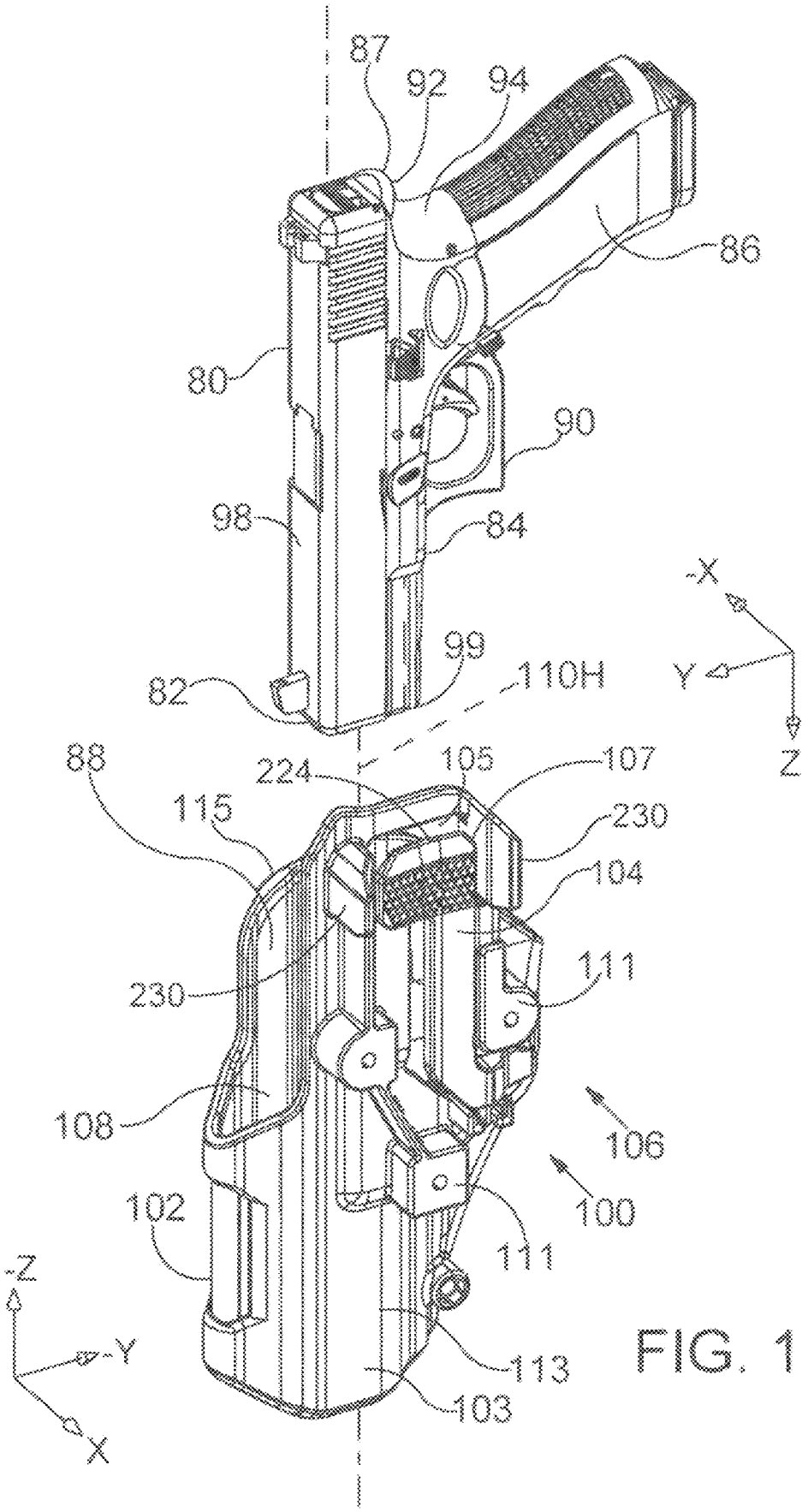
FIG. 1 is a perspective view showing a handgun and a holster in accordance with the detailed description.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
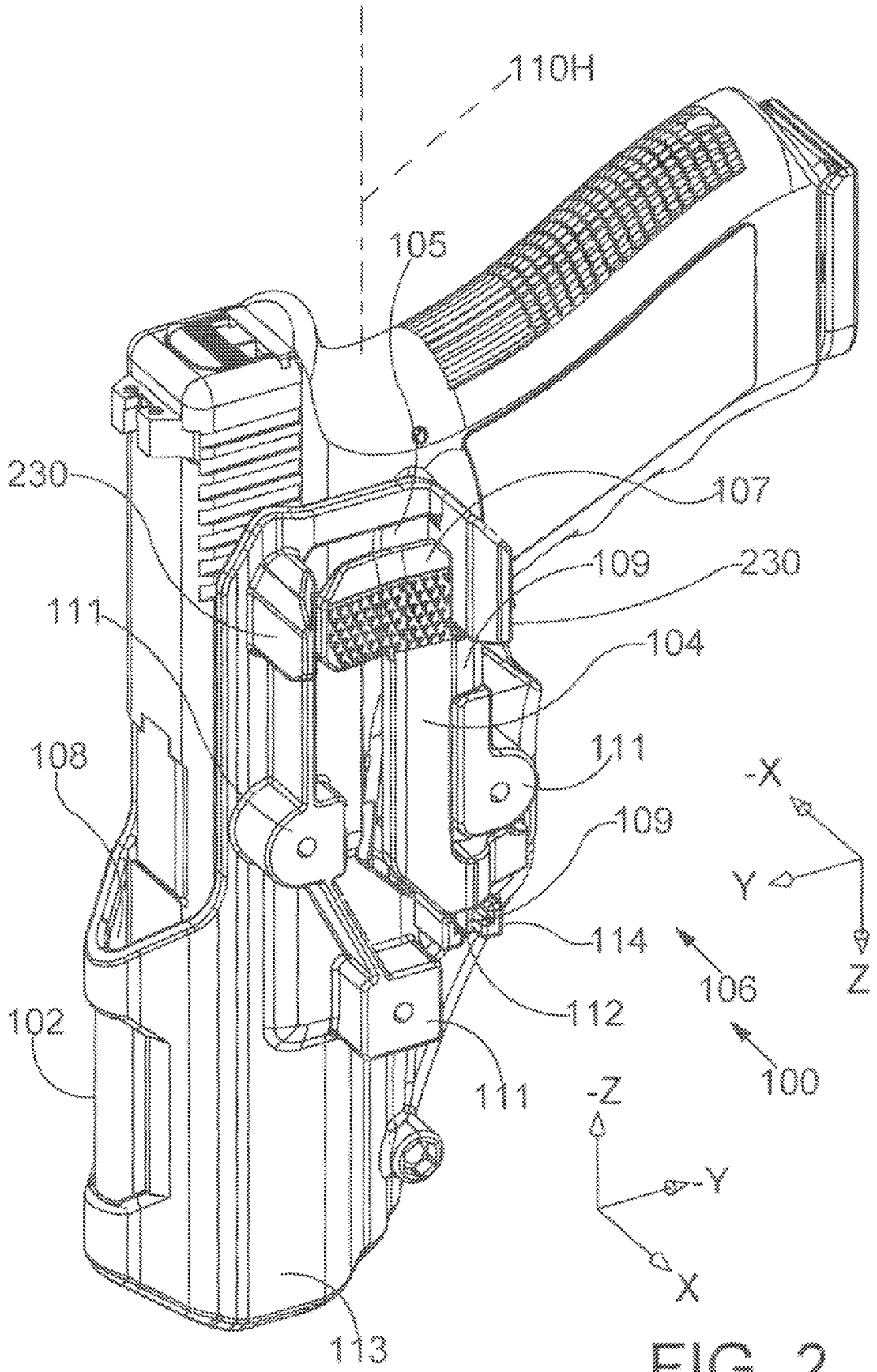
FIG. 2 is a perspective view showing a handgun and a holster in accordance with the detailed description.

Referring to FIGS. 1-4, perspective views of a handgun 80 and a holster 100 are shown. FIG. 1 shows the handgun 80 withdrawn from the holster 100 and FIG. 2 shows the handgun inserted into the holster 100. The handgun being conventional and having a forward end 82, a handgun body 84, a grip 86 at a rearward end 87 of the handgun 80, a trigger guard 90, a back strap 92 with a backstrap recess 94, a slide 98 positioned above the handgun body, and a rail 99 positioned below the slide. In embodiments, the holster 100 for receiving and withdrawing the handgun having a trigger guard 90 comprises a polymer holster body 102, an elongate polymer pivoting lever 104 that is part of a first handgun retention mechanism 106 that is thumb actuated. The pivoting lever has an actuation tab 107 configured as by a thumb receiving button that is disposed in an opening 105 in the holster body, actuation of the thumb receiving button moves a trigger guard block portion 128 of the lever between retention and release positions. The retention mechanism 106 has two distinct separated pivoting connections 109 each formed from a pair of cooperating connector pivot portions 110, one of each pair unitary with the holster body and the other of each pair unitary with the lever. In embodiments, the pivot portions 110 of the lever 104 and pivot portions 110 of the holster body 102 are coupled using a simple assembly process with no separate hinge pin.

Figure 12:
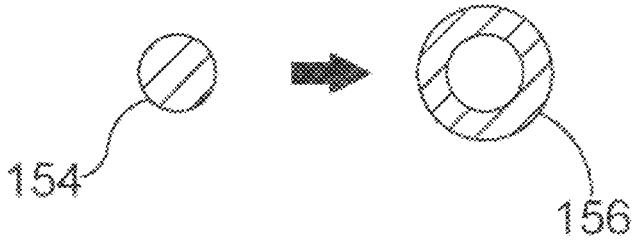
FIG. 12 is a stylized cross-sectional view showing a pin and a pin receiving portion.
Figure 13:
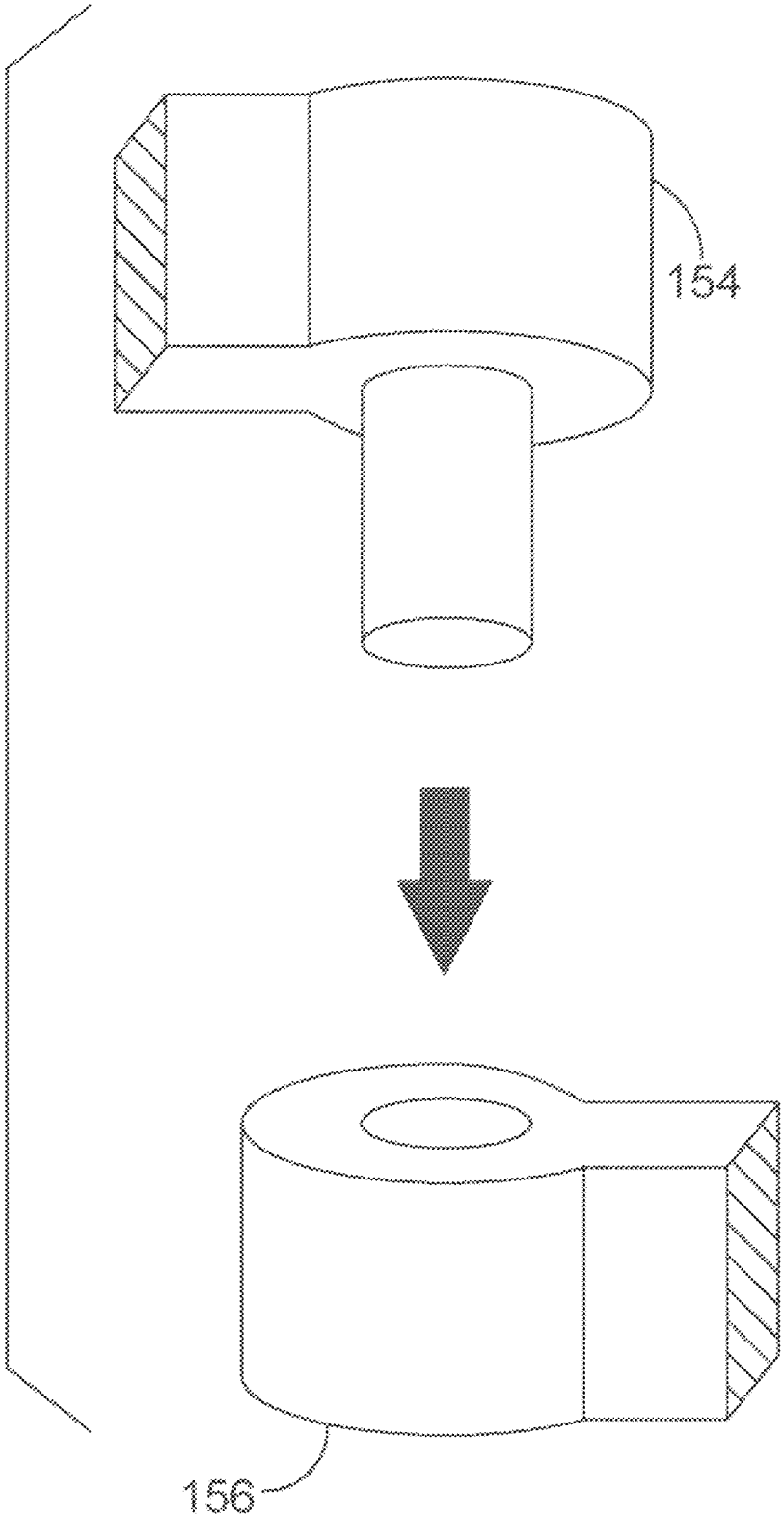
FIG. 13 is a perspective view showing a pin and a pin receiving portion.

The holster body has three unitary bosses 111 on a proximal wall portion 113 for attachment to a plate portion of a user attachment means, such as a belt engaging member. See FIGS. 12 and 13. The holster having a proximal side toward and holster body having a proximal Continuing to referring to FIGS. 1-4, in embodiments, the holster body 102 has a plurality of holster wall portions defining a cavity 108 extending along a handgun receiving and withdrawal axis 110H. In embodiments, the retention mechanism 106 comprises a lever 104 pivotally supported by the holster body 102 and retained by holster attachment plate portion 165 or by other means. The lever 104 may comprise an elongate central portion 124 integrally formed with a first forward pivot portion 112 and the holster body 102 may comprises a second forward pivot portion 114 integrally formed with one of the holster wall portions. The first forward pivot portion 112 may mate with the second forward pivot portion 114 to form a forward pivoting connection 109. In embodiments, the lever 104 further comprises a first rearward pivot portion 116 integrally formed with the elongate central portion 124 of the lever 104 and the holster body 102 comprises a second rearward pivot portion 118 integrally formed with one of the holster wall portions. The first rearward pivot portion 116 may mate with the second rearward pivot portion 118 to form a rearward pivoting connection 109. In embodiments all pivot portions of the retention mechanism are axially aligned and co-axial when assembled.

Continuing to referring to FIGS. 1-4, in embodiments, is a retention mechanism having a lever that can be pivoted with little tension in the muscles and tendons of the forearm and thumb while the forearm is extending in a downward direction and the thumb is contacting the a thumb button portion of the lever. In embodiments, the retaining mechanism comprises a lever having a thumb button portion, and the lever pivots about an axis that is parallel to a handgun insertion and withdrawal axis of the holster. In embodiments, the retaining mechanism comprises a thumb-actuated button that pivots about a first axis and a lever that pivots about a second axis that is parallel to the first axis.

Referring to FIGS. 5-8B, in embodiments, the lever 104 of the retention mechanism 106 has an elongate central portion 124, a thumb receiving portion 107, configured as a thumb button, and a blocking portion 108. The thumb receiving portion of the lever comprising a first arm 130 extending away from the elongate central portion 124 in a first direction, the elongate central portion 124 and the first arm 130 cooperating to form a first L-shaped portion 132. The blocking portion 128 of the lever 104 comprises a second arm 134 extending away from the elongate central portion 124 in a second direction opposite the first direction, the elongate central portion 124 and the second arm 134 cooperating to form a second L-shaped portion 136.

Figure 6:
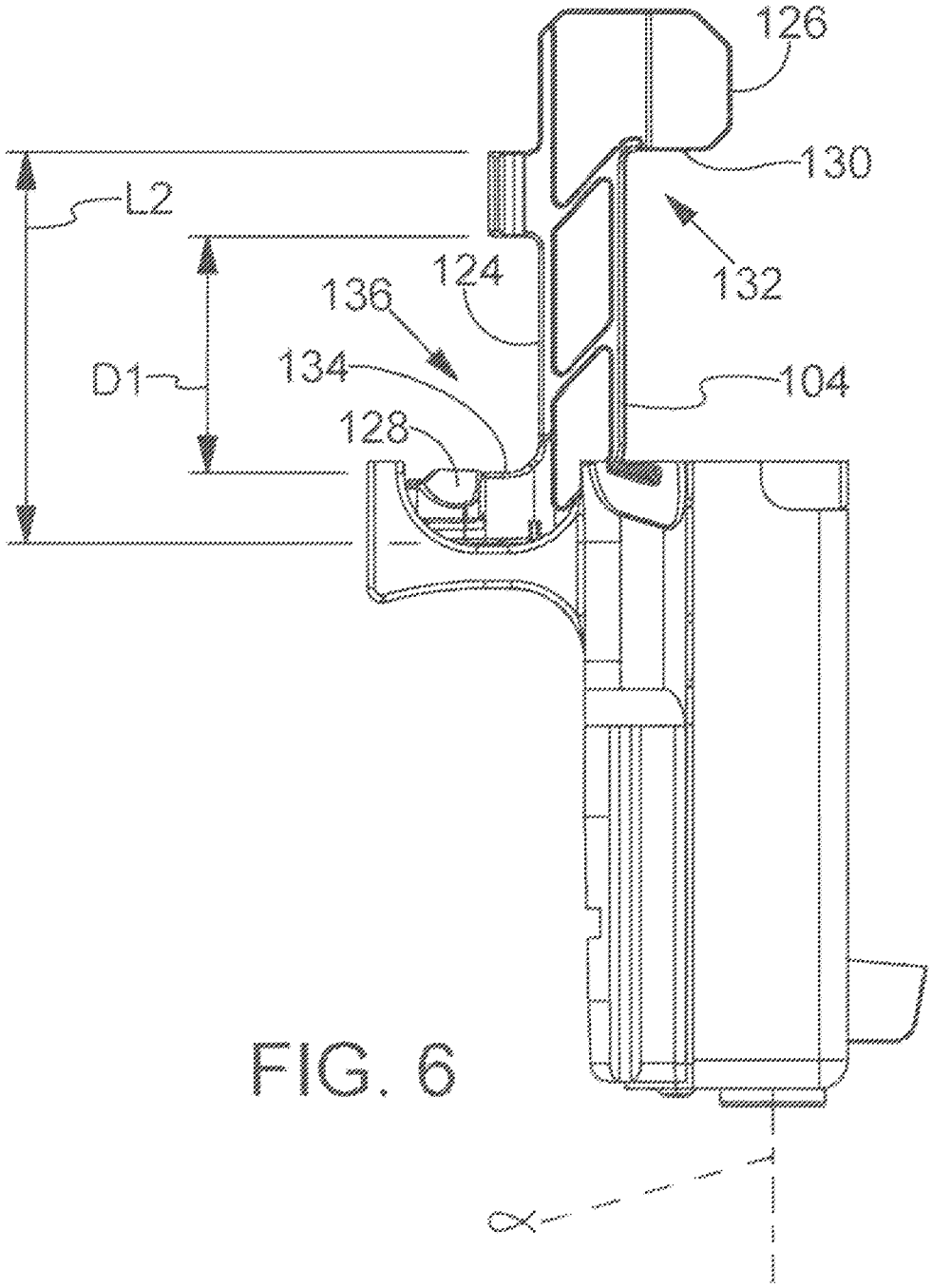
FIG. 6 is a perspective view of an assembly including a lever and a handgun having a trigger guard. The handgun is cross-sectioned for purposes of illustration in FIG. 6.
Figure 7:
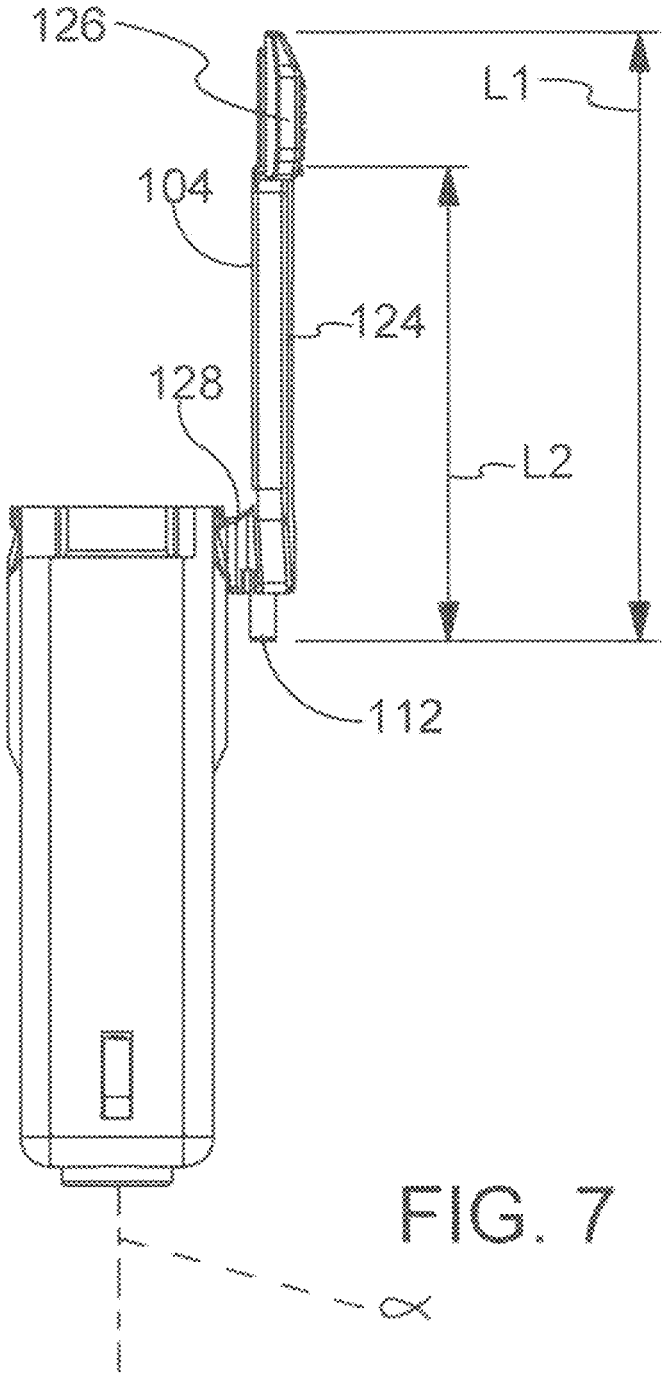
FIG. 7 is a perspective view of an assembly including a lever and a handgun having a trigger guard. The handgun is cross-sectioned for purposes of illustration in FIG. 7.
Figure 8A:
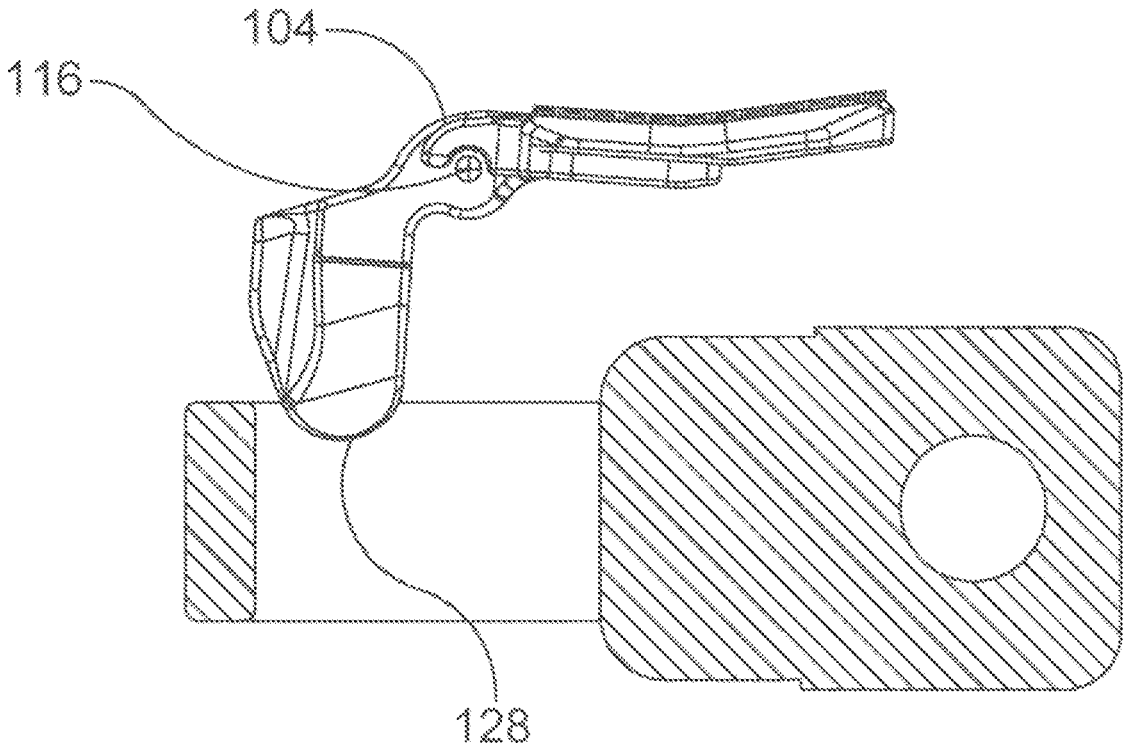
FIGS. 8A and 8B are plan views of an assembly including a lever and a handgun having a trigger guard. The handgun is cross-sectioned for purposes of illustration in FIGS. 8A and 8B.
Figure 8B:
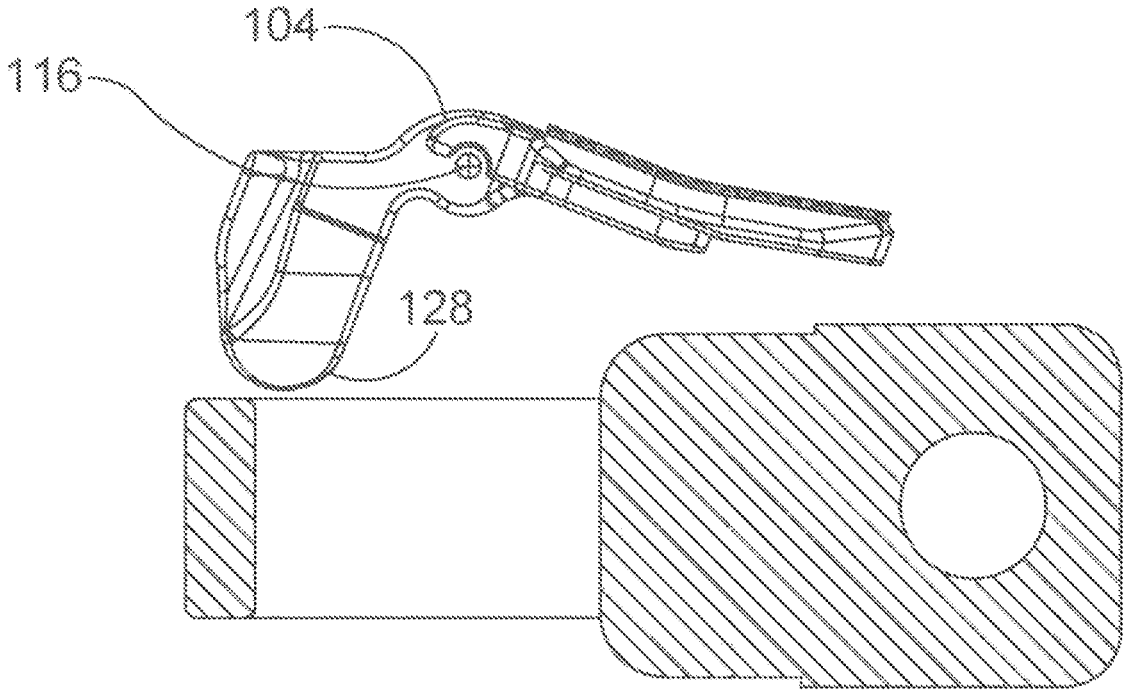

Referring to FIGS. 6 and 7, the lever 104 is elongate in the direction of the axis X and has a lever length L1. The pivot portions 112, 116 have a separation distance D1 and have a pivoting connection length L2. The pivoting connection length L2 to the overall lever length L1 is in embodiments greater than 0.70 or 70%; in embodiments, greater than 0.60 or 60%; in embodiments greater than 0.80 or 80%.

Referring to FIGS. 1 and 2, a forward or handgun insertion direction Z and a rearward or handgun withdrawal direction −Z are illustrated using arrows labeled "Z" and "−Z," respectively. An upward direction Y and a downward direction −Y are illustrated using arrows labeled "Y" and "−Y," respectively. A direction X extending away from the user's body and the user attachment side of the holster is illustrated using an arrow labeled "X." A direction −X extending toward the user's body and the user attachment side of the holster is illustrated using an arrow labeled "−X." The directions illustrated using these arrows may be conceptualized, by way of example and not limitation, from the point of view of a user who is wearing a holster hung from a service belt and inserting a handgun into the holster. The directions illustrated using these arrows may also be conceptualized, by way of example and not limitation, from the point of view of a user holding a handgun in a normal firing position and viewing the gunsights of the handgun. The directions illustrated using these arrows may be applied to the apparatus shown and discussed throughout this application. In embodiments, the Z direction and the −Z direction are both generally orthogonal to the XY plane defined by the X direction and the Y direction. In embodiments, the X direction and the −X direction are both generally orthogonal to the ZY plane defined by the Z direction and the −Z direction. In embodiments, the Y direction and the −Y direction are both generally orthogonal to the ZX plane defined by the Z direction and the X direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "rearwardly," etc. should not be interpreted to limit the scope of the invention recited in the attached claims.

Figure 9:
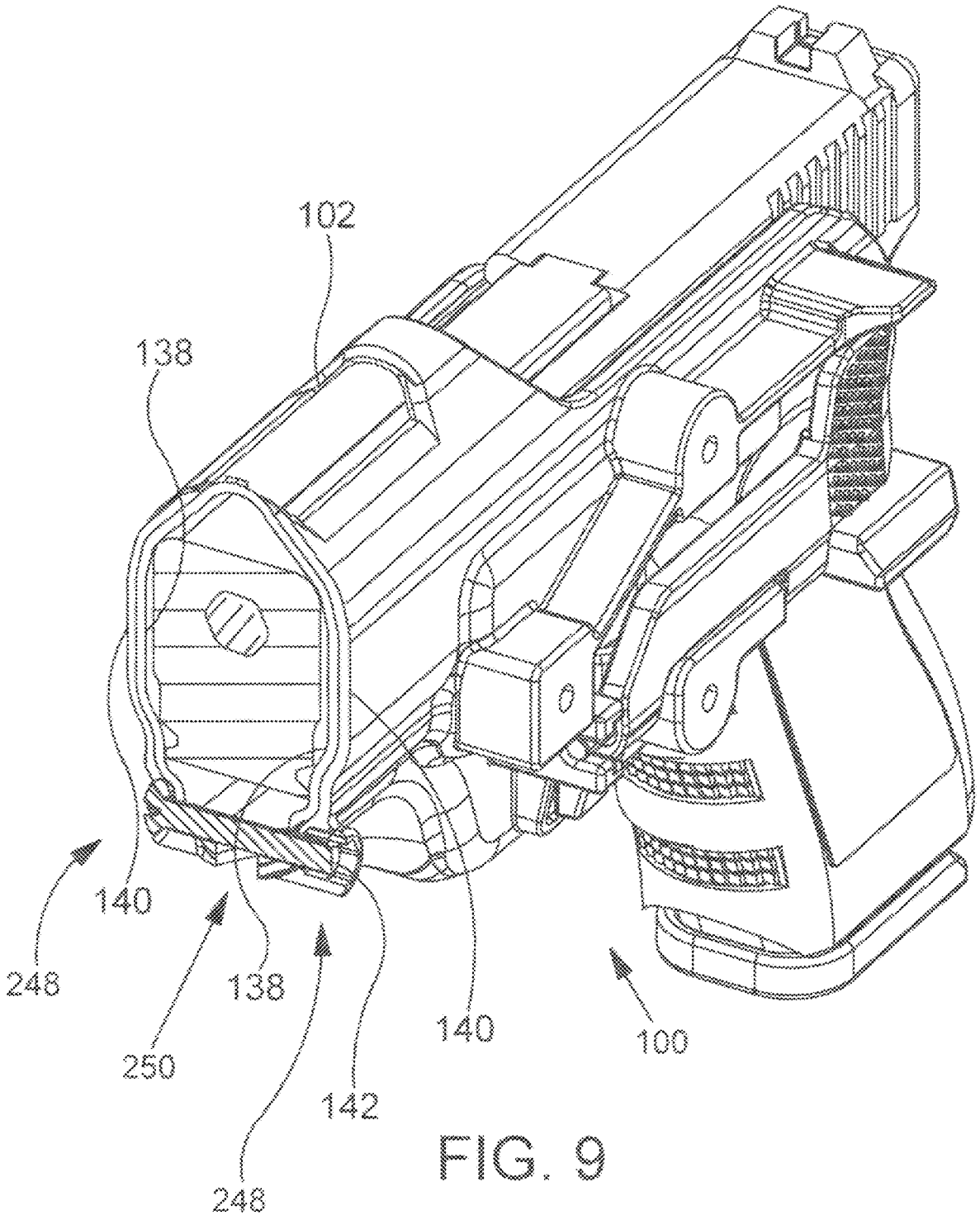
FIG. 9 is a cross-sectioned perspective view of an assembly including a holster and a handgun having a trigger guard. The holster and the handgun are cross-sectioned for purposes of illustration in FIG. 9.

Referring to FIG. 9, a cross-sectioned perspective view of a holster body 102 is shown. In the example embodiment of FIG. 9, the holster body 102 is formed from two polymers, one overmolded onto the other, providing an interior layer 138 and an exterior layer 140. In embodiments, the interior layer 138 is softer than the exterior layer 140 minimizing any wear, damage or markings on the exterior surface of the handgun that is received in the cavity 108 defined by the holster. In embodiments, the interior layer 138 and the exterior layer 140 are combined using an assembly process. In embodiments, the interior layer 138 comprises a thermoplastic elastomer (TPE) and the exterior layer 140 a thermoplastic material. In embodiments, the interior layer 138 comprises Hytrel® polymer, available from DuPont, and the exterior layer 140 comprises nylon. The exterior layer being harder and stiffer than the interior layer.

Figure 10:
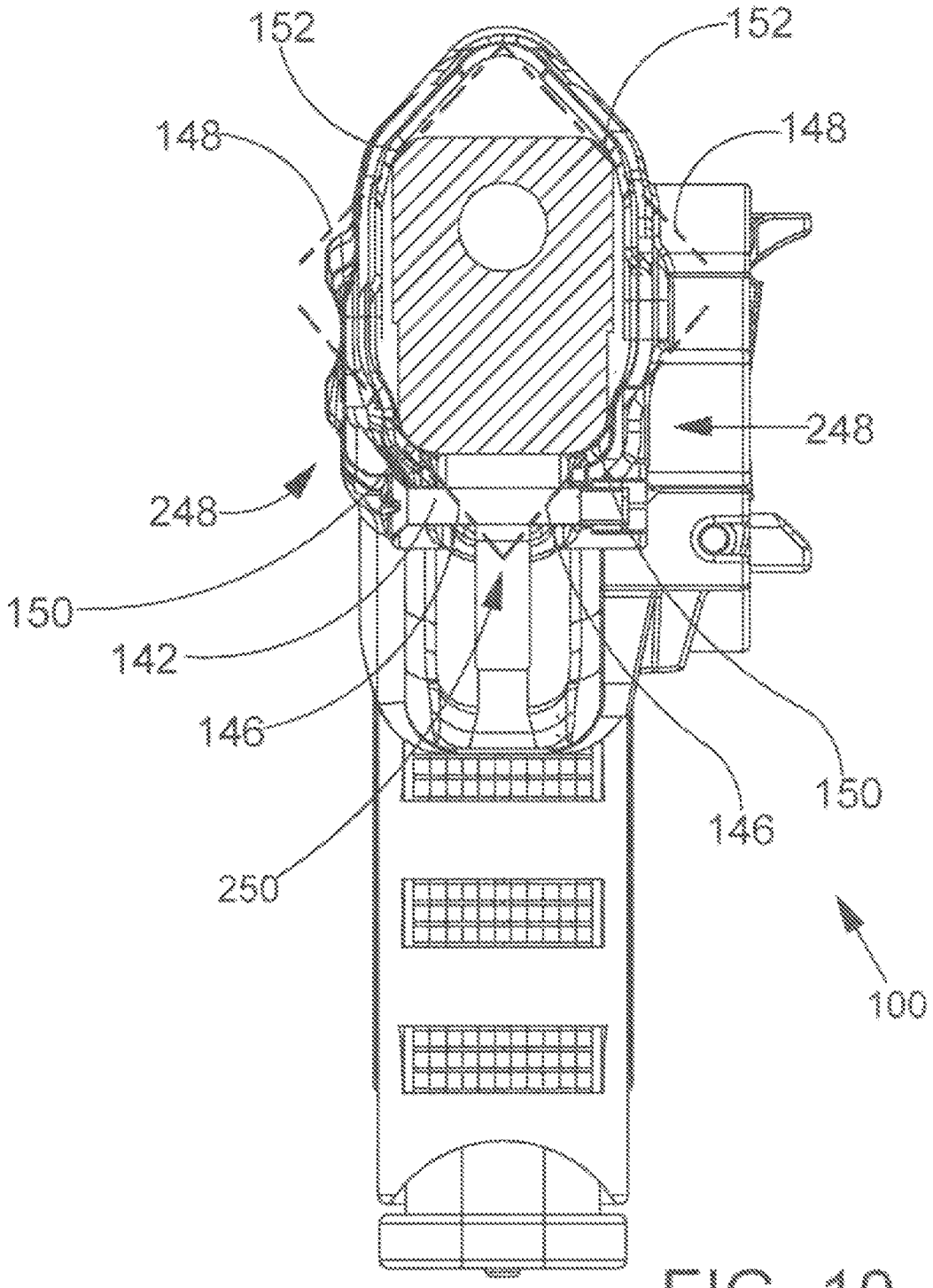
FIG. 10 is a plan view of an assembly including a holster and a handgun having a trigger guard. The holster and the handgun are cross-sectioned for purposes of illustration in FIG. 10.
Figure 11A:
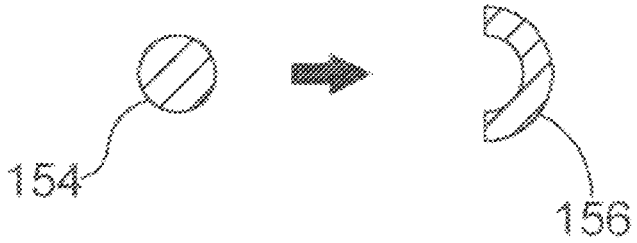
FIGS. 11A-11C are stylized cross-sectional views each showing a pin and a pin receiving portion.
Figure 11B:
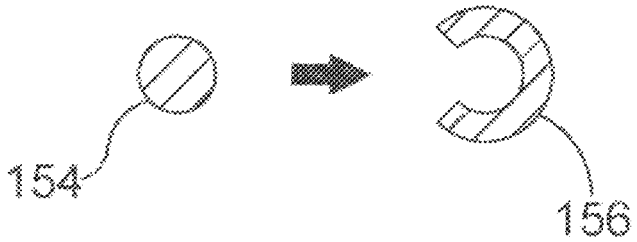
Figure 11C:
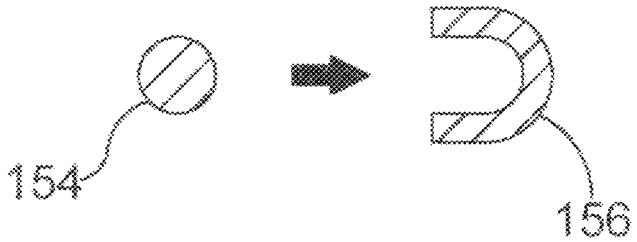

Referring to FIG. 10, a cross-sectional view of a holster body 102 is shown. In embodiments, the holster body 102 is formed to provide a handgun fitting function that can be adjusted by rotating a tensioning screw 142. The shape of the forward portion of the handgun can be conceptualized as a four cornered geometric figure, roughly a rectangle, and the shape of the cavity 108 defined by the holster body 102 can be configured to make point contact with the four corners of the figure or rectangle. In embodiments, the shape of the cavity 108 defined by the holster body 102 can be conceptualized as two opposing V-shapes, an upper V-shape 148 and a lower V-shape 146. The upper V-shape 148 and the lower V-shape 146 are shown using dashed lines in FIG. 10. The two legs of the upper V-shape 148 and the two legs of the lower V-shape 146 may each contact one corner of the figure or rectangle. In embodiments, the lower V-shape 146 defines a slot 144 near the lower end of the lower V-shape 146. A tensioning screw 142 is positioned to selectively decrease the angle between the two legs of the lower V-shape 146. As the angle between the two legs of the lower V-shape 146 decreases, the two legs of the lower V-shape 146 apply upwardly directed component forces to two lower corners 150 of the rectangle. The forces applied to the lower corners 150 of the rectangle urge the two upper corners 152 of the rectangle against the two legs of the upper V-shape 148.

The components herein may be formed of thermoplastic polymers using an injection molding process.

Referring to FIGS. 3, 4 and 11A-11C, a retention mechanism 106 for a holster 100 may include a lever pivotally supported by the holster body 102. The lever 104 may comprise an elongate central portion 124 integrally formed with a first forward pivot portion 112, and the holster body 102 may comprise a second forward pivot portion 114 integrally formed with a wall portion of the holster body 102. The first forward pivot portion 112 may be mated with the second forward pivot portion so that the lever 104 is pivotally supported by the holster body 102. In embodiments, one of the forward pivot portions 112, 114 is a pin portion 154 and the other of the forward pivot portions 112, 114 is a C-shaped pin receiving portion 156. In embodiments, the C-shaped pin receiving portion 156 has a circumferential span less than or equal to 180 degrees. In embodiments, the C-shaped pin receiving portion 156 has a circumferential span greater than 180 degrees; in embodiments greater than 185°; and in embodiments greater than 190°. In embodiments, one of the forward pivot portions 112, 114 is a pin portion 154 and the other of the forward pivot portions 112, 114 is a U-shaped pin receiving portion 158.

With continuing reference to FIGS. 3, 4 and 11A-11C, the lever 104 may further comprise a first rearward pivot portion 116 integrally formed with the elongate central portion 124 and the holster body 102 may comprise a second rearward pivot portion 118 integrally formed with a wall portion of the holster body 102. The first rearward pivot portion 116 may be mated with the second rearward pivot portion so that the lever 104 is pivotally supported by the holster body 102. In embodiments, one of the rearward pivot portions 116, 118 is a pin portion 154 and the other of the rearward pivot portions 116, 118 is a C-shaped pin receiving portion 156. In embodiments, the C-shaped pin receiving portion 156 has a circumferential span less than or equal to 180 degrees. In embodiments, the C-shaped pin receiving portion 156 has a circumferential span greater than 180 degrees; in embodiments greater than 185°; and in embodiments greater than 190°. In embodiments, one of the rearward pivot portions 116, 118 is a pin portion 154 and the other of the rearward pivot portions 116, 118 is a U-shaped pin receiving portion 158.

Figure 3A:
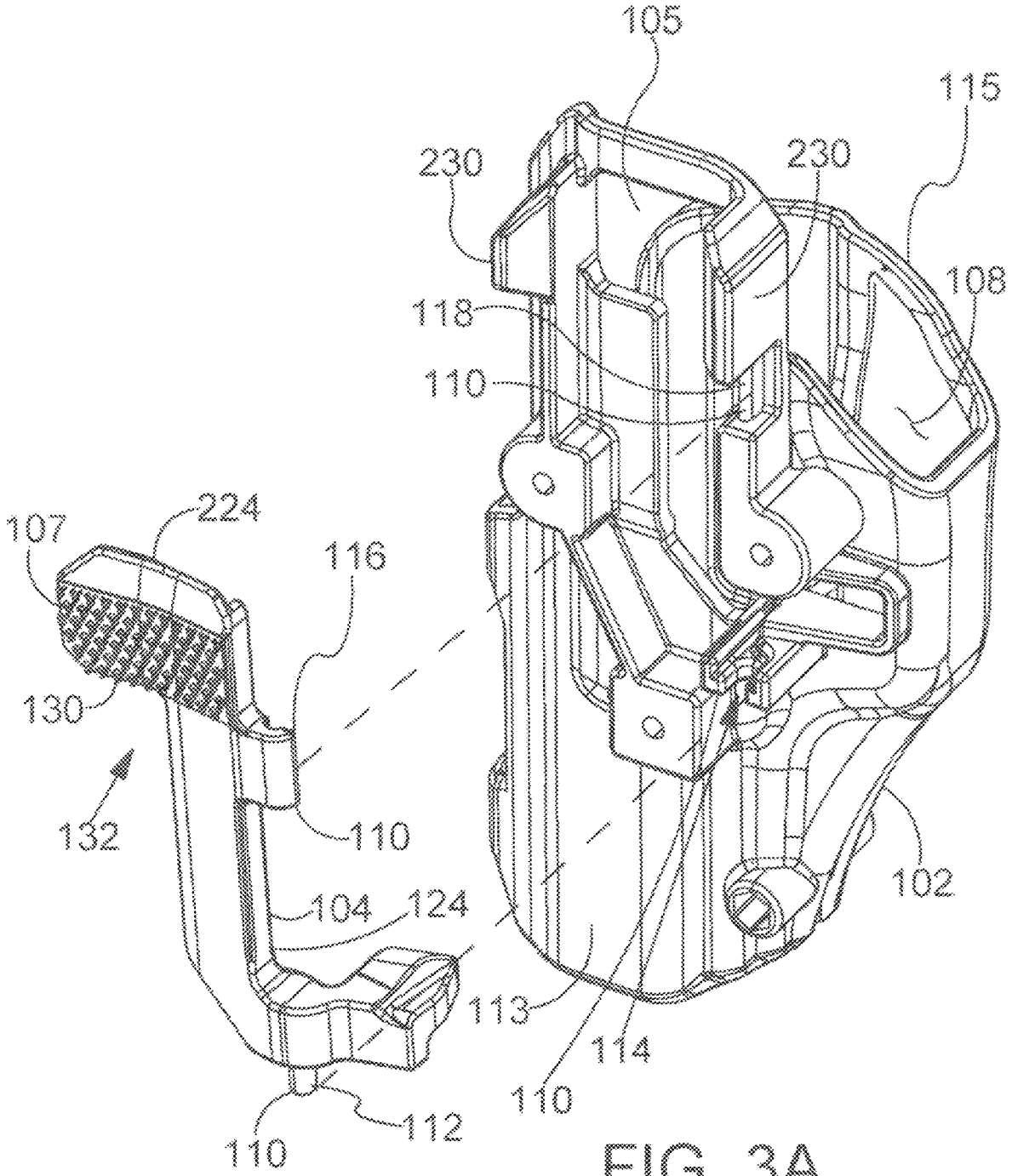
FIG. 3A is an exploded perspective view showing a holster body and a lever.
Figure 3B:
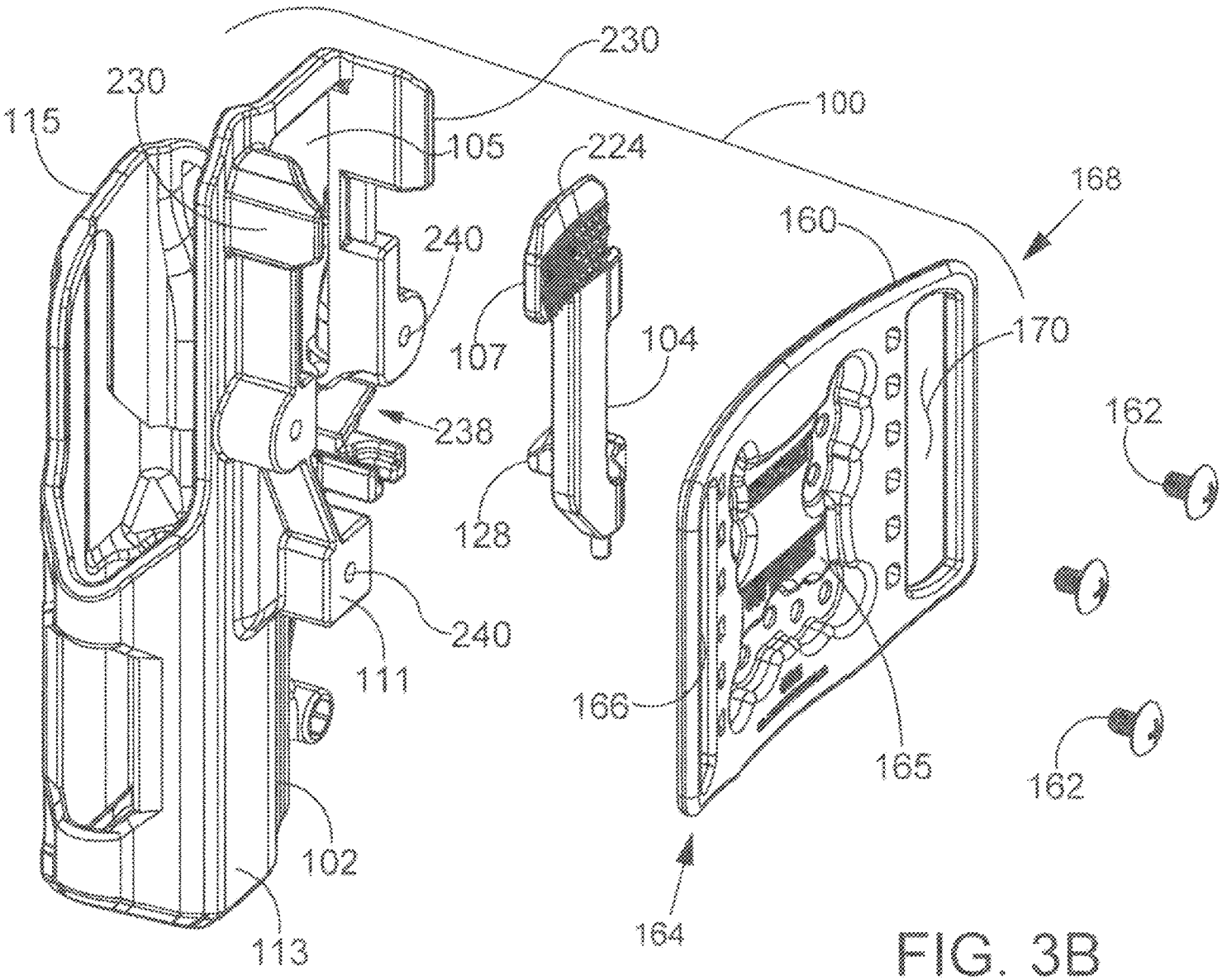
FIG. 3B is an exploded perspective view showing a belt receiving member, a holster body and a lever.
Figure 3C:
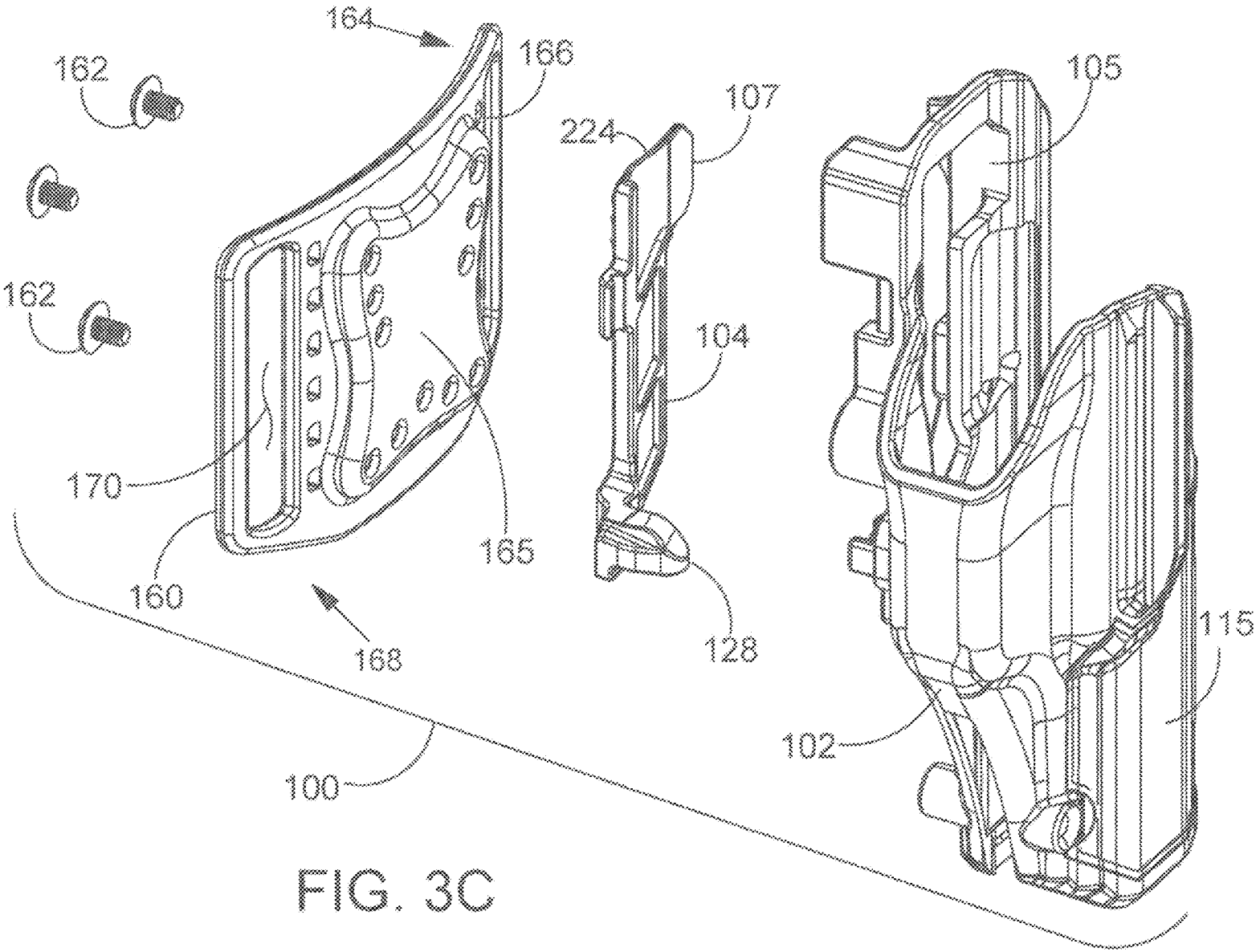
FIG. 3C is an exploded perspective view showing a belt receiving member, a holster body and a lever.
Figure 4:
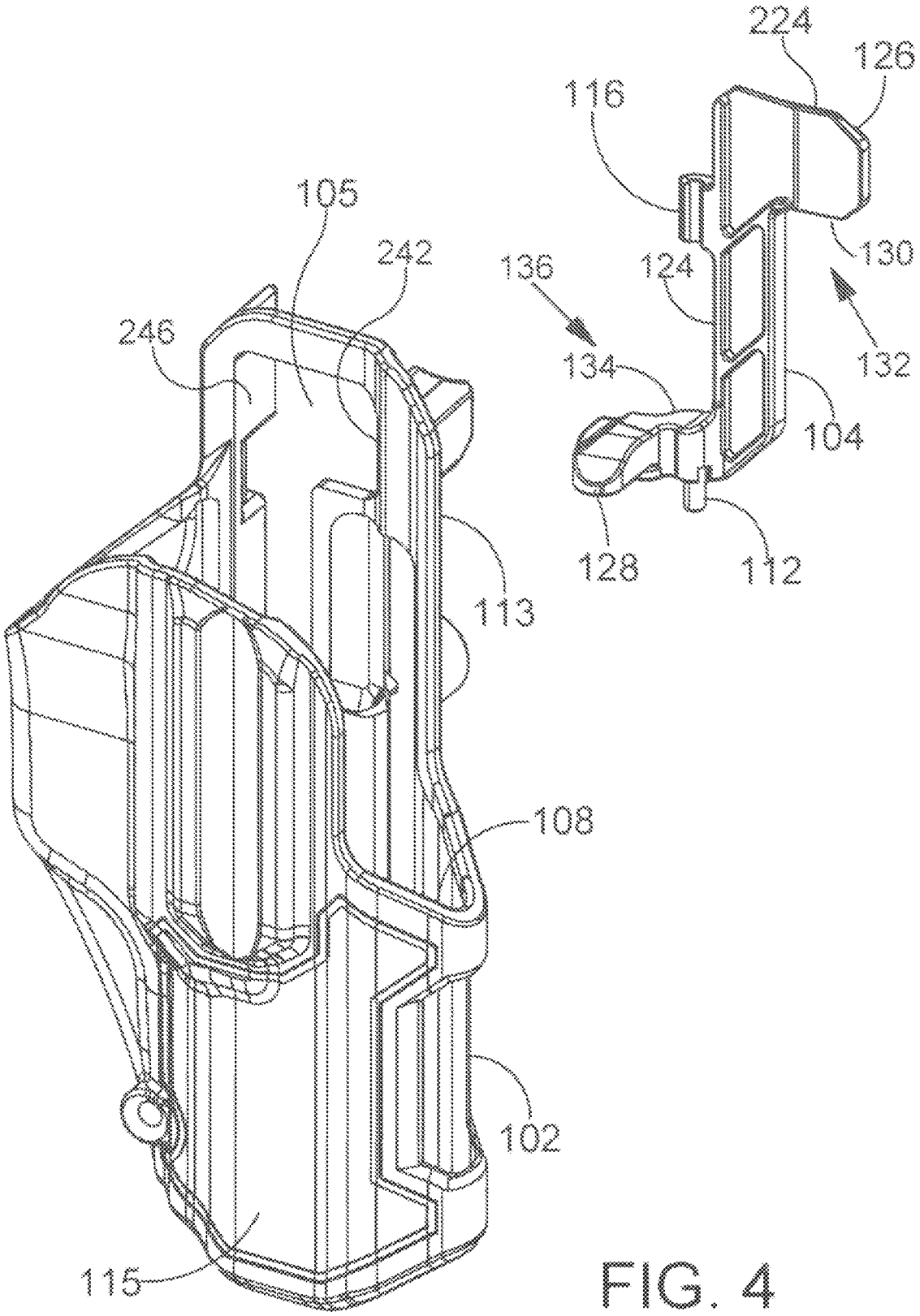
FIG. 4 is an exploded perspective view showing a holster body and a lever.
Figure 5:
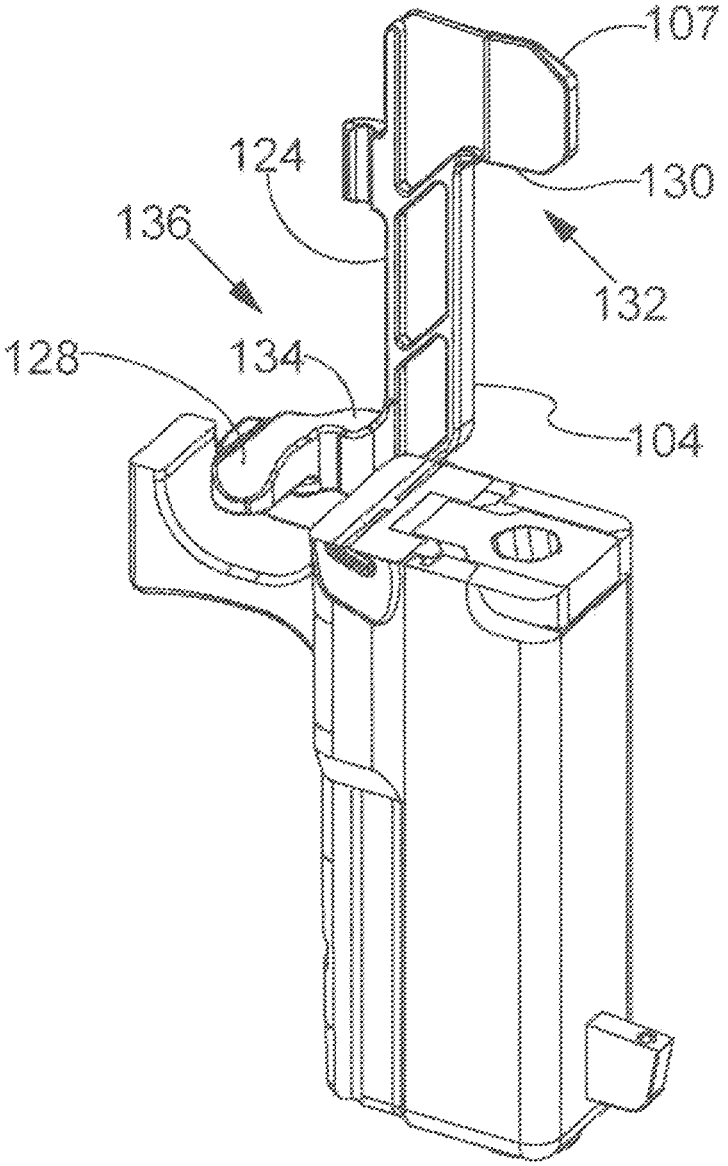
FIG. 5 is a perspective view of an assembly including a lever and a handgun having a trigger guard. The handgun is cross-sectioned for purposes of illustration in FIG. 5.

Referring to FIGS. 3B and 3C, a holster 100 in accordance with this detailed description may comprise a holster attachment plate portion 165 that is part of or all of a user attachment means for the holster which may be a belt engaging member. The plate portion 165 may retain the lever 104 in a pivoting connection arrangement with the holster body 102. The lever 104 may be pivotally supported by the holster body 102 and may be moveable between a handgun trigger guard capture position and a handgun trigger guard release position. In embodiments, the plate portion 165 is fixed to the holster body 102 by a plurality of screws 162. The lever 104, may be, for example, captured between the belt engaging member 160, or other user attachment means, and the holster body 102. In embodiments, the lever 104 can be freely separated from the holster body 102 after the belt engaging member 160 is removed from the holster body 102. In embodiments, the belt engaging member 160 comprises a first belt loop portion 164 defining a first passageway 166 to receive a belt and a second belt loop portion 168 defining a second passageway 170 for receiving the belt.

The user attachment means 160 may comprise various holster supporting devices without deviating from the spirit and scope of this detailed description. Examples of holster supporting devices that may be suitable in some applications are disclosed in the following United States patents all of which are hereby incorporated by reference herein: U.S. D653848, U.S. D567707, U.S. D508318, U.S. Pat. Nos. 9,134,093, 8,783,532, 8,517,234, 8,469,245, 8,297,562, 8,251,266, 8,235,263, 7,866,515, 7,320,420, 9,423,210, 9,664,480, 9,841,255, 9,222,751, 8,544,706, 8,215,525, 8,100,304, 7,971,762, 7,922,050, 7,690,541, 6,478,202, 6,189,751, and 5,467,909.

Referring to FIGS. 14-17, in embodiments, a holster 100 has a first handgun retention mechanism 106' that engages the trigger guard as previously described with respect to FIGS. 1-13, and a second handgun retention mechanism 106' with a pivoting lever 104'. A dual actuation member 179 with a thumb button 180 actuates both the first handgun retention mechanism 106' and the second handgun retention mechanism 174. In embodiments, each handgun retention mechanism selectively prevents the handgun 80 from being withdrawn from the cavity 108 defined by the wall portions 109 of the holster body 102.

The second handgun retention mechanism 106' comprises a slide retention member configured as a U-shaped shroud 176 that is pivotally supported by the holster body 102 so that the U-shaped shroud 176 selectively pivots between a handgun retaining position in which the U-shaped shroud 176 extends across a portion of a rearward opening 178 of the cavity 108 and a release position in which the U-shaped shroud 176 extends forward of the rearward opening 178 so that a withdrawal path of the handgun 80 is unobstructed. In embodiments, the U-shaped shroud 176 pivots about a shroud pivot axis 177 that extends laterally and is perpendicular to the handgun insertion and withdrawal axis.

Referring to FIGS. 15-20, in embodiments, the first handgun retention mechanism 106' comprises a lever 104' pivotally supported by the holster body 102. The lever 104' may be similarly configured to the lever 106 of FIGS. 1-13. In embodiments, the lever 104' has an elongate central portion 124, a depressible actuation portion 186, and a trigger guard blocking portion 128. The depressible actuation portion 186 of the lever 104 comprises a first arm 130 extending away from the elongate central portion 124 in a first direction so that the elongate central portion 124 and the first arm 130 cooperate to form a first L-shape 182. The trigger guard blocking portion 128 of the lever 104' comprises a second arm 134 extending away from the elongate central portion 124 in a second direction opposite the first direction so that the elongate central portion 124 and the second arm 134 cooperate to form a second L-shape 184. In embodiments, the lever 104' is pivotally supported by the holster body so that the lever 104' pivots about a lever axis 110 that extends in upward and downward directions as the holster is worn or forward and rearward with respect to the handgun. In embodiments, the lever pivots between a handgun trigger guard blocking or capture position and a handgun trigger guard non-blocking or release position. The trigger guard blocking portion 128 of the lever 104 extends into a trigger guard portion of the holster body 102 when the lever 104' is disposed in the handgun trigger guard capture position.

Continuing to referring to FIGS. 15-20, a feature and benefit of embodiments is a retention mechanism having a lever that can be pivoted with little tension in the muscles and tendons of the forearm and thumb while the forearm is extending in a downward direction and the thumb is used to rotate the lever. In embodiments, the retaining mechanism comprises a thumb-actuated button that pivots about a first axis and a lever that pivots about a second axis that is parallel to the first axis. In embodiments, the lever pivots about an axis that is parallel to a handgun insertion and withdrawal axis of the holster. In embodiments, the thumb-actuated button pivots about an axis that is parallel to a handgun insertion and withdrawal axis of the holster.

Referring to FIGS. 16-20, the second handgun retention mechanism is illustrated. The slide blocking member configured as a shroud 176 is part of a hood assembly 188. Fasteners 197, 198 pivotally secure the U-shaped shroud, second handgun retention mechanism housing 201, bracket 190 with slot 144, to the holster body. Fastener 199 secures the opposite side of the shroud to the holster body. The second handgun retention mechanism 174 utilizes the retention mechanism housing 201 to secure components of the retention mechanism in place. The housing has two cooperating components, and inward member 202 and an outward member 204 that may be arranged in a clamshell-like fashion that captures the leaf spring 194 and a pivoting shaft 206 of the dual actuation member 179 within the housing 201. In embodiments, the holster includes a spring 196 that biases the U-shaped shroud 176 to pivot toward the release position. In embodiments, the holster 100 includes the leaf spring 194 that is received in the slot 144 of the bracket 190 when the U-shaped shroud 176 is in the handgun retaining position. The base 195 of the leaf spring 194 is fixed with respect to the holster body and the tip 196 of the leaf spring 194 can flex inwardly and outwardly. The bracket 190 is attached to the U-shaped shroud 176 such that as the leaf spring 194 keeps the bracket from rotating forwardly it also keeps the shroud from rotating forwardly. In embodiments, rotation of the thumb receiving tab or button 180 through a first range of rotary motion causes deflection of the leaf spring 194 so that a distal portion of the leaf spring 194 moves outside of the slot 144 allowing the bracket 190 and also the shroud 176 to rotate forwardly. In embodiments, rotation of the thumb button 180 through a second range of rotary motion causes the thumb button 180 to engage the depressible actuation portion 186 of the lever 104 causing at least part of the trigger guard blocking portion 128 of the lever to be withdrawn from the trigger guard receiving portion of the holster body 102. In this embodiment, the thumb receiving portion of the lever 104 of the embodiment of FIGS. 1-4 has been replaced with an actuation portion or depressible portion that is depressed by the inner side of the thumb receiving tab 180.

The first and second active handgun retention mechanisms may be arranged such that the second and first mechanisms can actuate sequentially or simultaneously, in embodiments.

Figure 14:
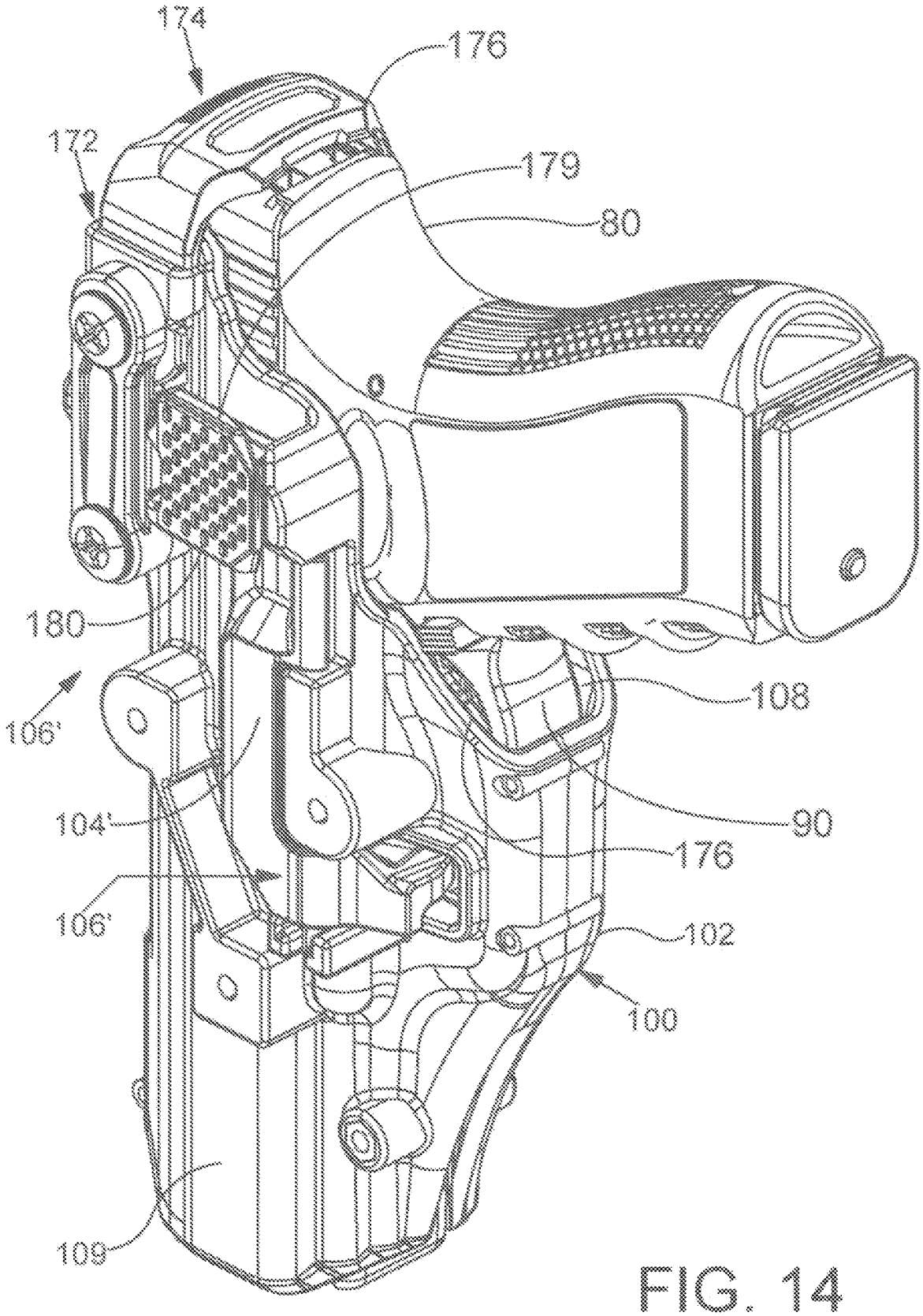
FIG. 14 is a perspective view showing a handgun and a holster in accordance with the detailed description.
Figure 15:
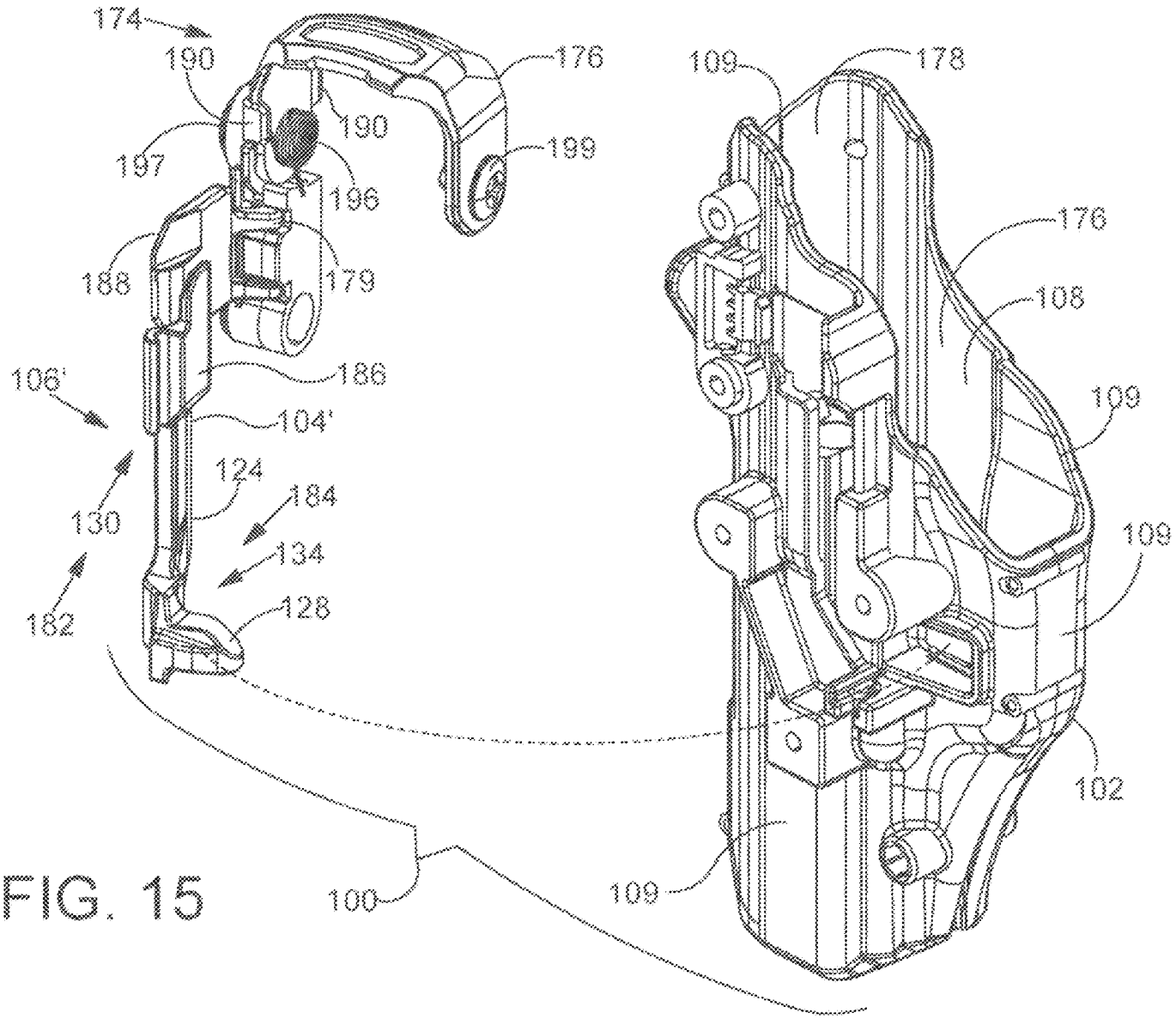
FIG. 15 is an exploded perspective view showing a holster body and two active handgun retention mechanisms operated by a single thumb button.
Figure 16:
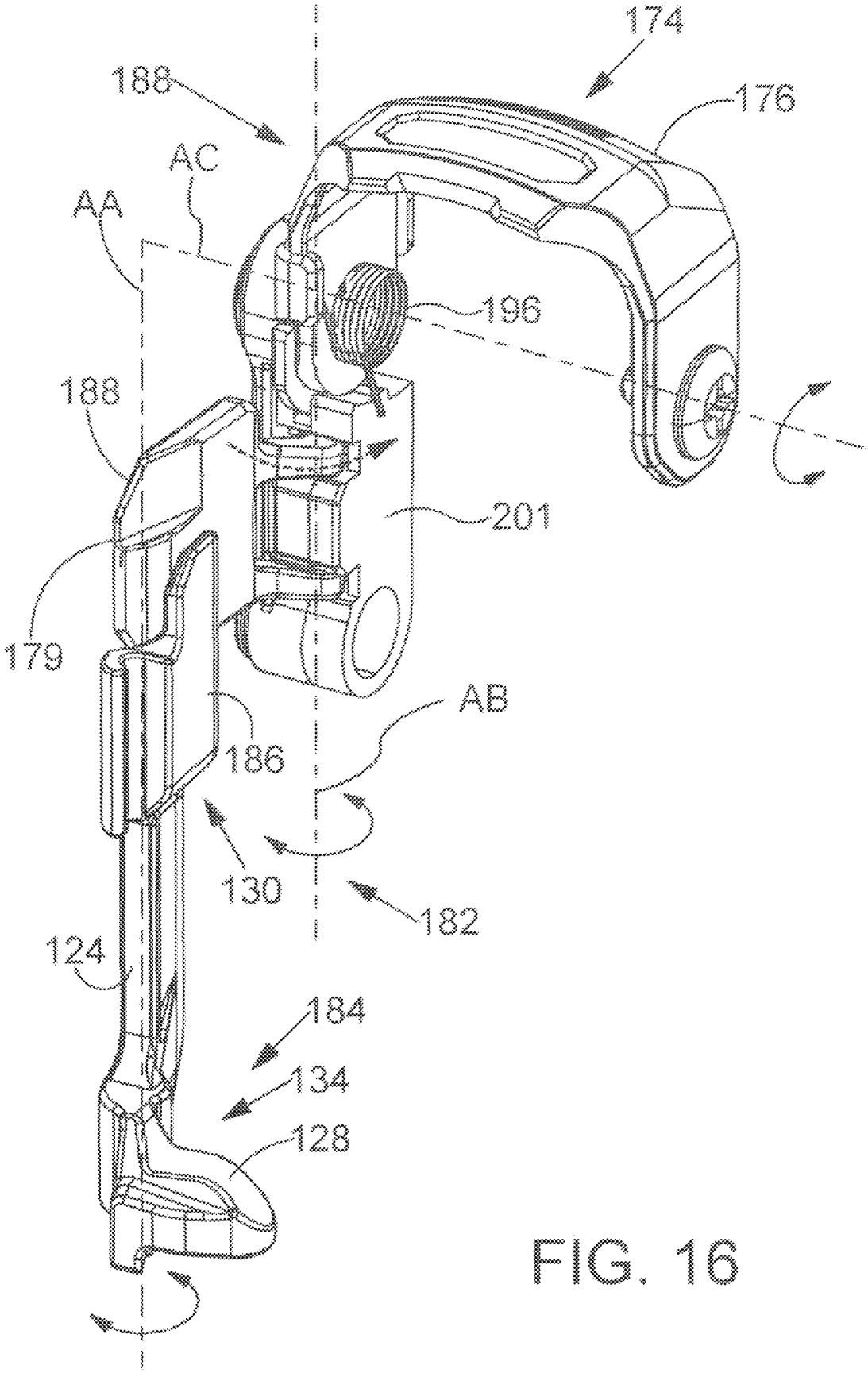
FIG. 16 is a perspective view showing retention mechanisms seen in the exploded perspective view of FIG. 15.
Figure 17:
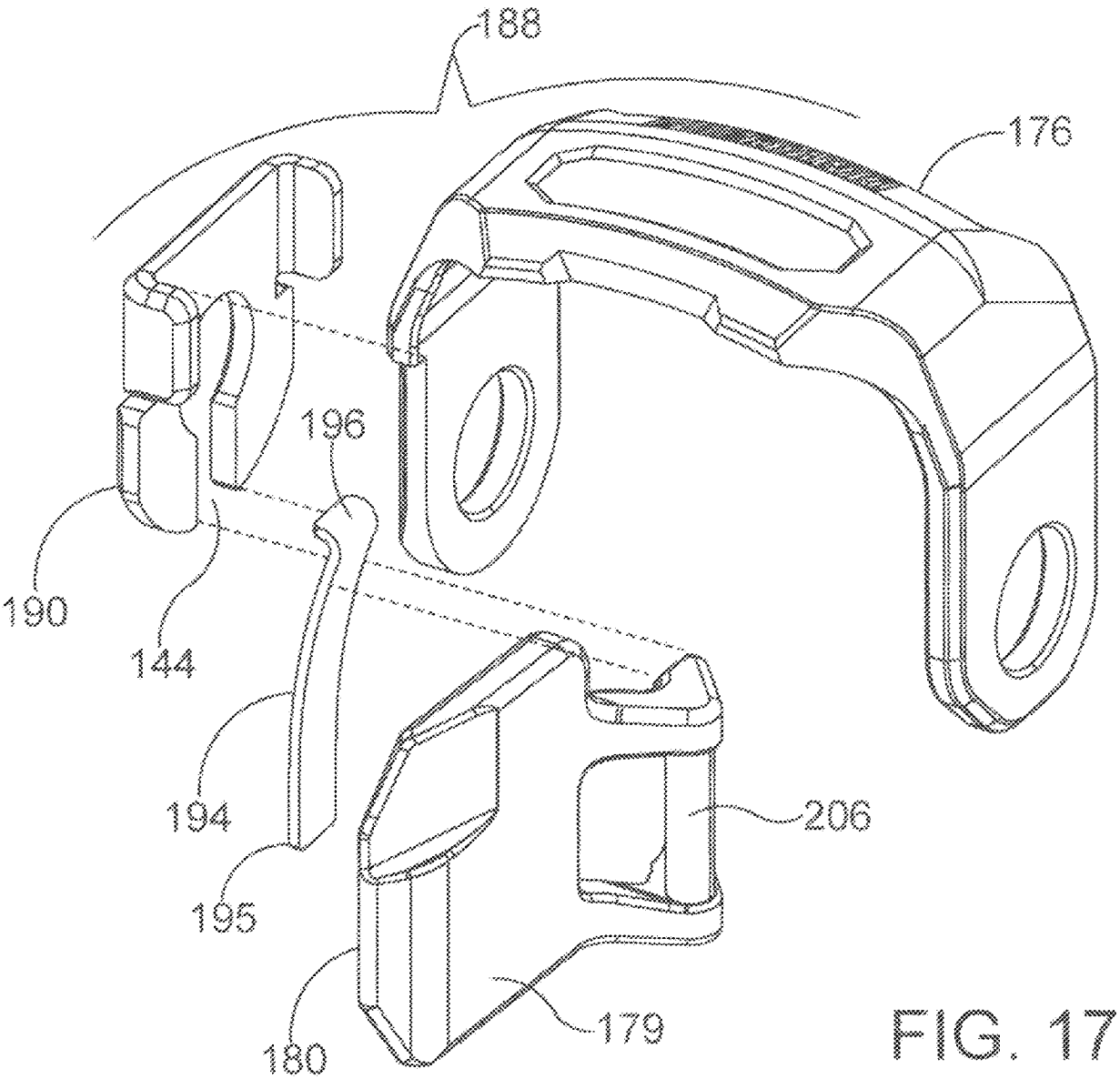
FIG. 17 is an exploded perspective view further illustrating some of the elements seen in the sub-assembly of FIG. 16.
Figure 18B:
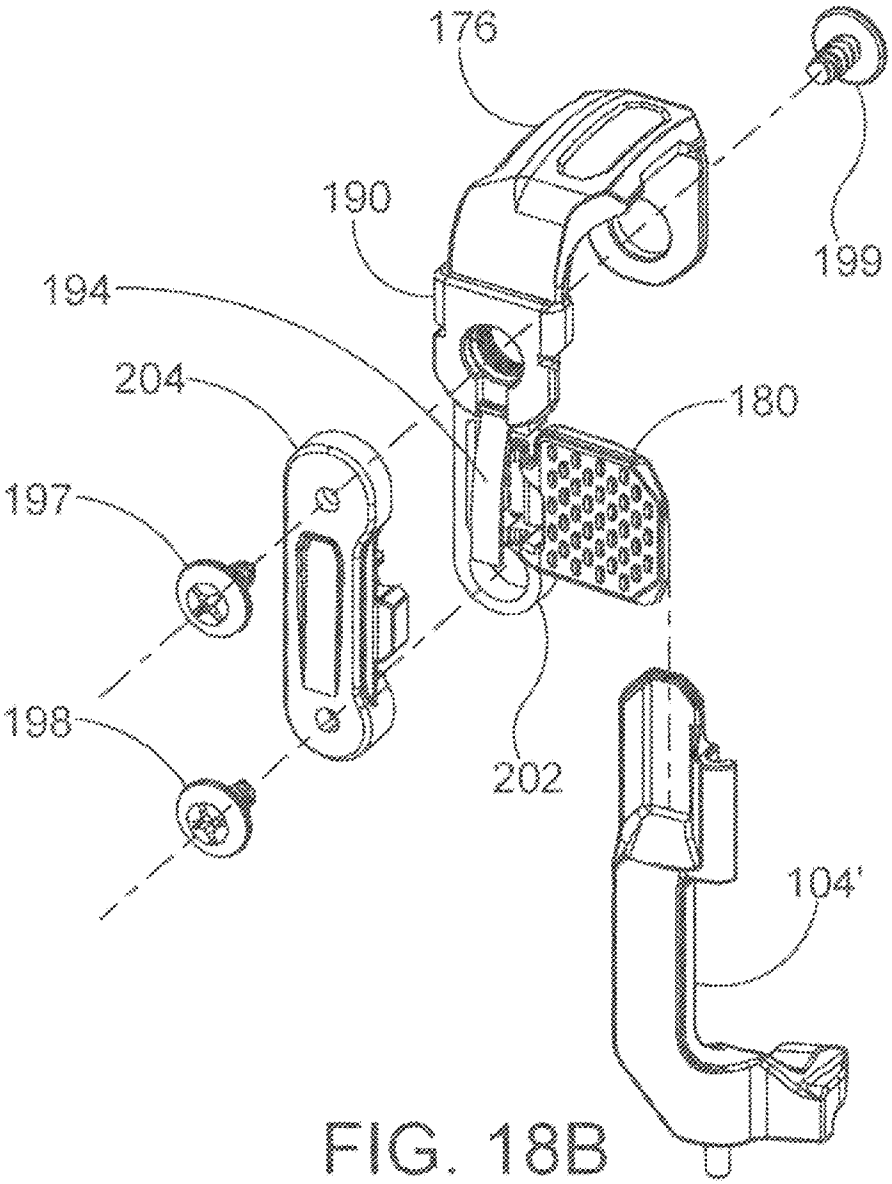
FIG. 18B is an exploded view of the components of FIG. 18A.
Figure 18A:
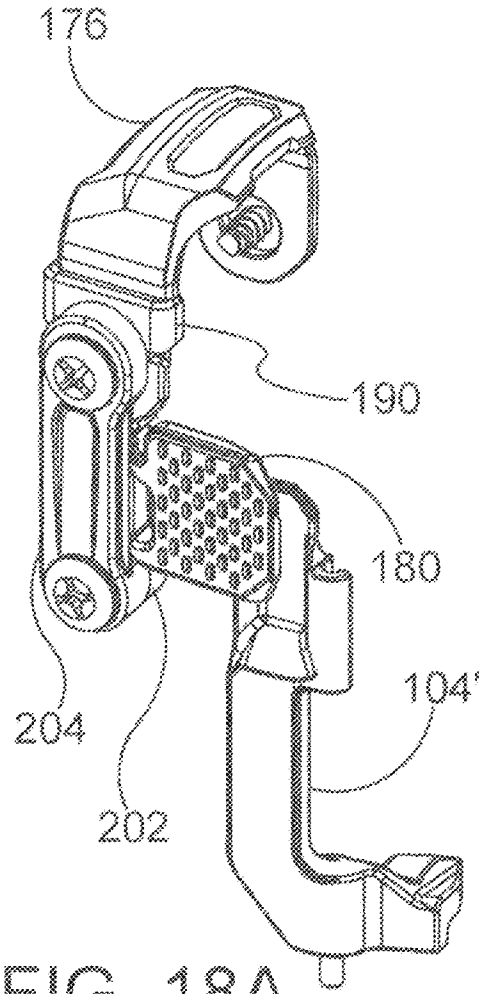
FIG. 18A is a perspective view of components of handgun retention mechanisms.
Figure 19:
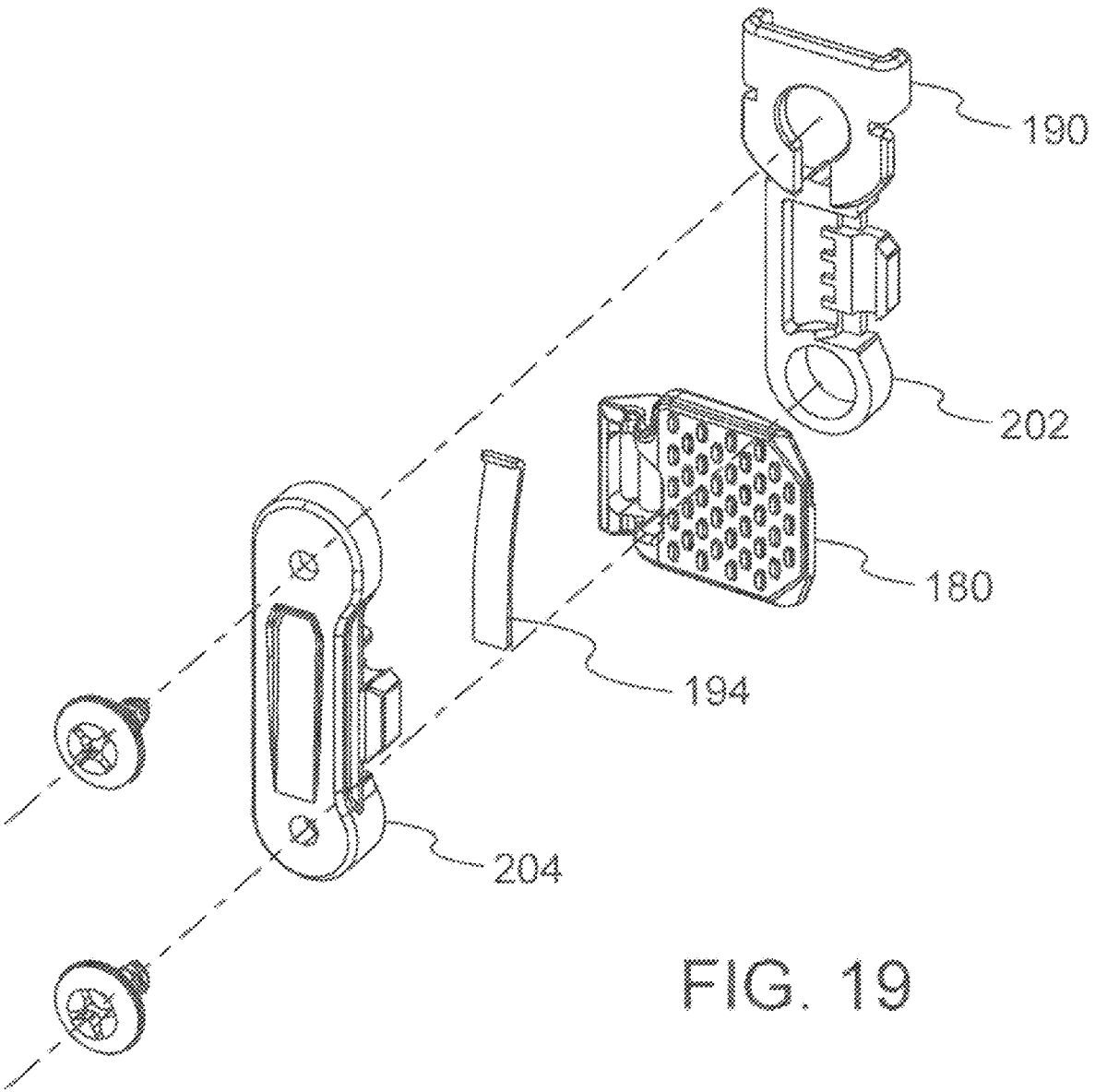
FIG. 19 is a further exploded view of components of the handgun retention mechanisms including a housing for securing the pivoting thumb button.
Figure 20:
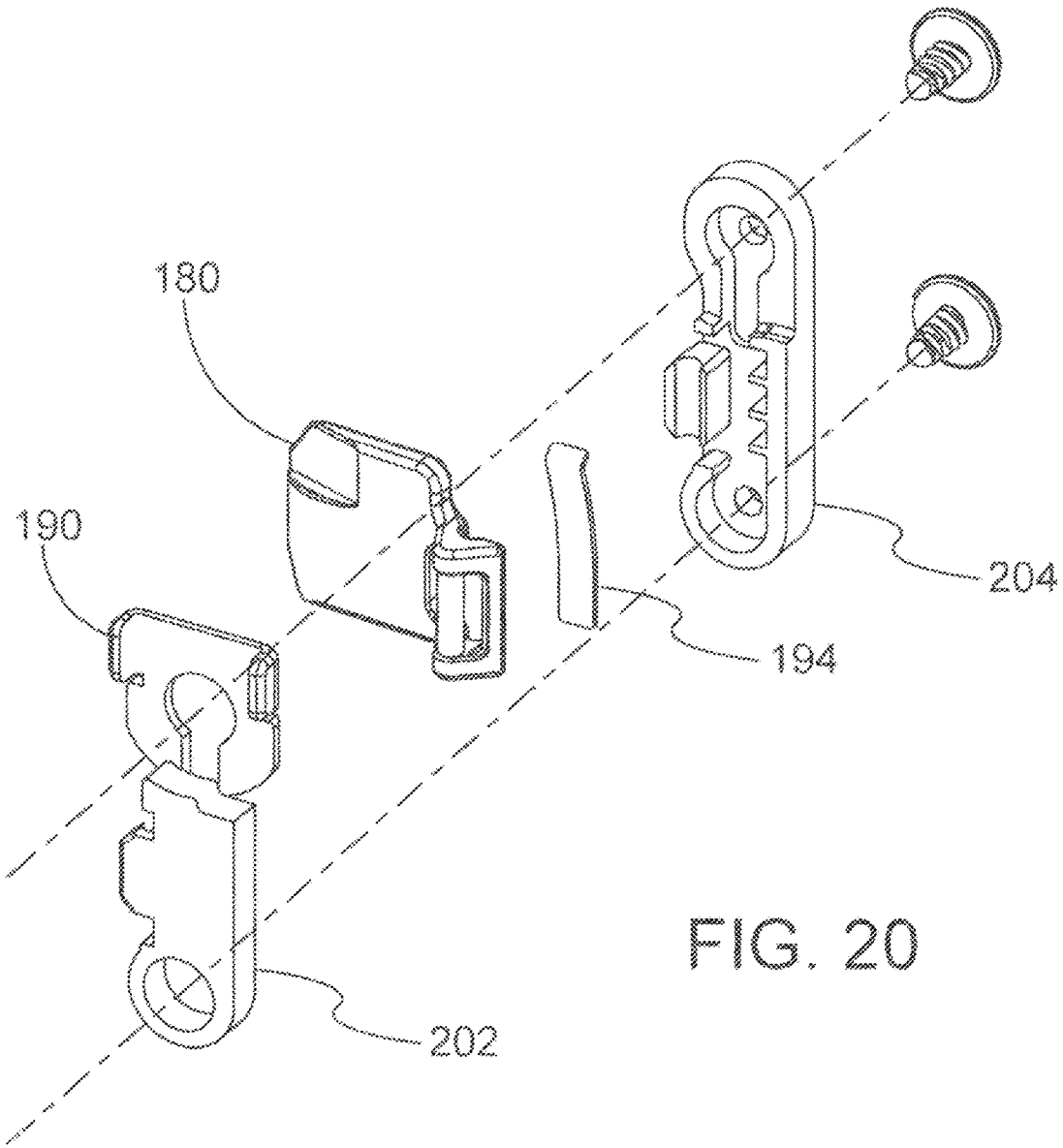
FIG. 20 is a further exploded view of components of the handgun retention mechanisms taken from the side opposite that of FIG. 19.
Figure 21:
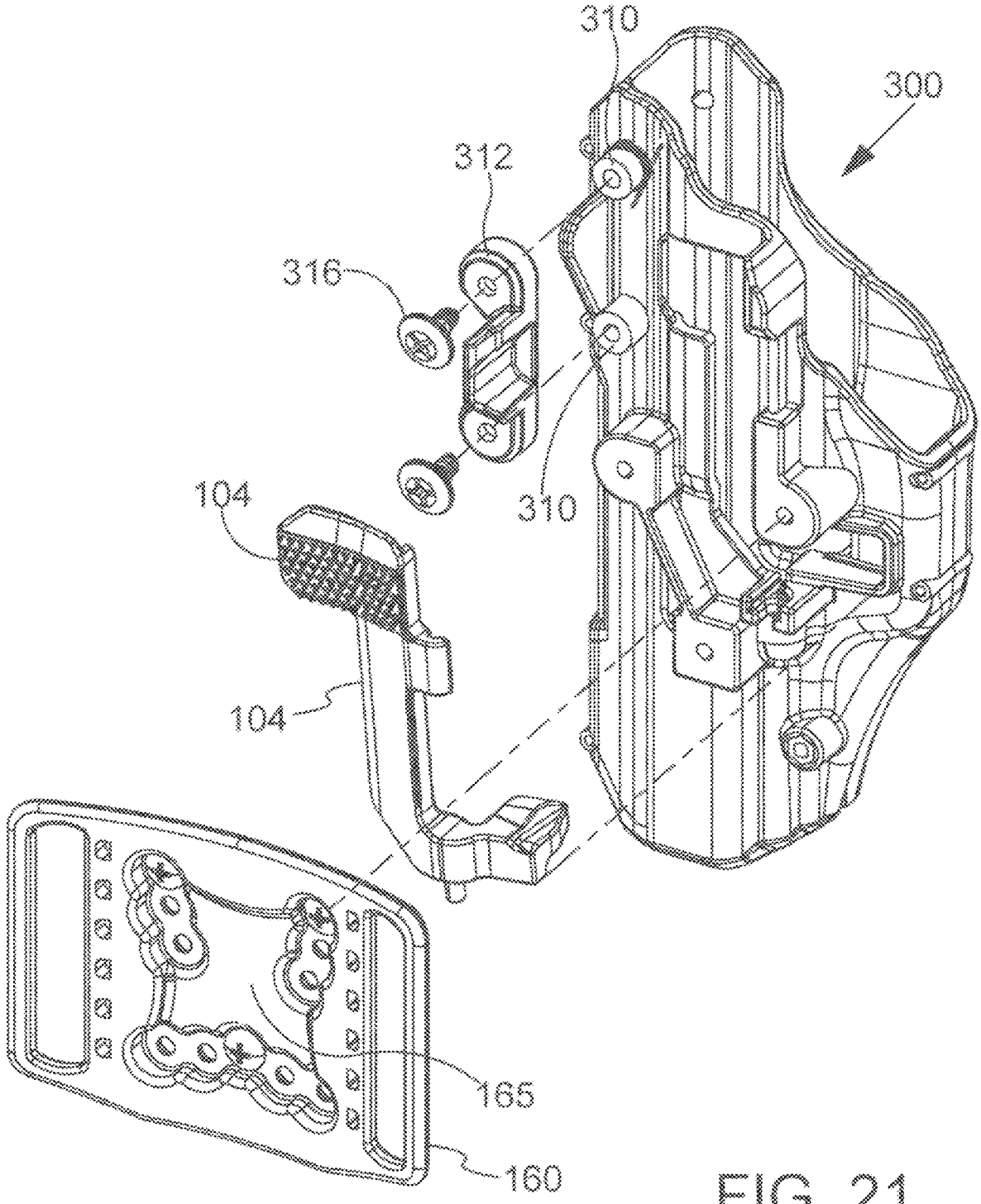
FIG. 21 is an exploded view of an embodiment of a holster with a with thumb button operating a single retention mechanism and a thumb button guard.

Referring to FIG. 21, another embodiment of a holster 300 comprising a holster body 306 similar to that of FIGS. 14 and 15 with a top or forward wall portion that mostly covers the slide of a handgun holstered therein, a pair of bosses 310 that can receive components of a second active handgun retention mechanism or, as illustrated in FIG. 21, a removable thumb button guard 312 secured to the bosses with fasteners 316. The lever 104 may be configured as discussed previously with respect to FIGS. 1-9 and has a thumb button 180. The plate portion 165 of a belt engaging member may capture the pivoting lever onto the holster body.

Figure 22:
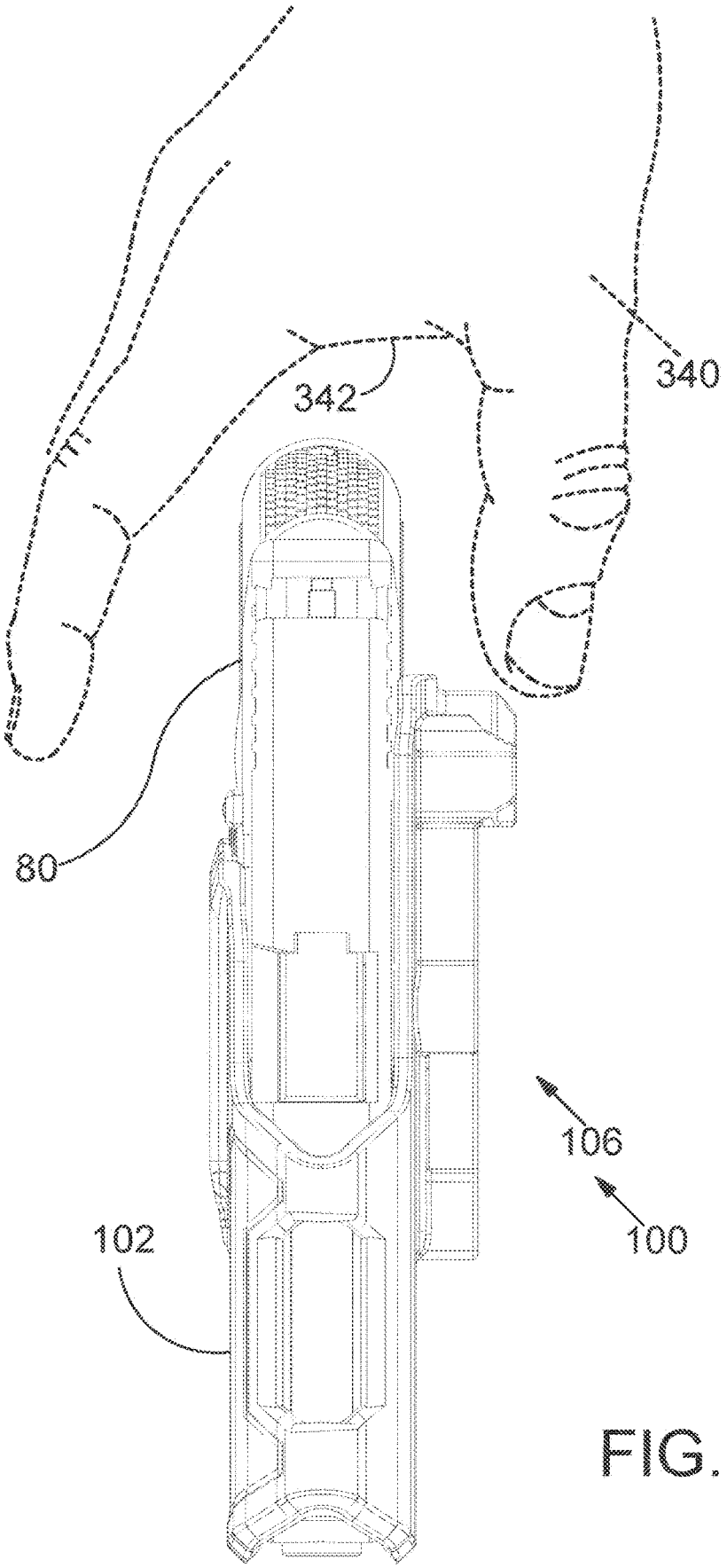
FIG. 22 is a plan view of a holster with a holstered handgun and a user's hand about the grasp the handgun.
Figure 23:
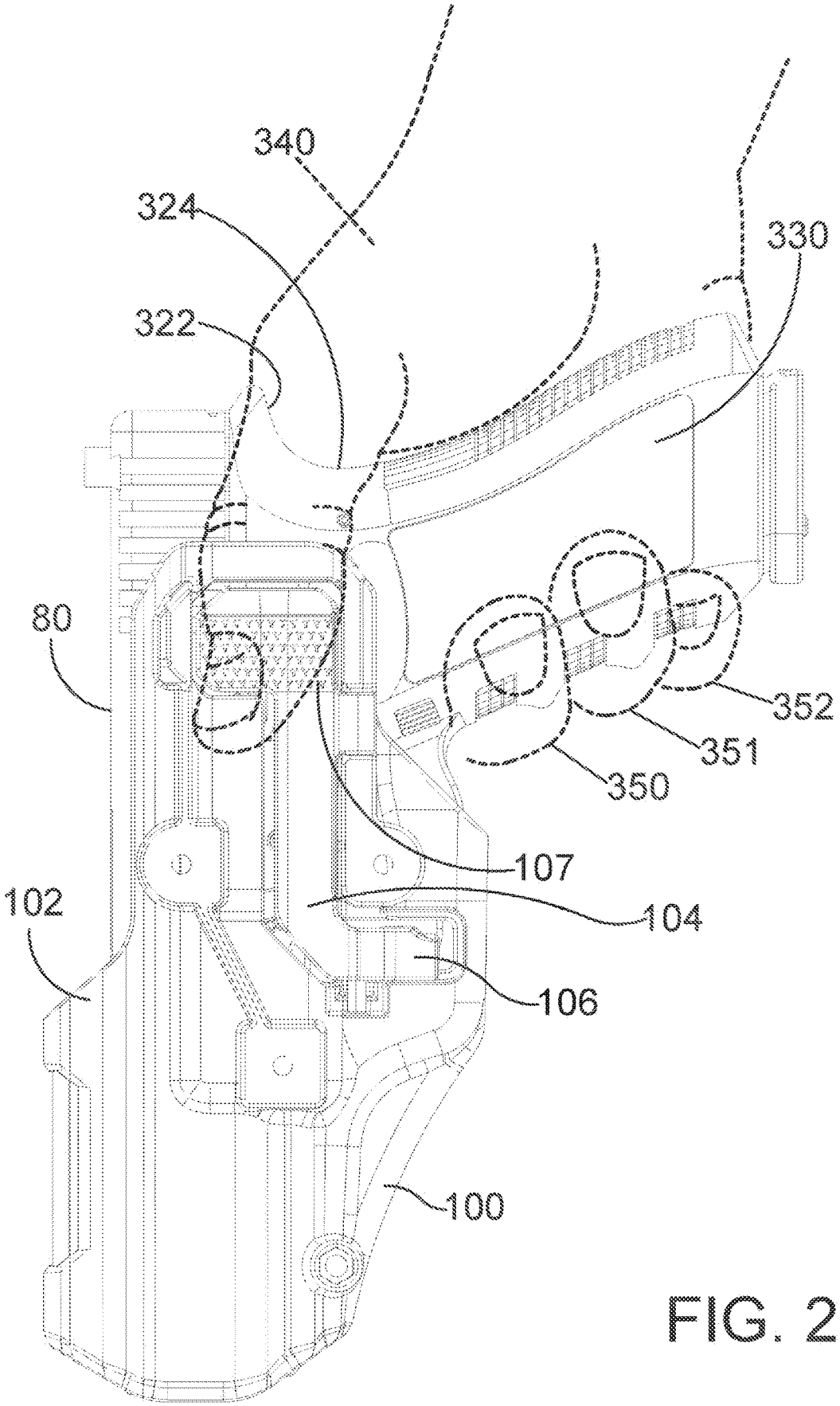
FIG. 23 is a plan view of a holster with a holstered handgun and a user's hand engaging the handgun.
Figure 24:
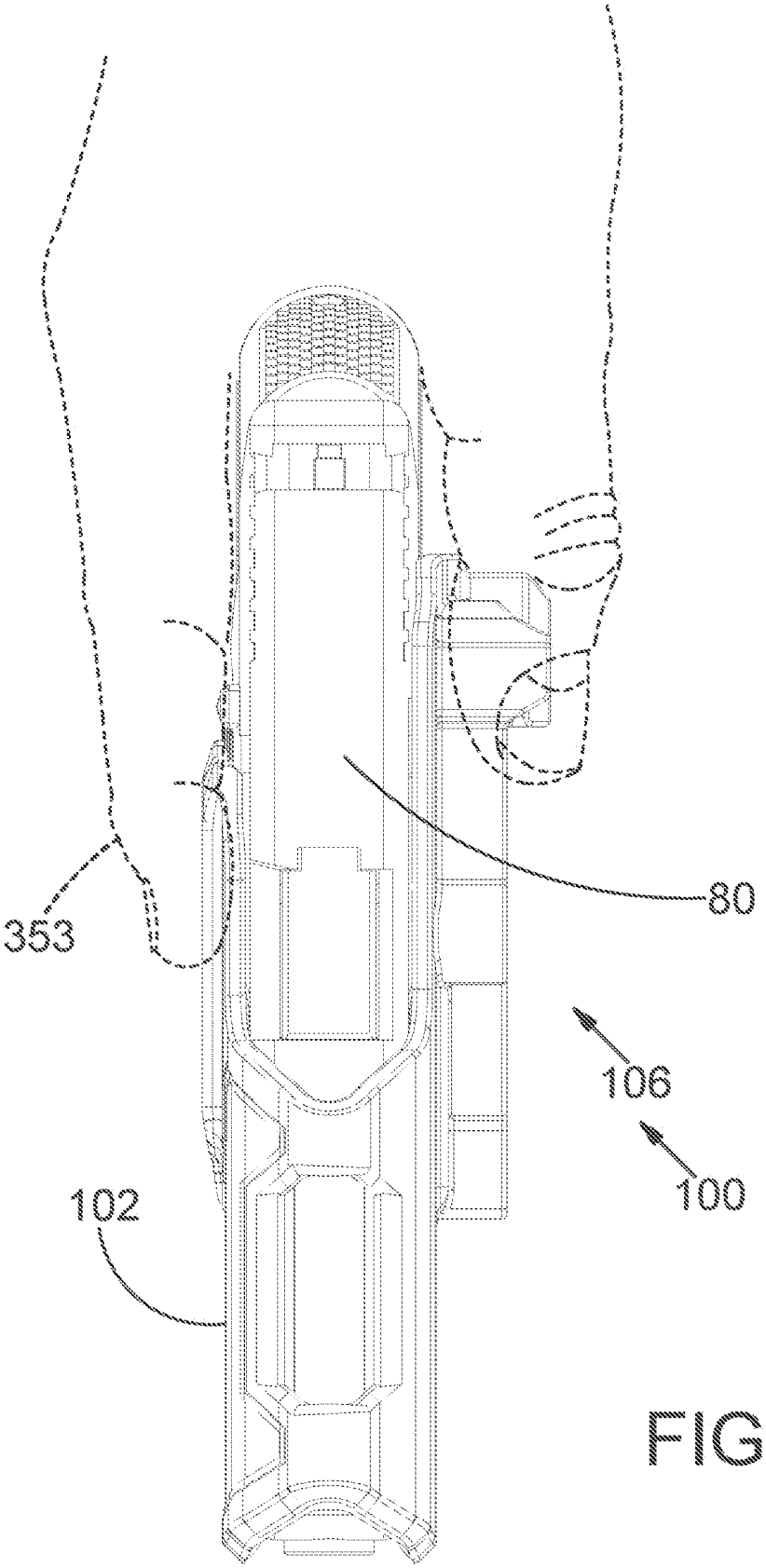
FIG. 24 is a plan view of a holster with a holstered handgun and a user's hand engaging the handgun.
Figure 25:
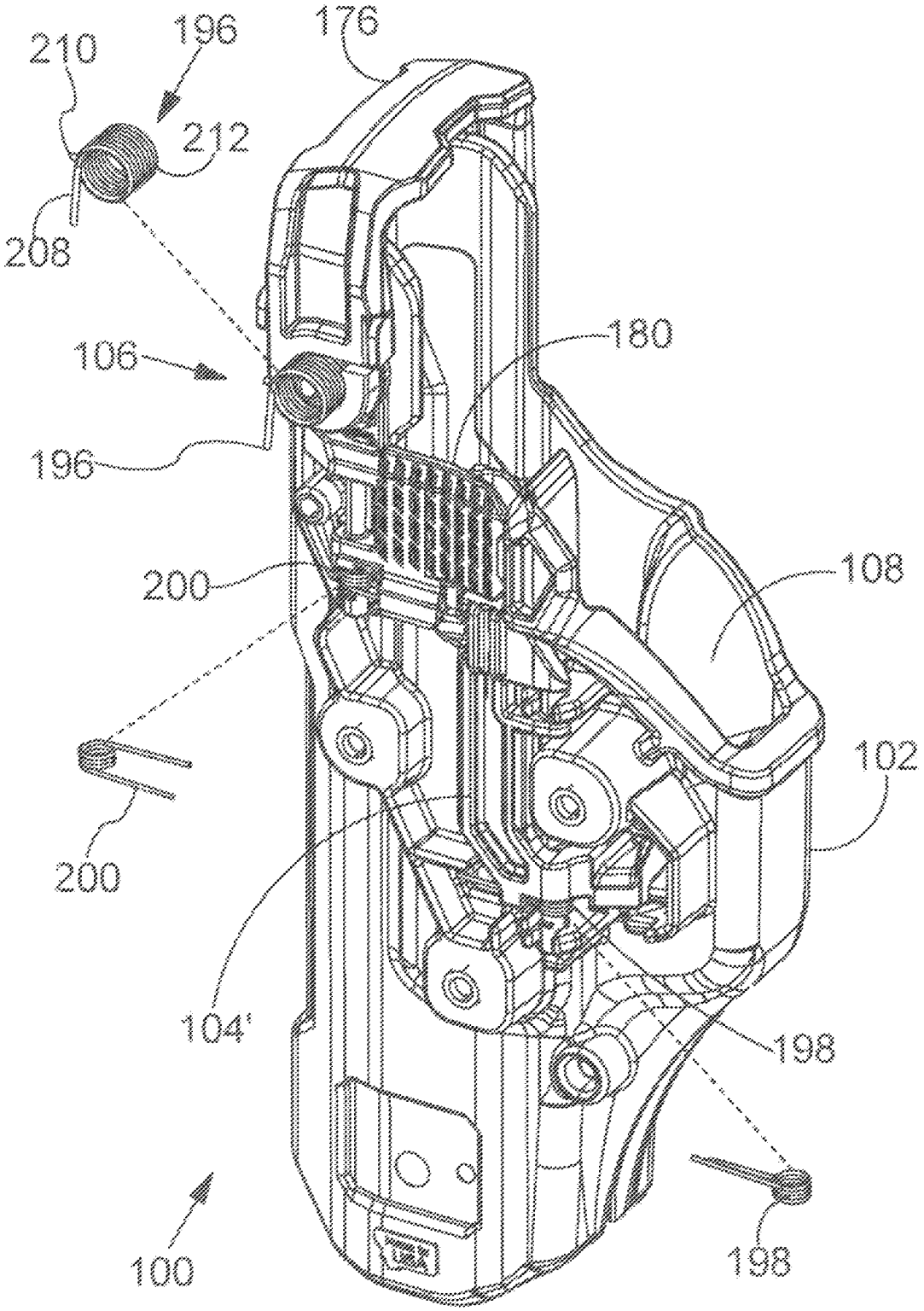
FIG. 25 is a perspective view showing a holster including a hood spring, a lever spring, and a tab spring. For purposes of illustration and explanation, the hood spring, the lever spring, and the tab spring are each illustrated a second time at a location spaced away from the holster.
Figure 26:
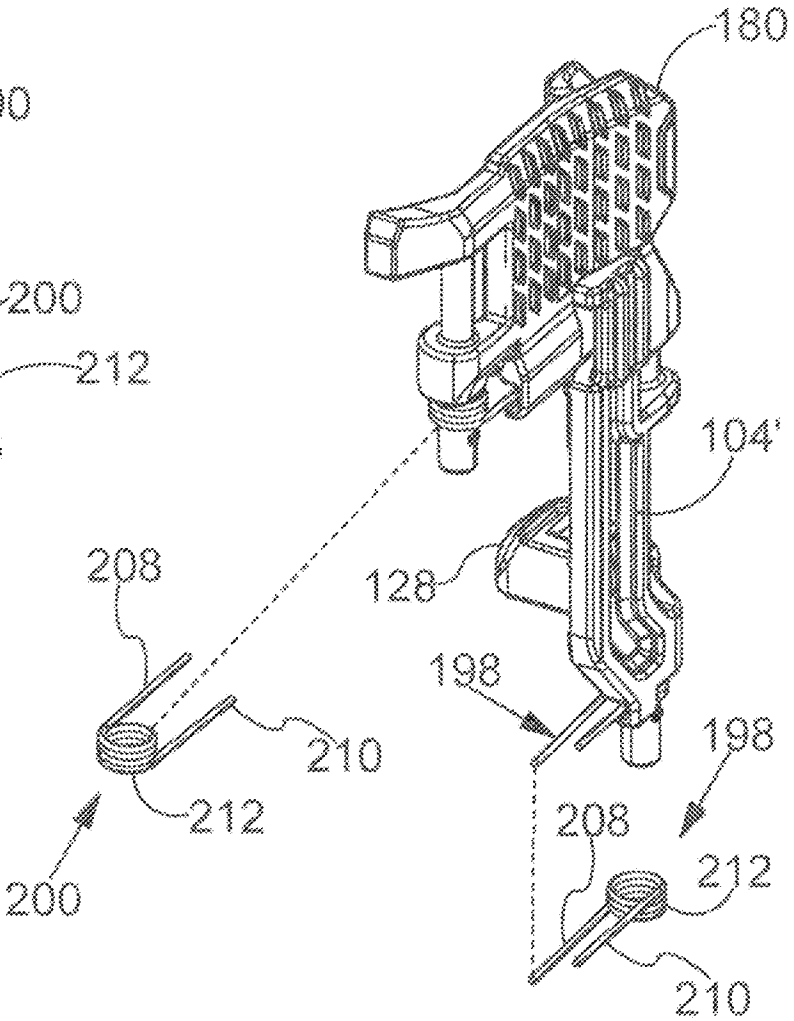
FIG. 26 is a perspective view showing an assembly including a lever, a lever spring, a tab, and a tab spring. For purposes of illustration and explanation, the lever spring and the tab spring are each illustrated a second time at a location spaced away from the assembly.
Figure 27:
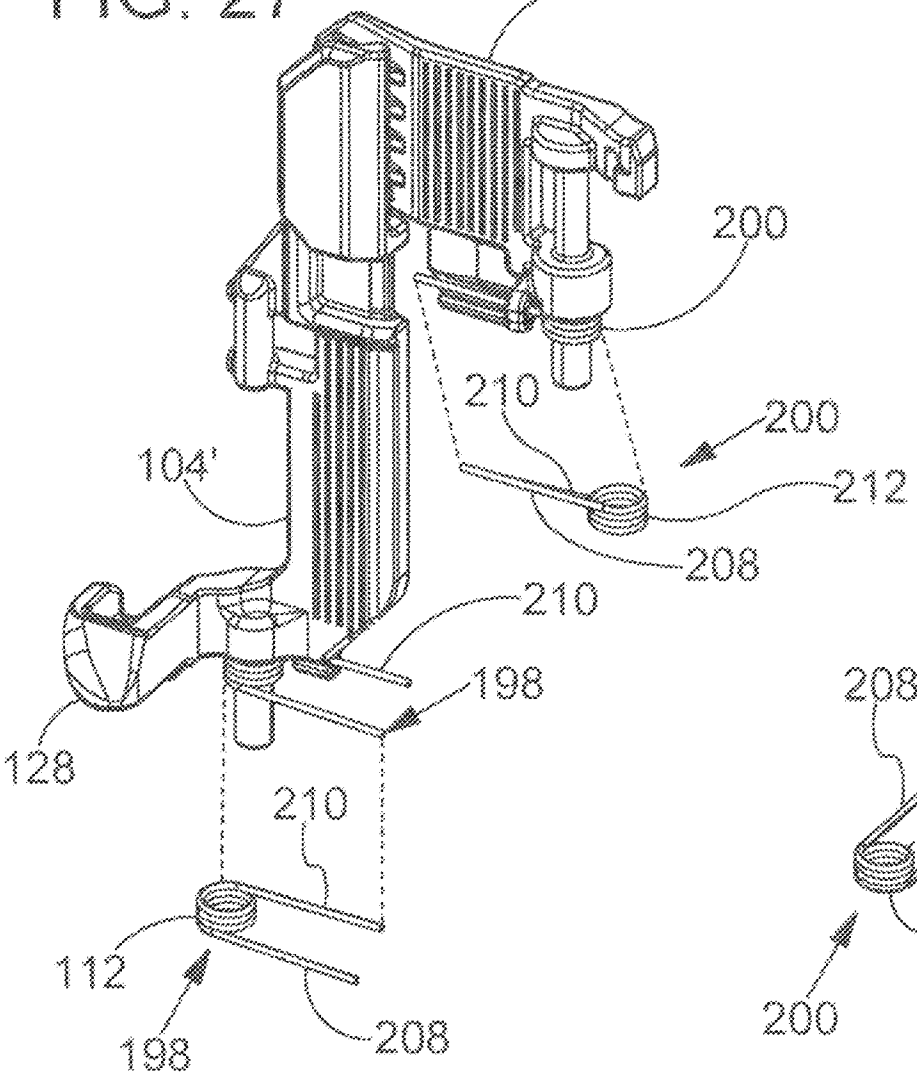
FIG. 27 is a perspective view of an assembly including a lever, a lever spring, a tab, and a tab spring. For purposes of illustration and explanation, the lever spring and the tab spring are each illustrated a second time at a location spaced away from the assembly.
Figure 29A:
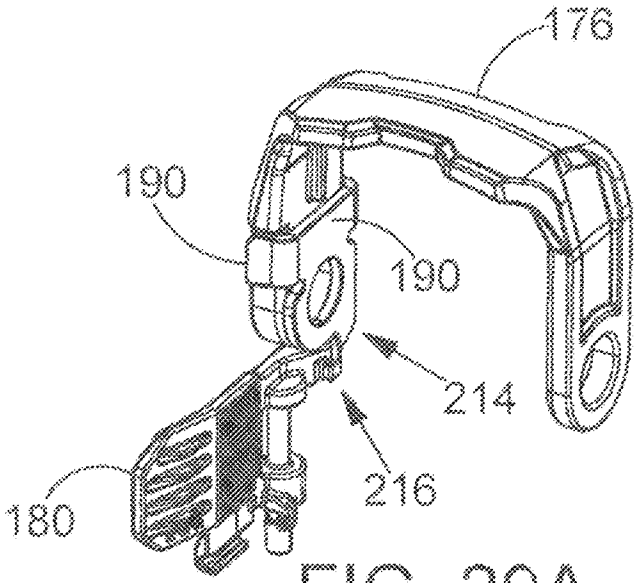
Figure 29B:
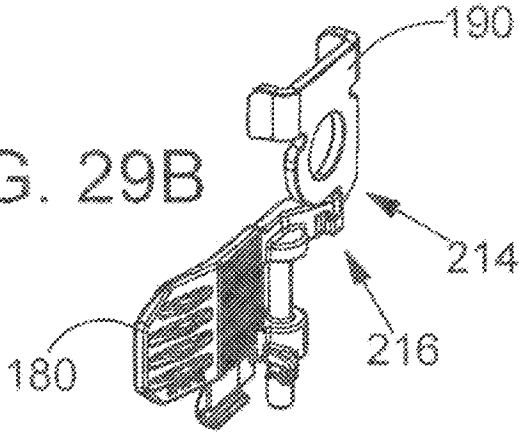
Figure 28A:
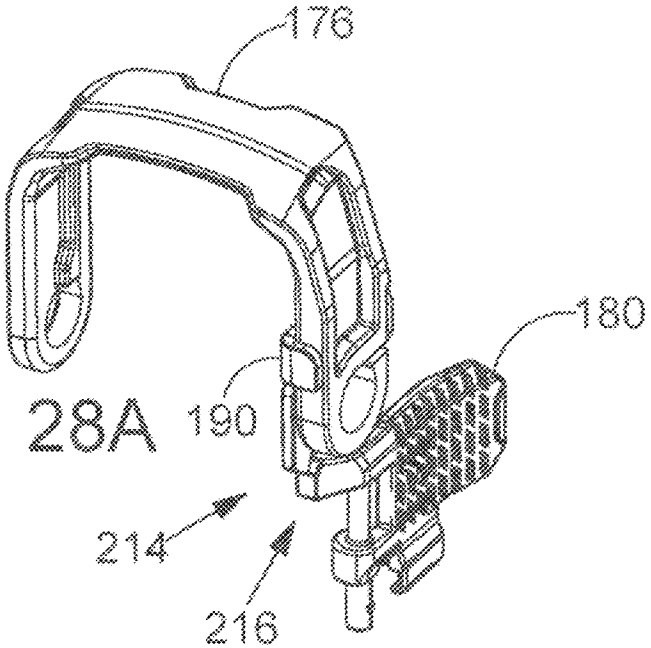
FIGS. 28A and 28B are perspective views showing an assembly including a hood assembly and a thumb receiving tab.
Figure 28B:
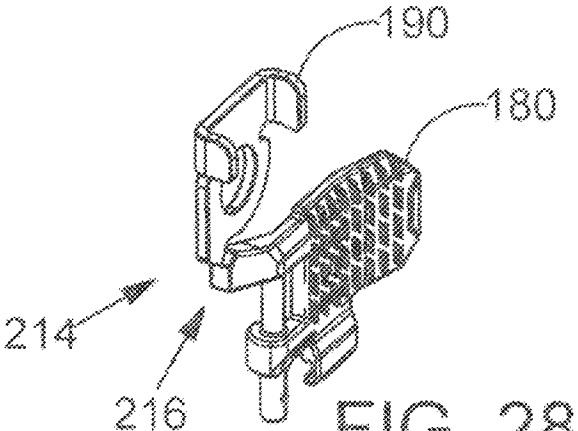
Figure 31A:
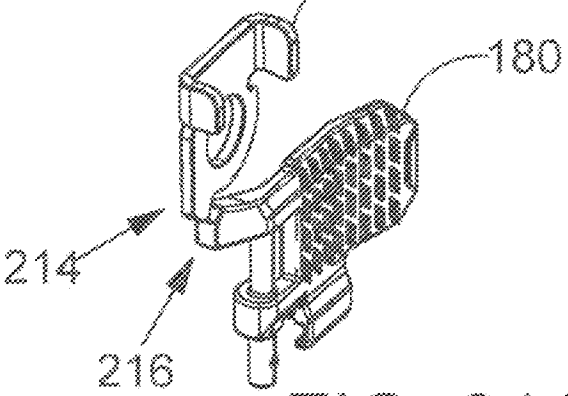
FIG. 31A is a perspective view of the assembly shown in FIG. 30A. In the embodiments of FIGS. 30A and 31A, the hood assembly part is in a handgun retaining position.
Figure 31B:
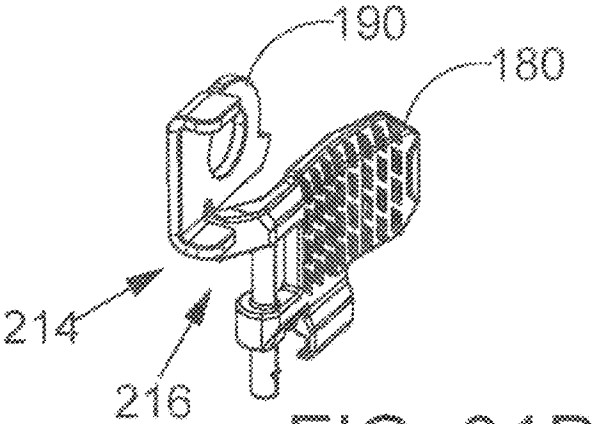
FIG. 31B is a perspective view of the assembly shown in FIG. 30B. In the embodiments of FIGS. 30B and 31B, the hood assembly part is in a handgun releasing position.
Figure 30A:
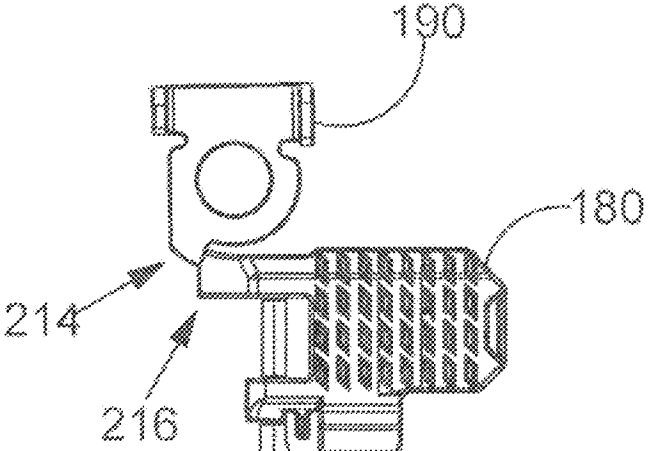
FIG. 30A is a plan view showing a hood assembly part having a lug portion and a thumb receiving tab having a protrusion portion that selectively engages the lug portion of the hood assembly part.
Figure 30B:
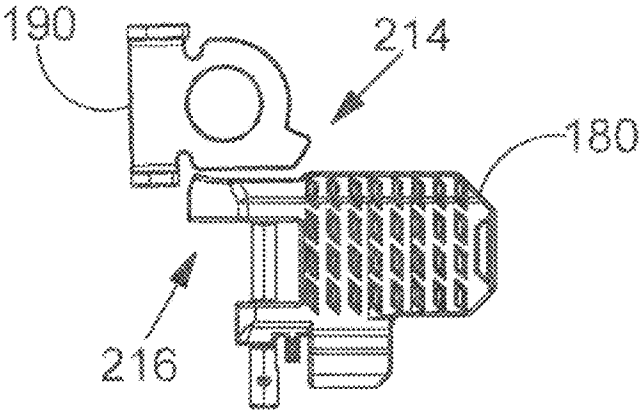
FIG. 30B is a plan view showing a hood assembly part having a lug portion and a thumb receiving tab having a protrusion portion that selectively engages the lug portion of the hood assembly part.
Figure 32A:
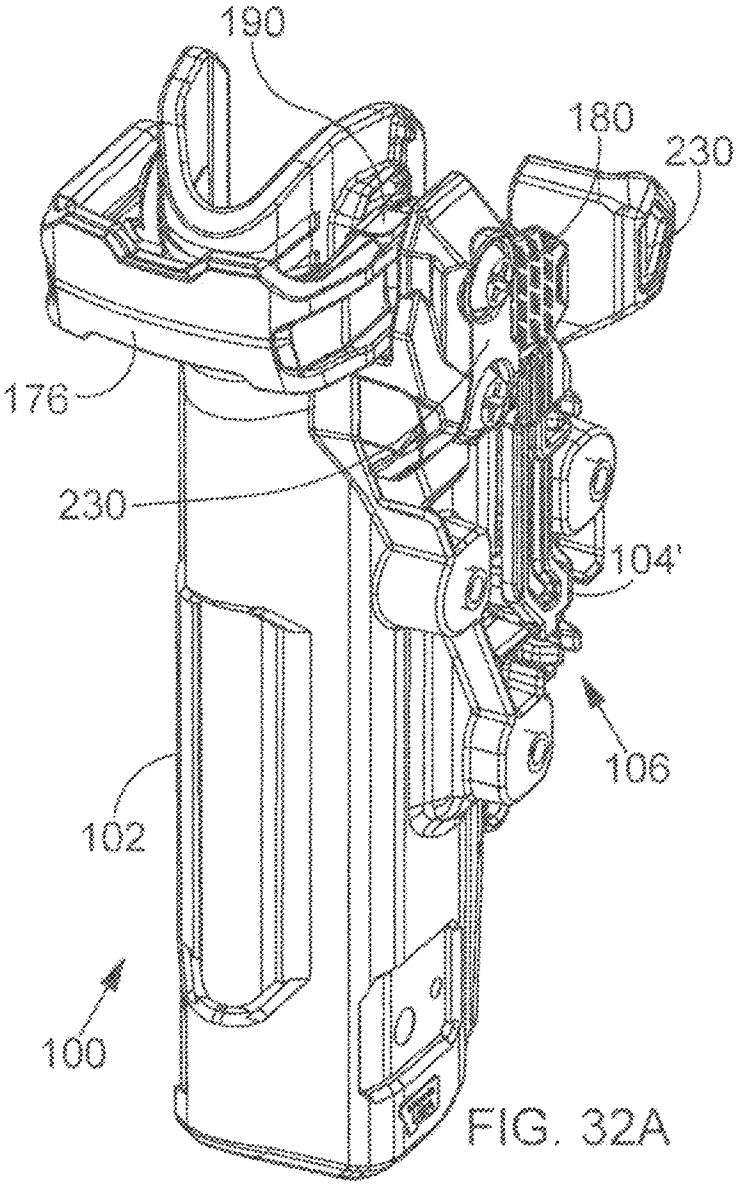
FIG. 32A is a perspective view showing a holster in accordance with the detailed description.
Figure 32B:
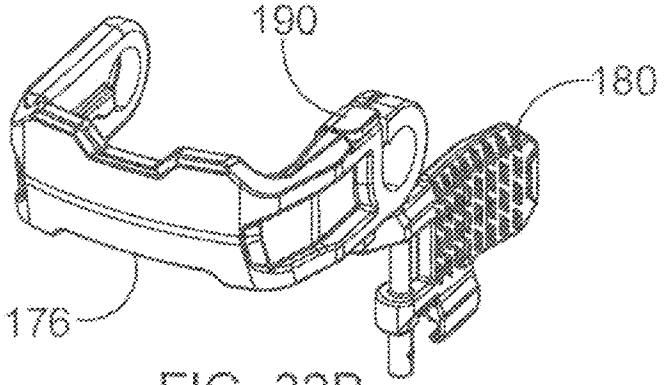
FIG. 32B is a perspective view showing selected parts from the holster shown in FIG. 32A. The parts shown in FIG. 32B include a U-shaped shroud, a bracket and a finger receiving tab.
Figure 32C:
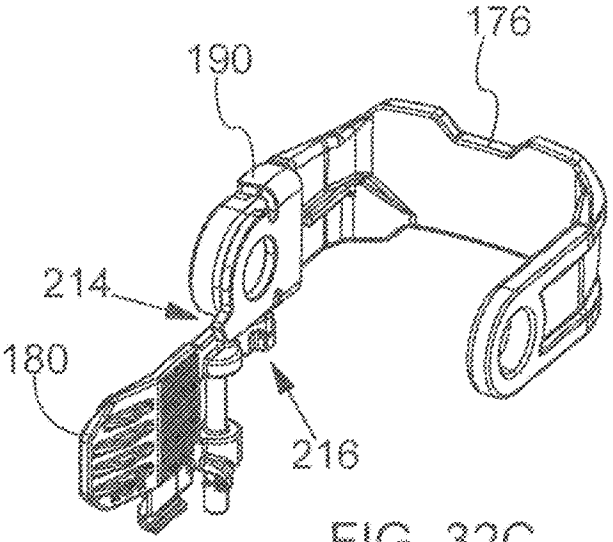
FIG. 32C is a perspective view further illustrating the parts shown in FIG. 32B.

Referring to FIGS. 22-24, the sequence of gripping and drawing a handgun 80 from a holster 100 having a optimally positioned thumb button 107 is illustrated. The handgrip a of the handgun 80 has a backstrap 322 region with a backstrap recess 324 that receives the user's hand 340 initially by the webbing 342 of the hand contacting the recess 324. The user will then wrap his middle, ring, and pinky fingers 350, 351, 352 around the grip as shown in FIG. 23 and will have his forefinger 353 in a longitudinal recess for said finger on the side of the holster opposite the thumb button. The thumb 354 will naturally be positioned at the thumb button 107 such that a normal grasping action of the grip, consistent with the "master grip" will depress the thumb button 107 and actuate the retention mechanism 104. Referring to FIGS. 22-25, 36A, 36B, 38A, 38B and 40-43, the master grip and ergonomics are further facilitated in embodiments where the thumb button 180 is positioned with no holster body directly rearward of the rearward margin of the thumb button 180, as well as no holster body portions below the thumb button 180. In use, as the handgun 80 is gripped prior to actuation of the thumb button 180, the user's thumb is in the natural gripping position at the surface of the thumb button 180, the thumb button 180 is depressed, coincident with grasping the handgun 80, and as the handgun 80 is withdrawn, the user's thumb slides off of the thumb button 180 into immediate contact with the handgun 80. That is, there is no engagement with the exterior surface of the holster body 102 by the user's thumb either during actuation of the release of the retention mechanism or as the handgun 80 is withdrawn. In that the thumb button 180 is positioned in close proximity to the surface of the handgun 80, the thumb movement inward as the thumb transitions from engagement with the thumb button 180 to engagement with the body of the handgun 80 is minimal.

Referring to FIGS. 25-27C, in embodiments, the holster includes the hood spring 196, a lever spring 198 and a tab spring 200. In embodiments, each spring comprises a length of wire 206, the wire 206 of the spring forming a first leg 208, a second leg 210 and a coil 212 disposed between the first leg 208 and the second leg 210. In embodiments, the first leg 208 of the hood spring 196 is fixed relative to the holster body 102 and the second leg 210 of the hood spring 196 is seated against the hood assembly 188 so that the U-shaped shroud 176 is biased to pivot toward the release position. In embodiments, the lever spring 198 is positioned and adapted to bias the lever 104 to rotate toward the handgun trigger guard capture position. In embodiments, the first leg 208 of the lever spring 198 is seated against to the holster body 102 and the second leg 210 of the lever spring 198 is seated against the lever 104. In embodiments, the tab spring 200 is positioned and adapted to bias the thumb receiving tab 180 to rotate in a direction that moves a distal end of the thumb receiving tab 180 away from the holster body 102. In embodiments, the first leg 208 of the tab spring 200 is seated against to the holster body 102 and the second leg 210 of the tab spring 200 is seated against the thumb receiving tab 180.

Referring to FIGS. 28A-31B, in embodiments, the U-shaped shroud 176 is part of a hood assembly 188. In embodiments, a bracket 190 of the hood assembly 188 includes a lug portion 214 and the thumb receiving tab 180 includes a protrusion portion 216 that engages the lug portion 214 of the hood assembly 188 while the U-shaped shroud 176 is in the handgun retaining position. In embodiments, the holster 100 further includes a hood spring 196 that biases the U-shaped shroud 176 to pivot toward the release position. In embodiments, the hood spring 196 biases the lug portion 214 of the hood assembly 188 against the protrusion portion 216 of the thumb receiving tab 180 while the U-shaped shroud 176 is in the handgun retaining position. In embodiments, rotation of the thumb receiving tab 180 through a first range of rotary motion causes the protrusion portion 216 of the thumb receiving tab 180 to disengage from the lug portion 214 of the hood assembly 188. In embodiments, rotation of the thumb receiving tab 180 through a second range of rotary motion causes the thumb receiving tab 180 to engage the tab receiving portion of the lever 104 causing at least a portion of the trigger guard retaining portion of the lever 104 to be withdrawn from the trigger guard receiving portion of the holster body 102.

Figure 33B:
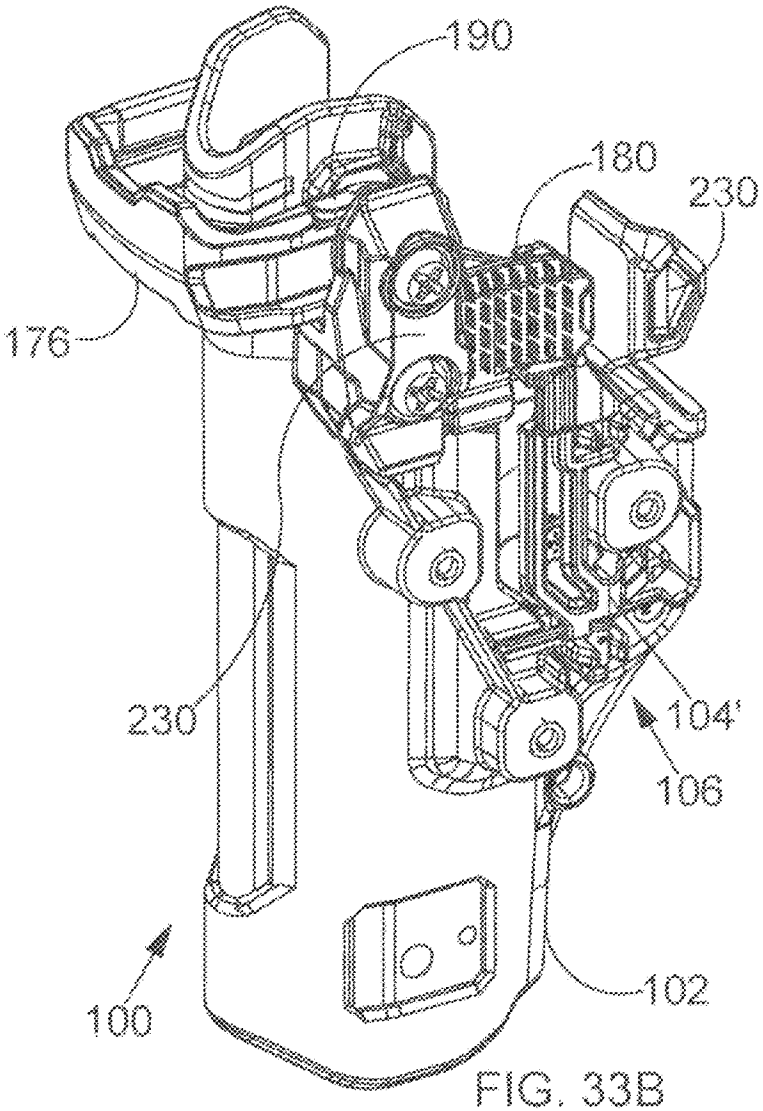
FIGS. 33A and 33B are two perspective views showing a holster including a U-shaped shroud. In the embodiment of FIG. 33A, the U-shaped shroud is in a handgun retaining position. In the embodiment of FIG. 33B, the U-shaped shroud is in a release position.
Figure 33A:
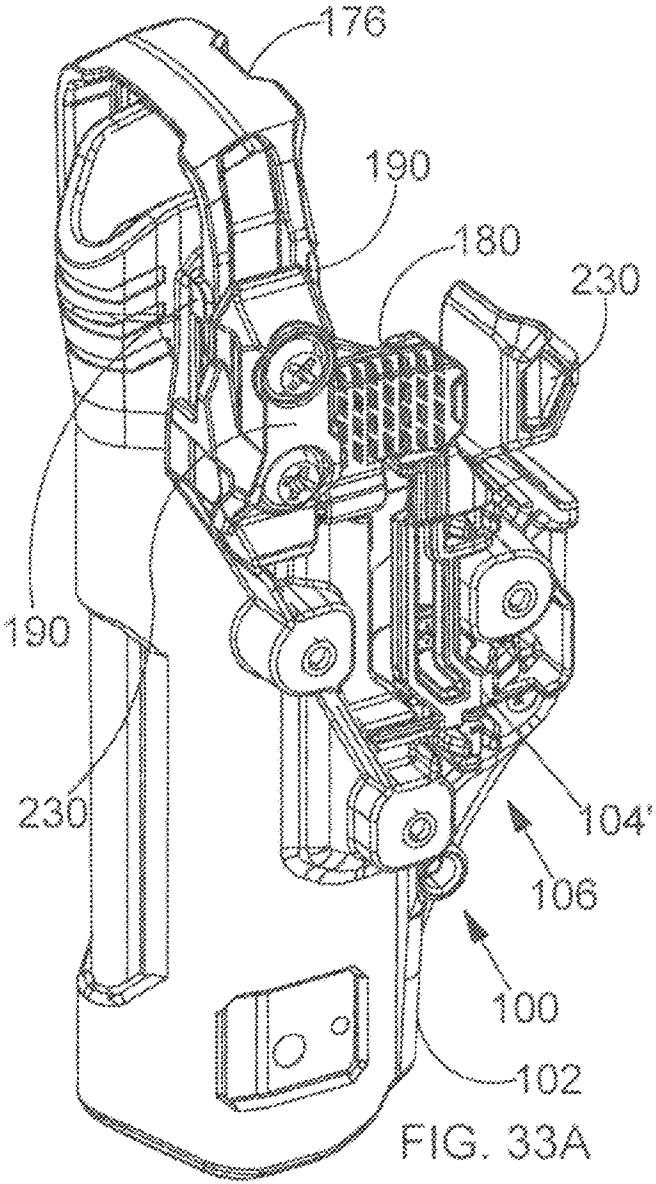
Figure 34B:
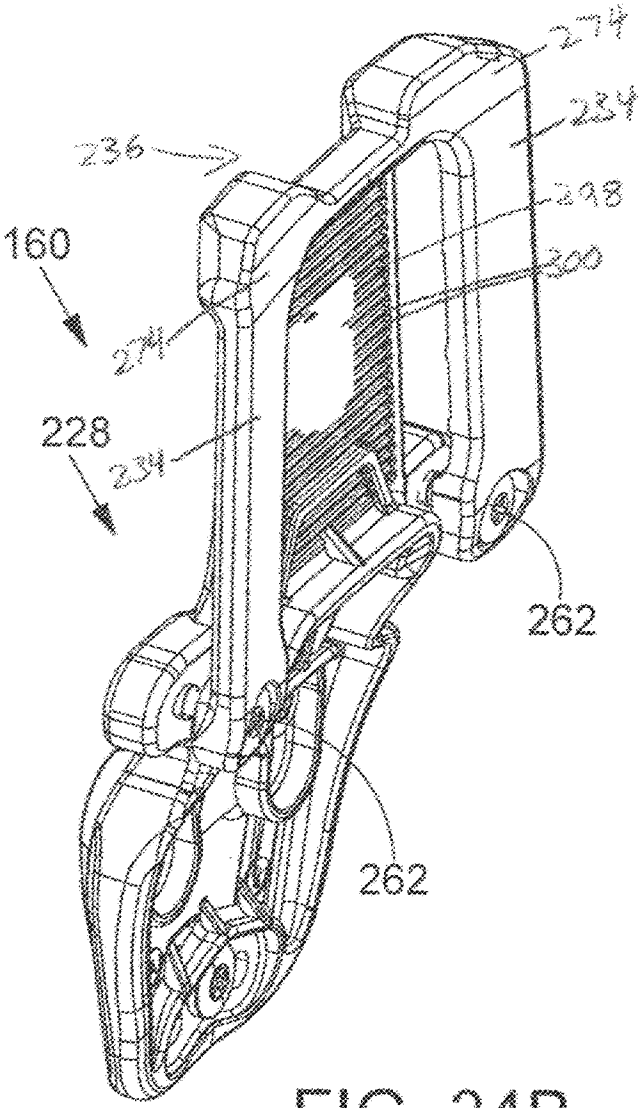
FIGS. 34A and 34B are perspective views of a belt engaging member.
Figure 34A:
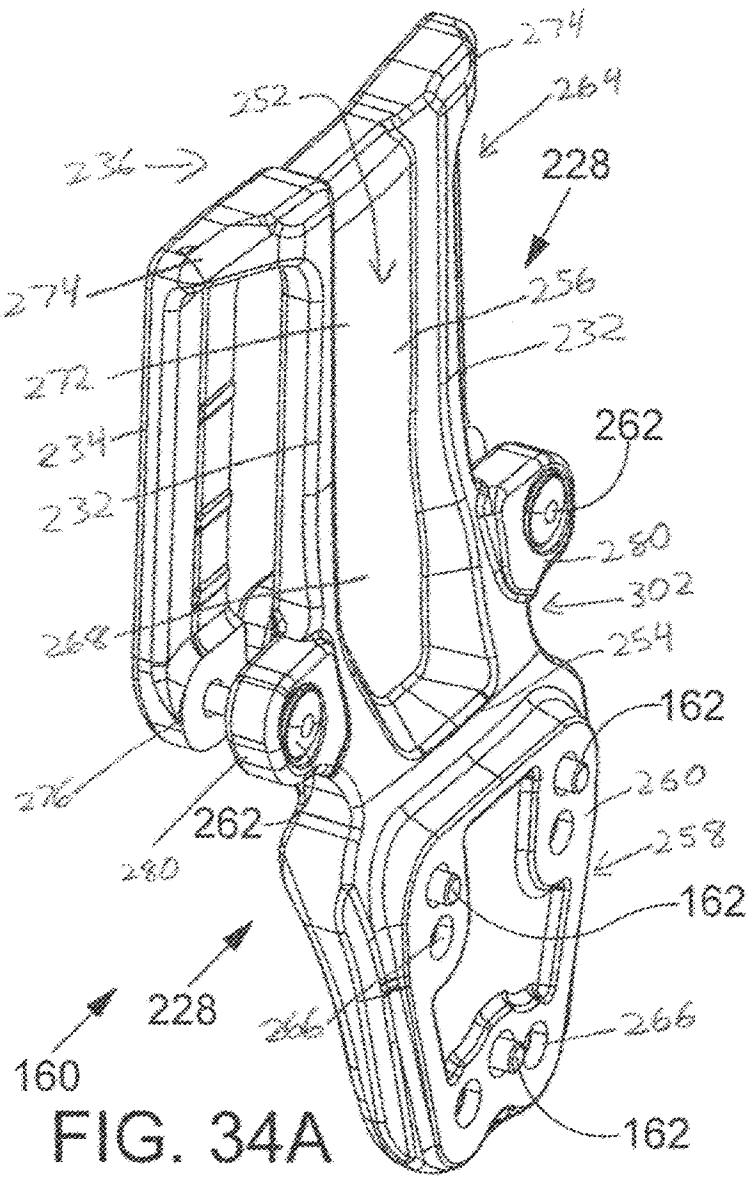
Figure 35D:
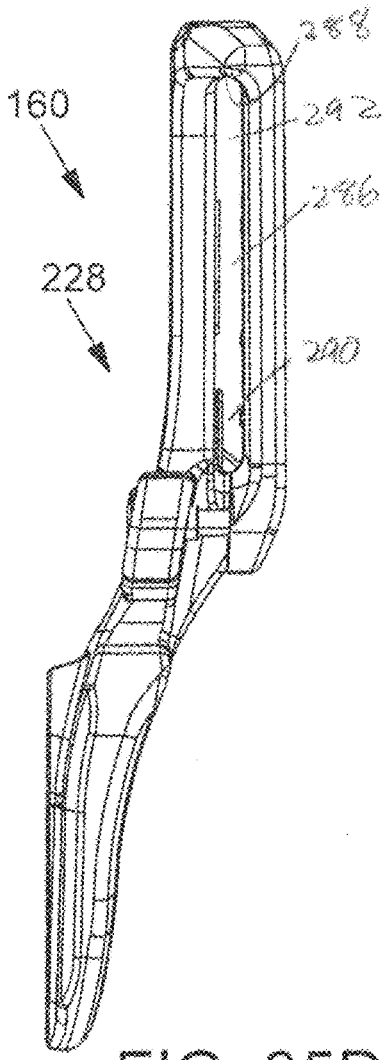
FIG. 35D is a rear view of the belt engaging member shown in FIGS. 34A and 34B.
Figure 35E:
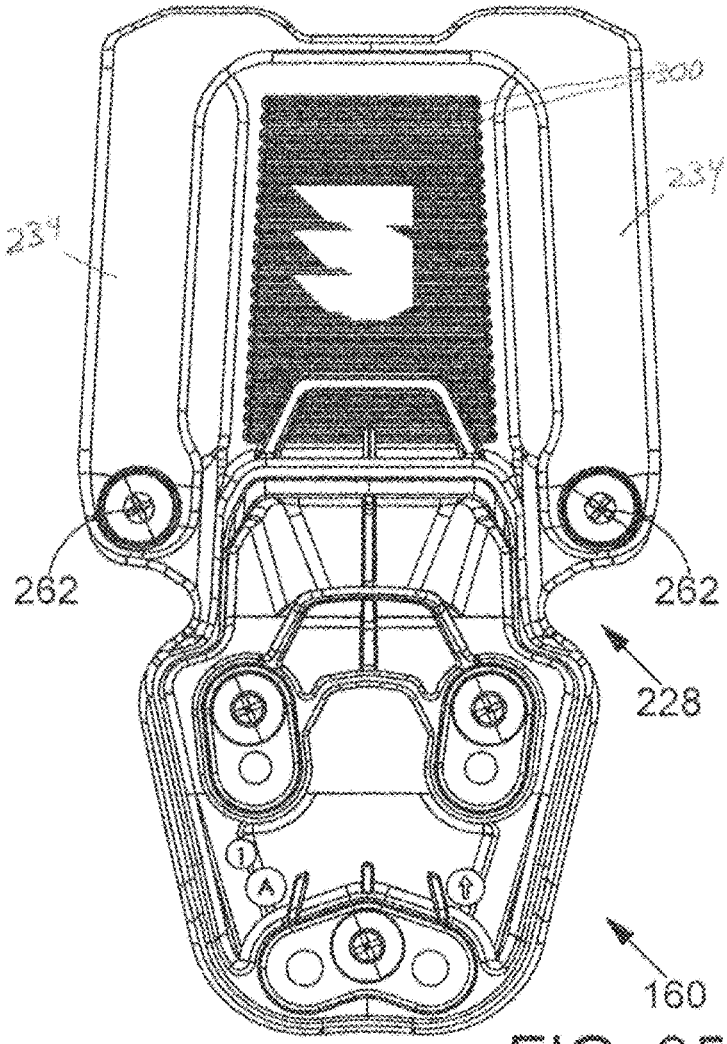
FIG. 35E is a left side view of the belt engaging member shown in FIGS. 34A and 34B.
Figure 35F:
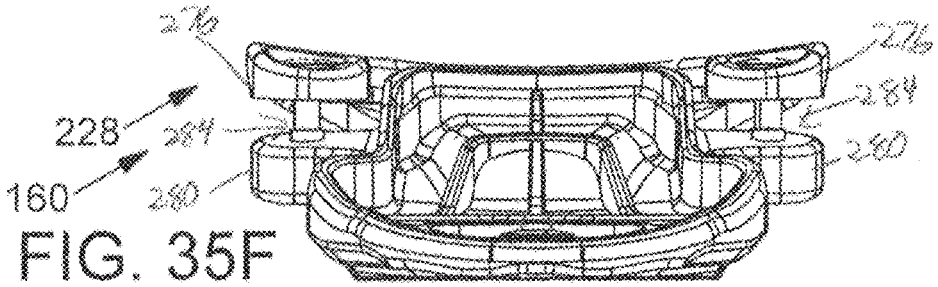
FIG. 35F is a bottom view of the belt engaging member shown in FIGS. 34A and 34B.
Figure 36B:
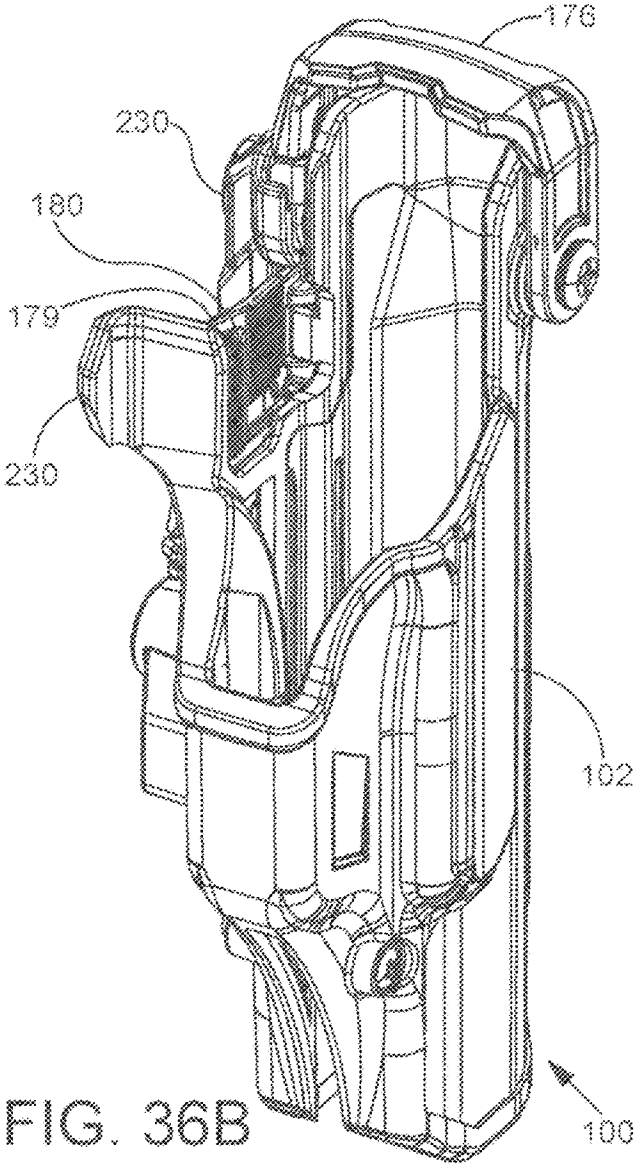
FIGS. 36A and 36B are two perspective views showing a holster having a first handgun retention mechanism including a pivotable lever and a second handgun retention mechanism including a U-shaped shroud. In the embodiment of FIGS. 36A and 36B, the U-shaped shroud is in a handgun retaining position.
Figure 36A:
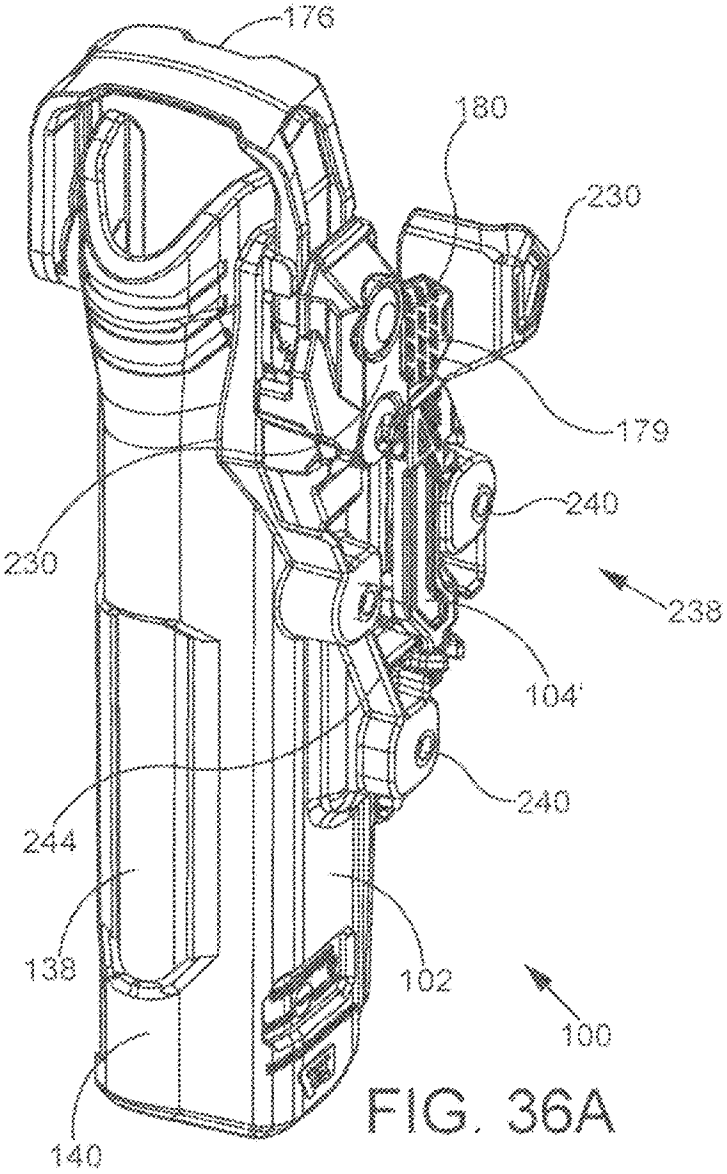
Figure 37C:
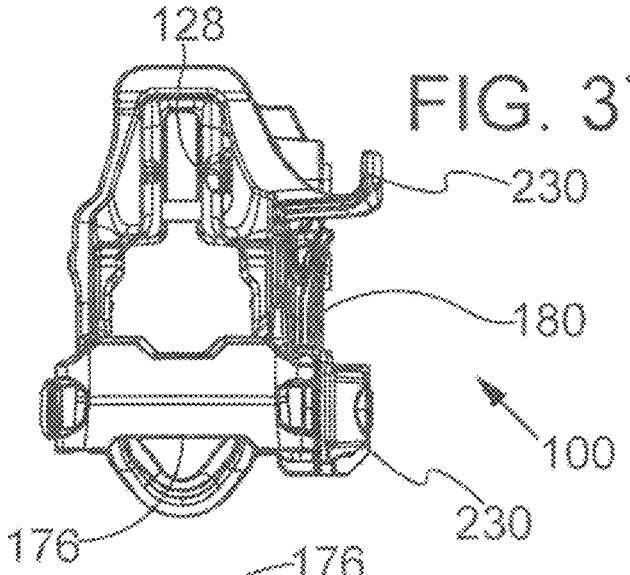
FIG. 37C is a top view of the holster shown in FIGS. 36A and 36B.
Figure 37A:
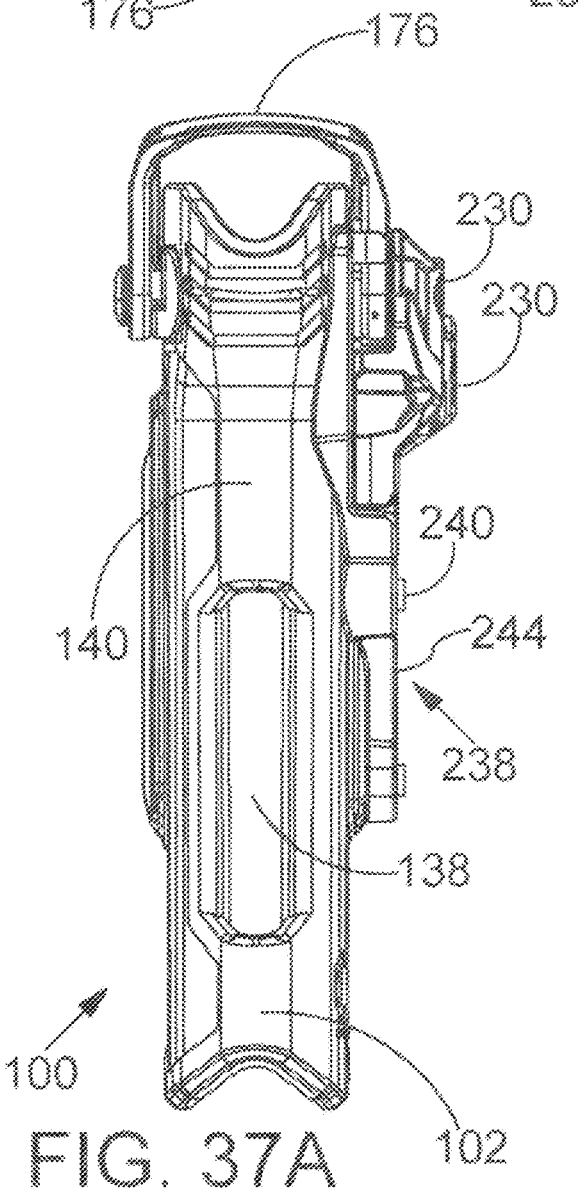
FIG. 37A is a front view of the holster shown in FIGS. 36A and 36B.
Figure 37B:
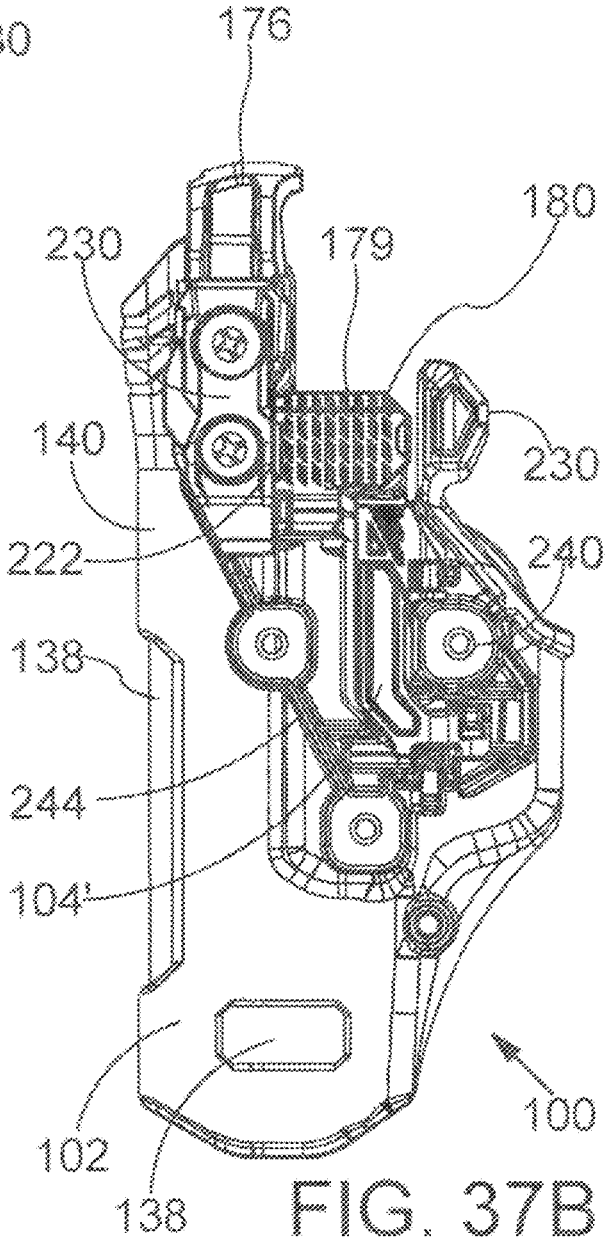
FIG. 37B is a right side view of the holster shown in FIGS. 36A and 36B.
Figure 37D:
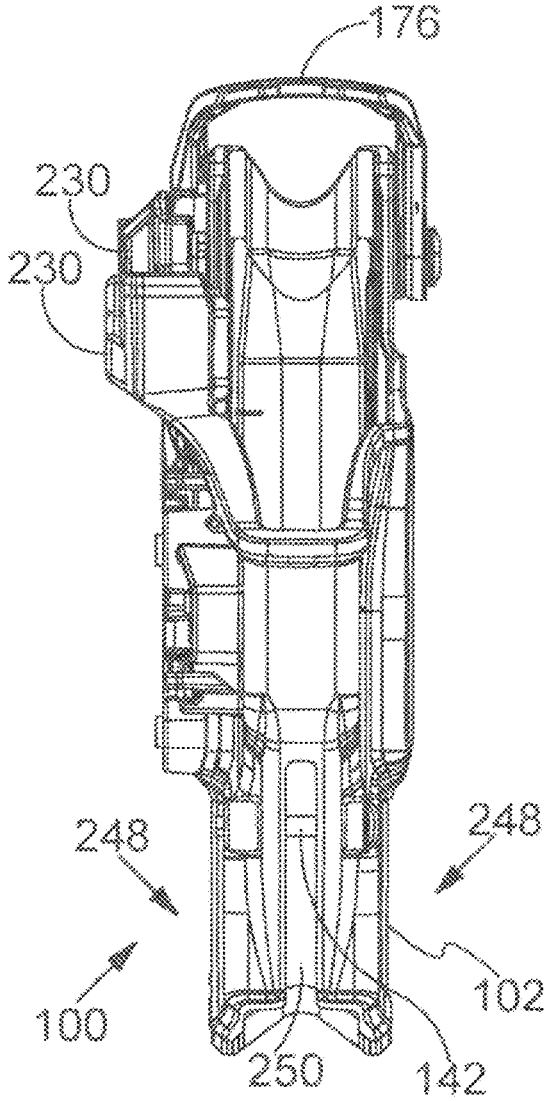
FIG. 37D is a rear view of the holster shown in FIGS. 36A and 36B.
Figure 37E:
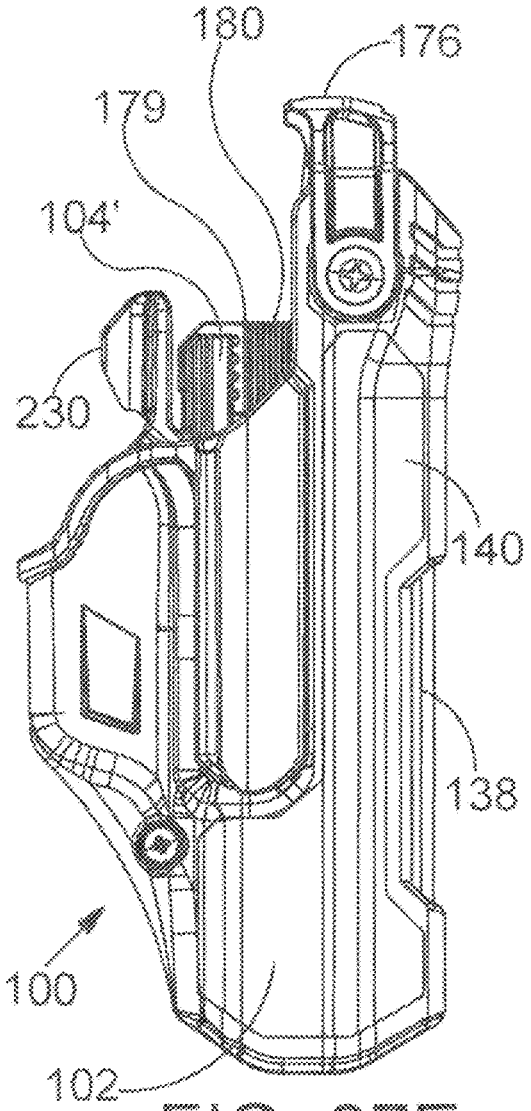
FIG. 37E is a left side view of the holster shown in FIGS. 36A and 36B.
Figure 37F:
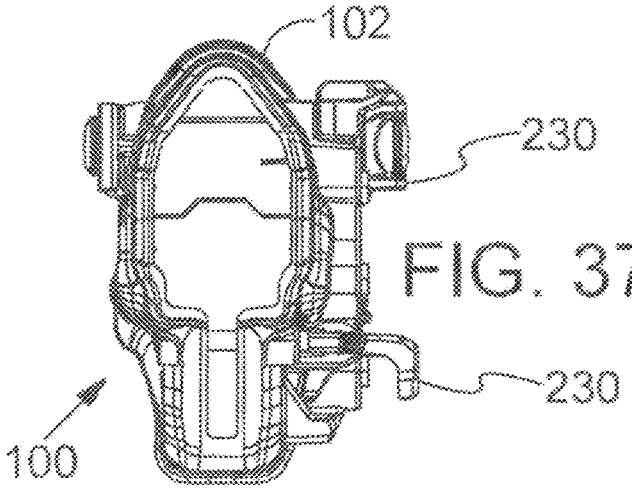
FIG. 37F is a bottom view of the holster shown in FIGS. 36A and 36B.
Figure 38B:
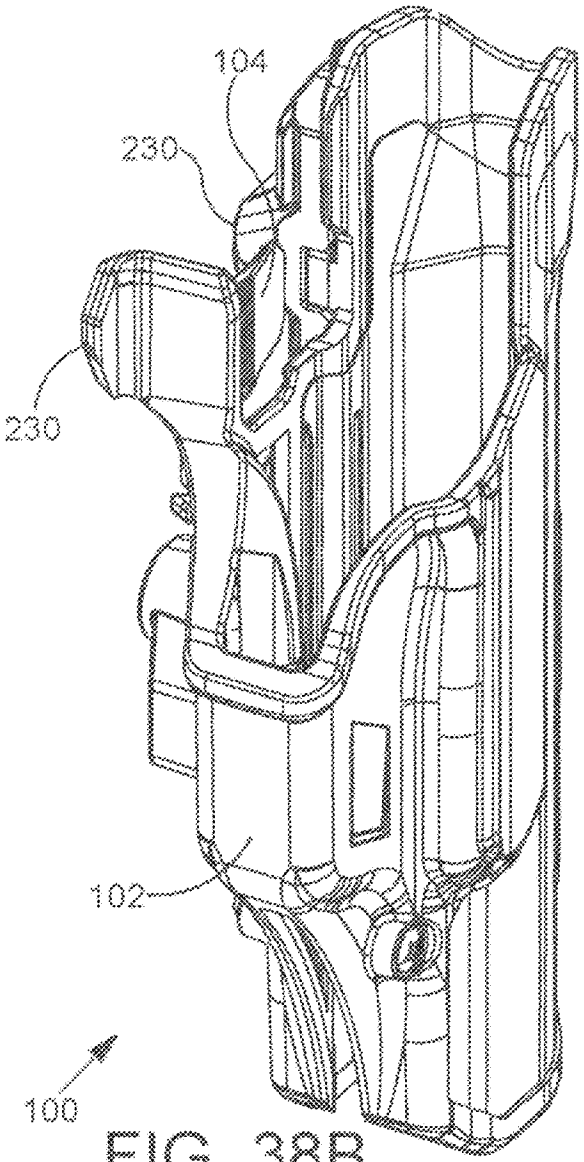
FIGS. 38A and 38B are two perspective views showing a holster having a handgun retention mechanism including a pivotable lever.
Figure 38A:
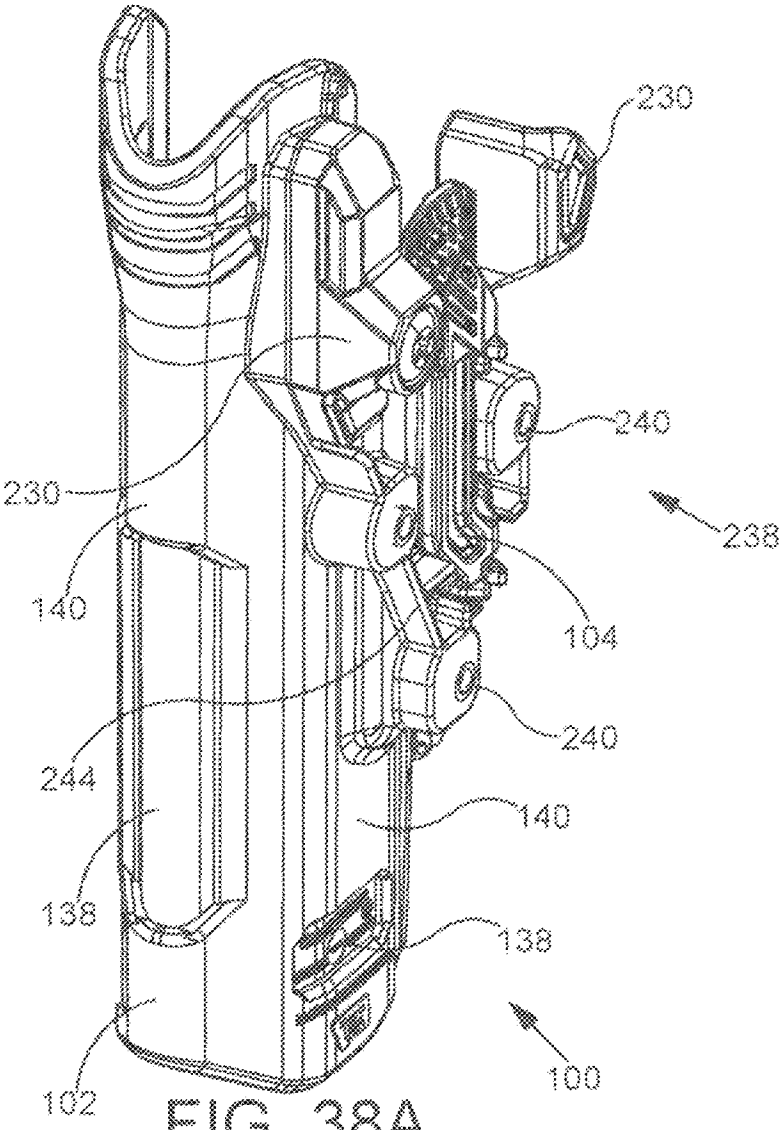
Figure 39D:
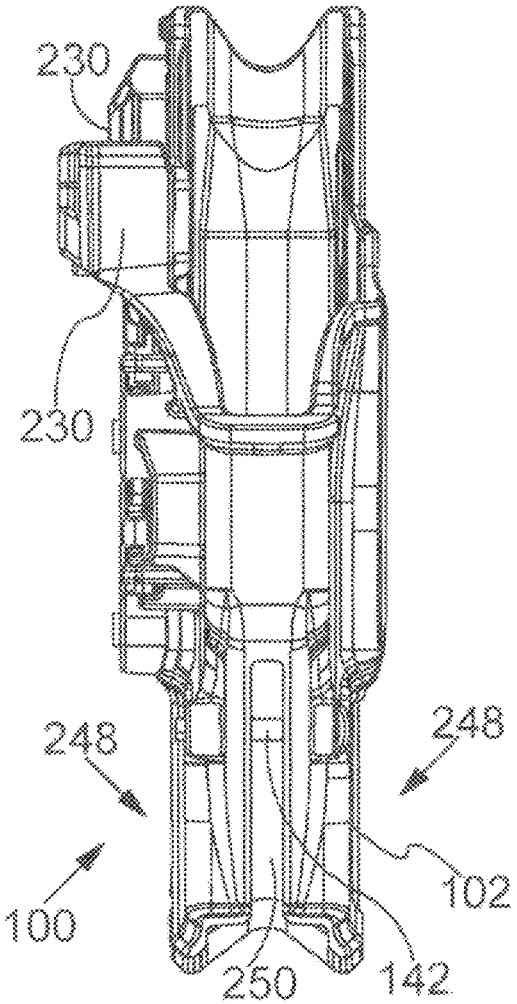
FIG. 39D is a rear view of the holster shown in FIGS. 38A and 38B.
Figure 39E:
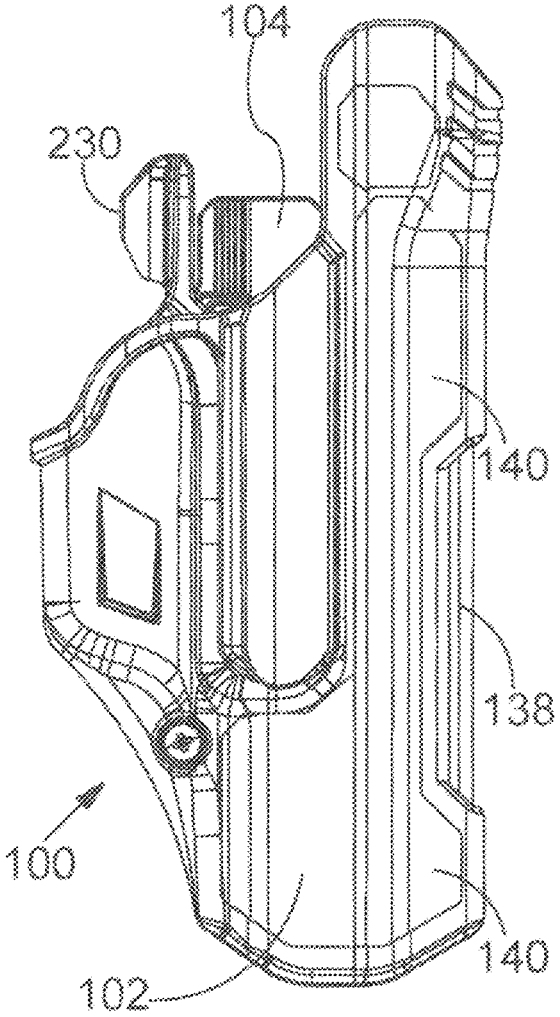
FIG. 39E is a left side view of the holster shown in FIGS. 38A and 38B.
Figure 39F:
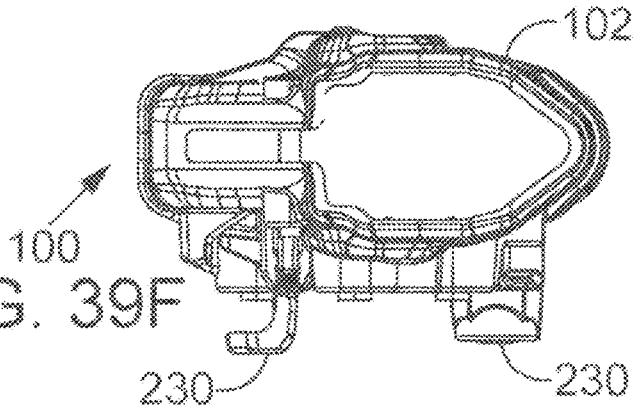
FIG. 39F is a bottom view of the holster shown in FIGS. 38A and 38B.
Figure 40:
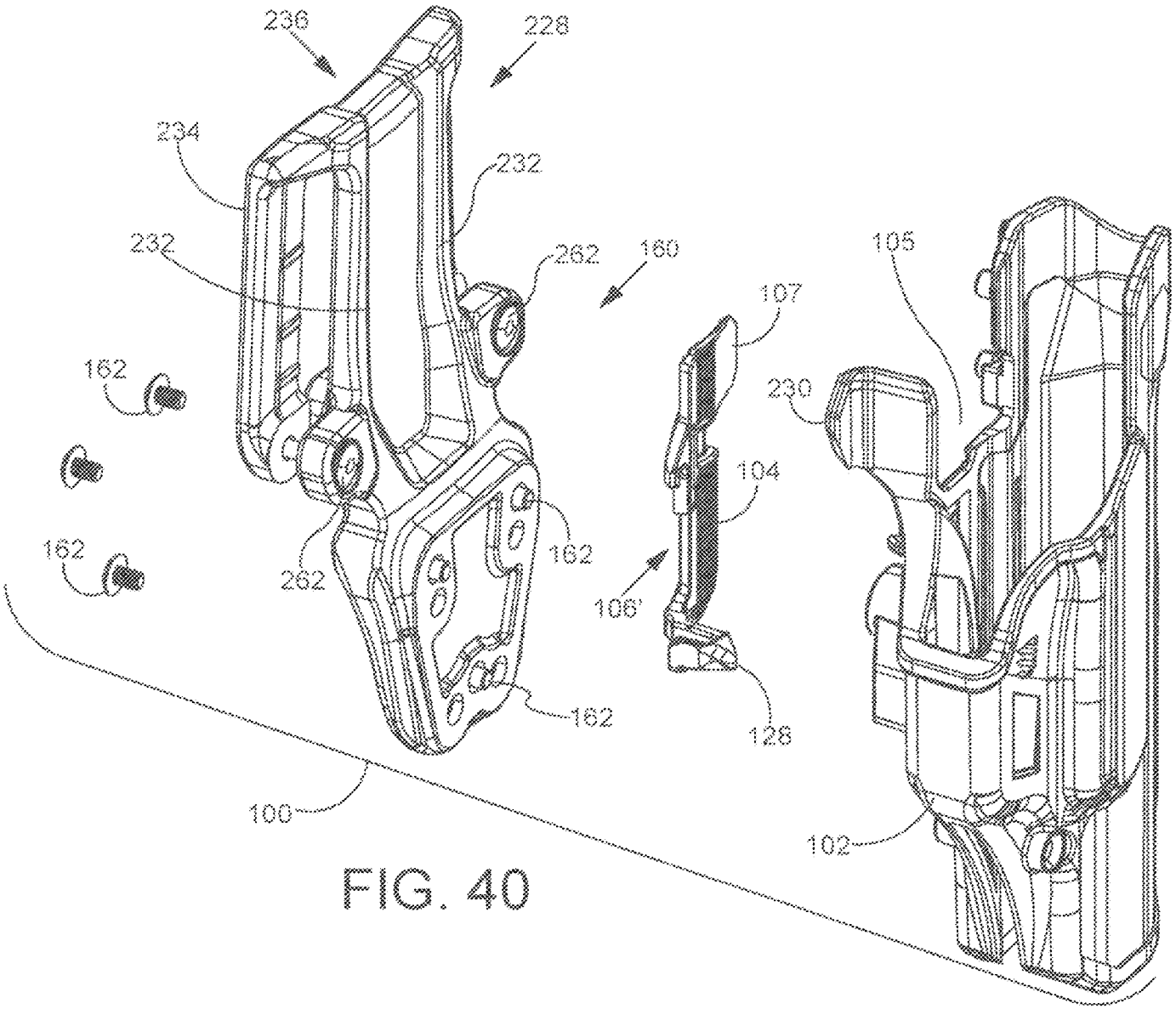
FIG. 40 is an exploded perspective view showing a belt receiving member, a holster body and a lever.
Figure 41:
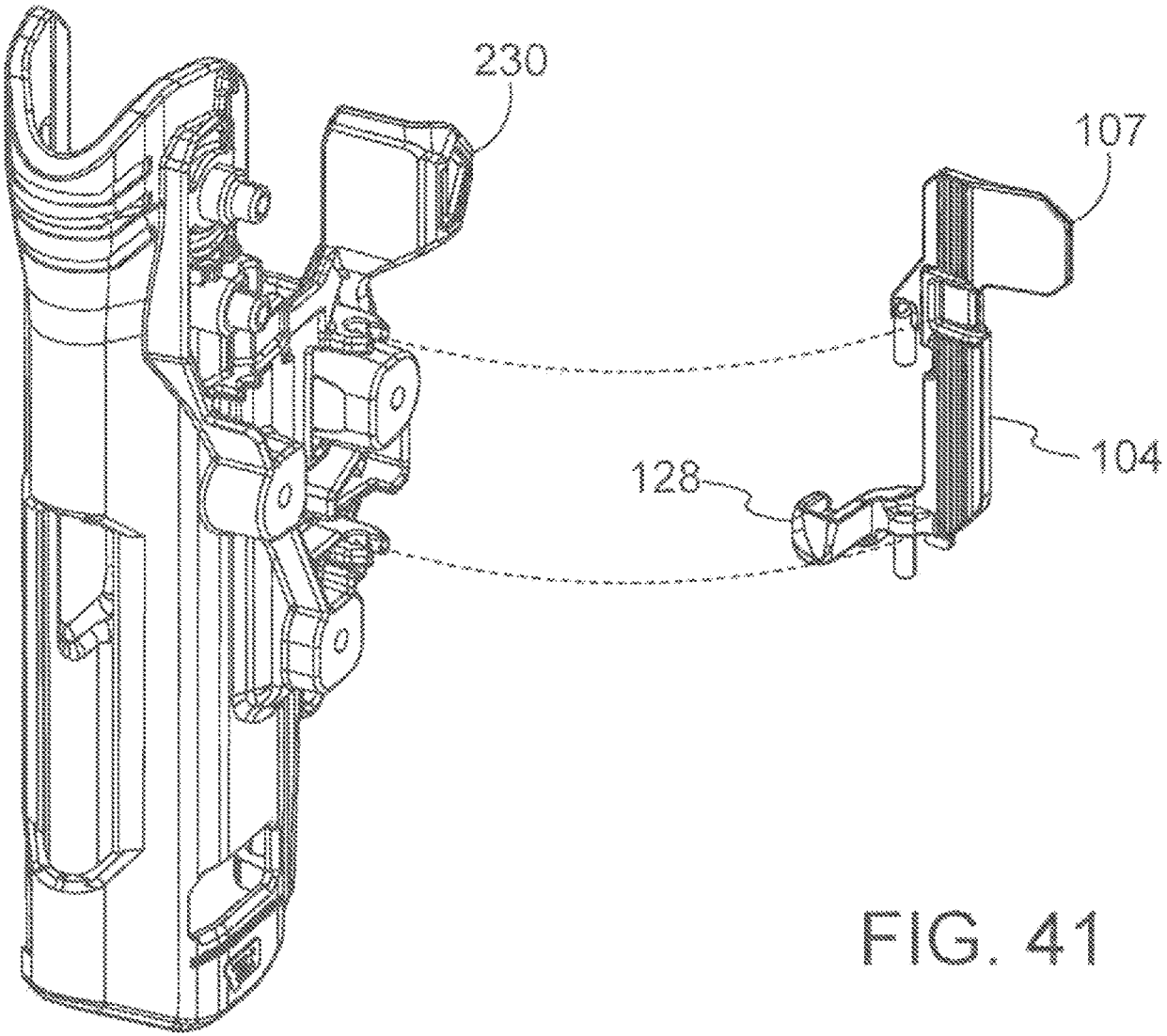
FIG. 41 is an exploded perspective view showing a holster body and a lever.
Figure 42:
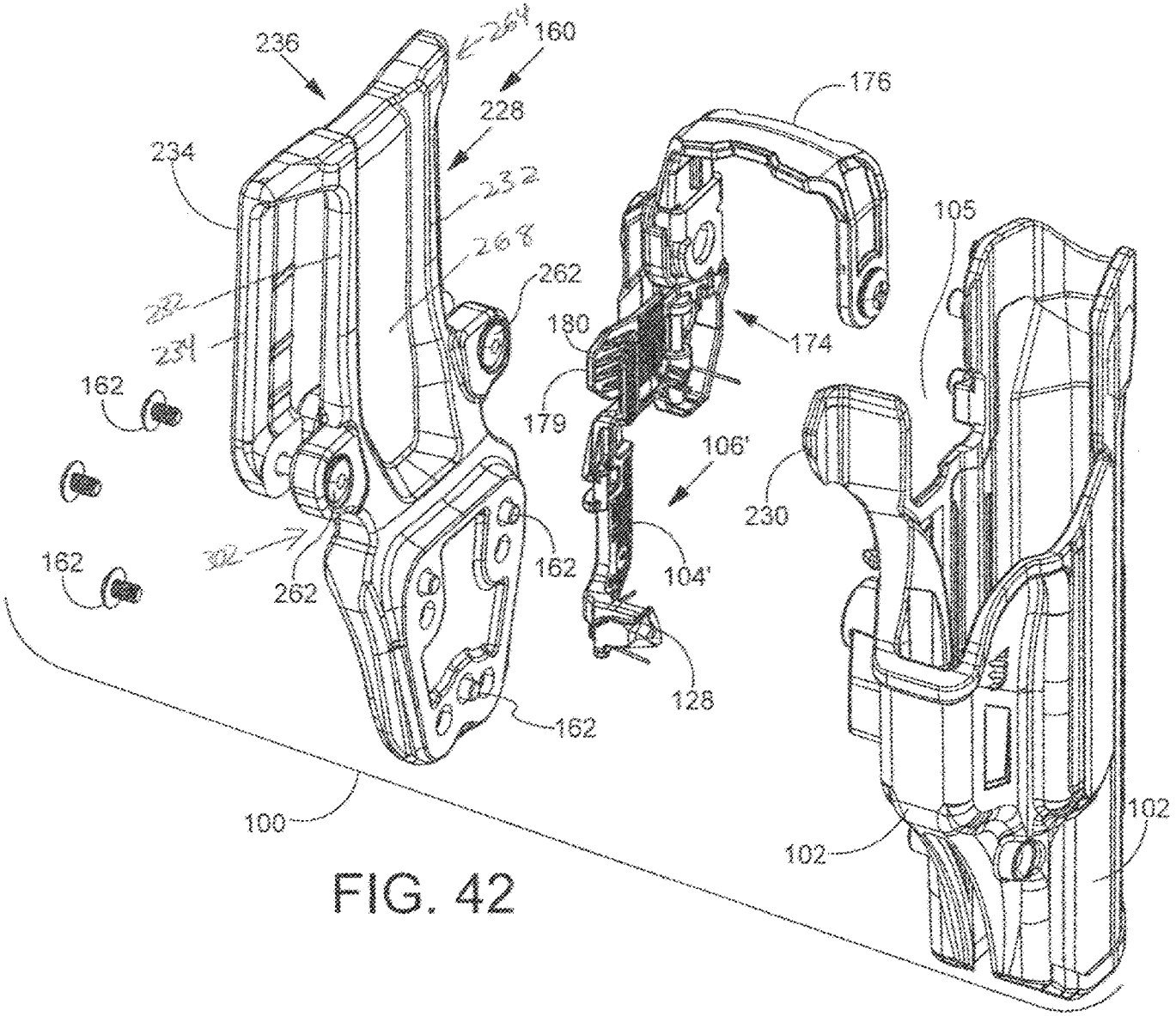
FIG. 42 is an exploded perspective view showing a belt receiving member, a holster body and two locking mechanisms.
Figure 43:
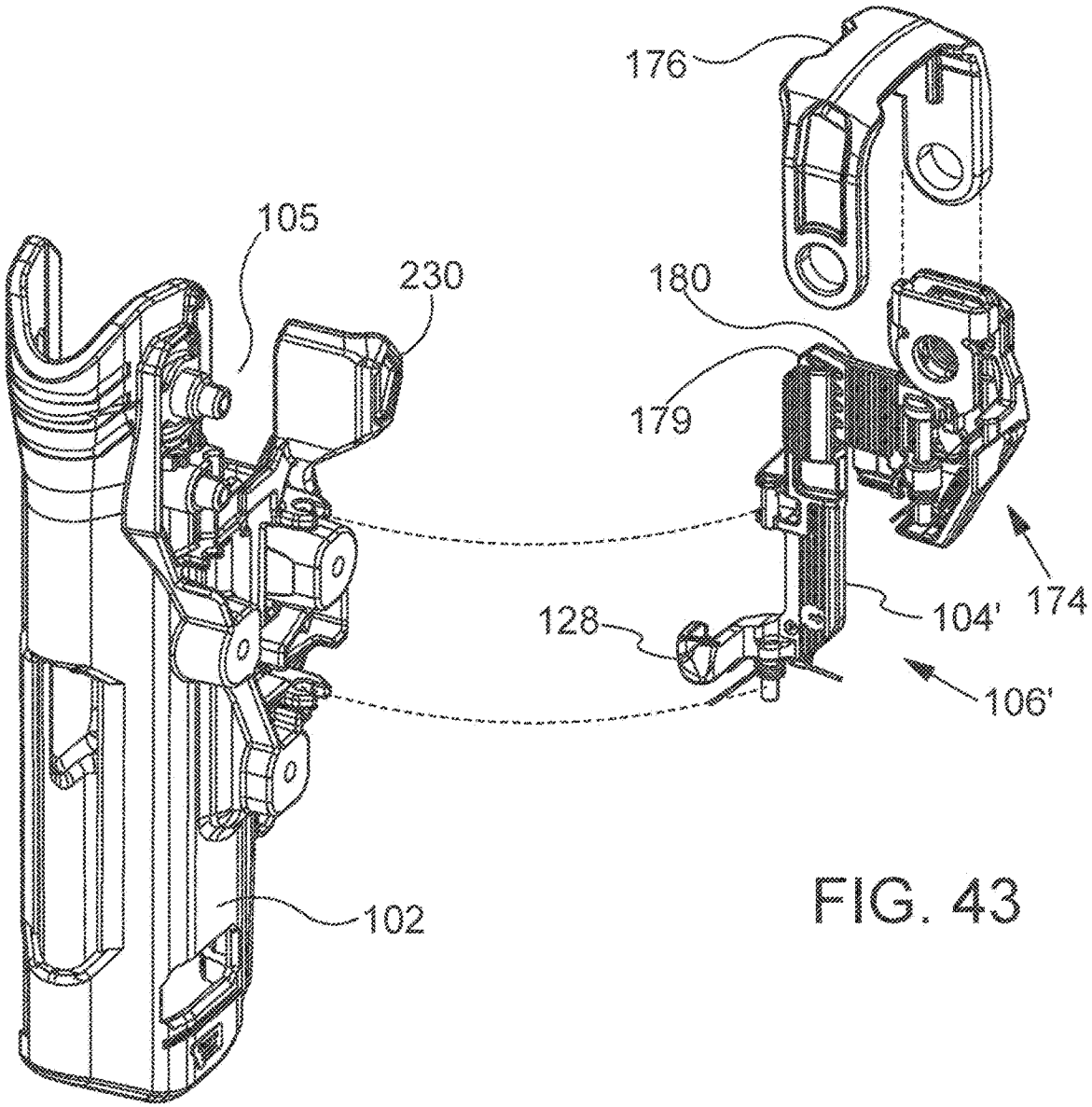
FIG. 43 is an exploded perspective view showing a holster body and two locking mechanisms.
Figure 45:
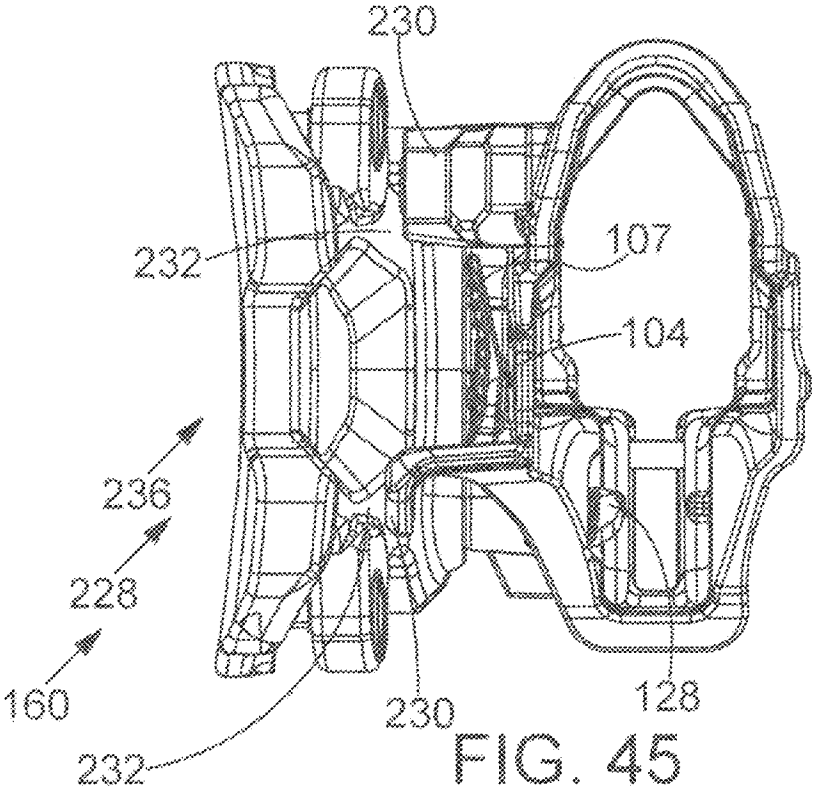
FIG. 45 is a top view showing the belt receiving member, the holster body and the lever shown in FIG. 40.
Figure 44:
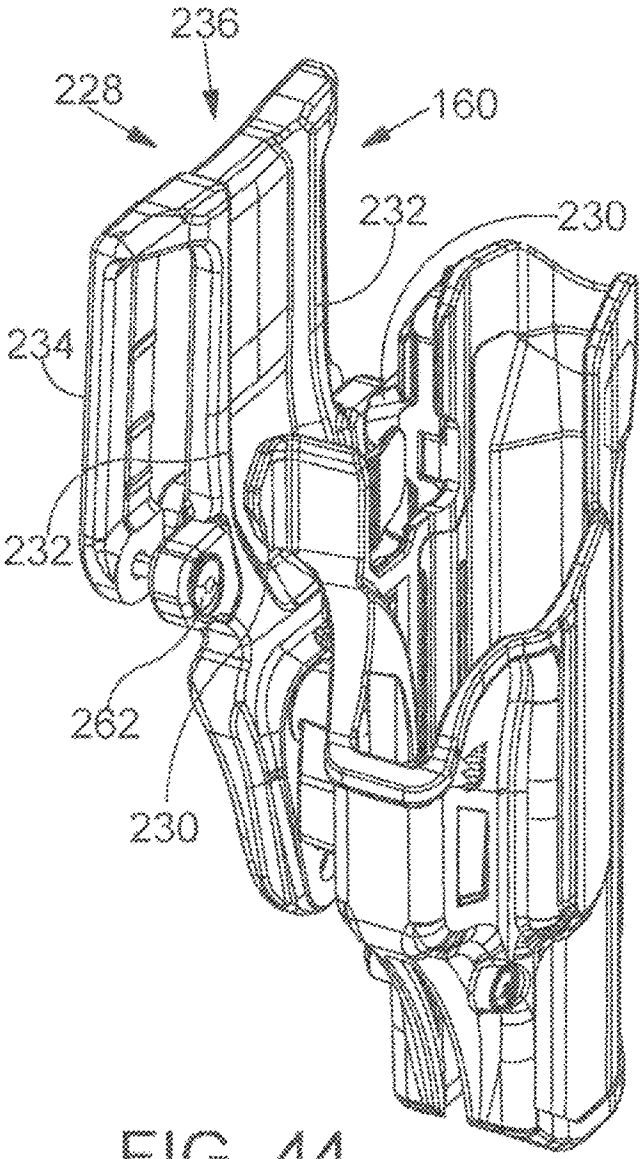
FIG. 44 is a perspective view showing the belt receiving member, the holster body and the lever shown in FIG. 40.
Figure 47:
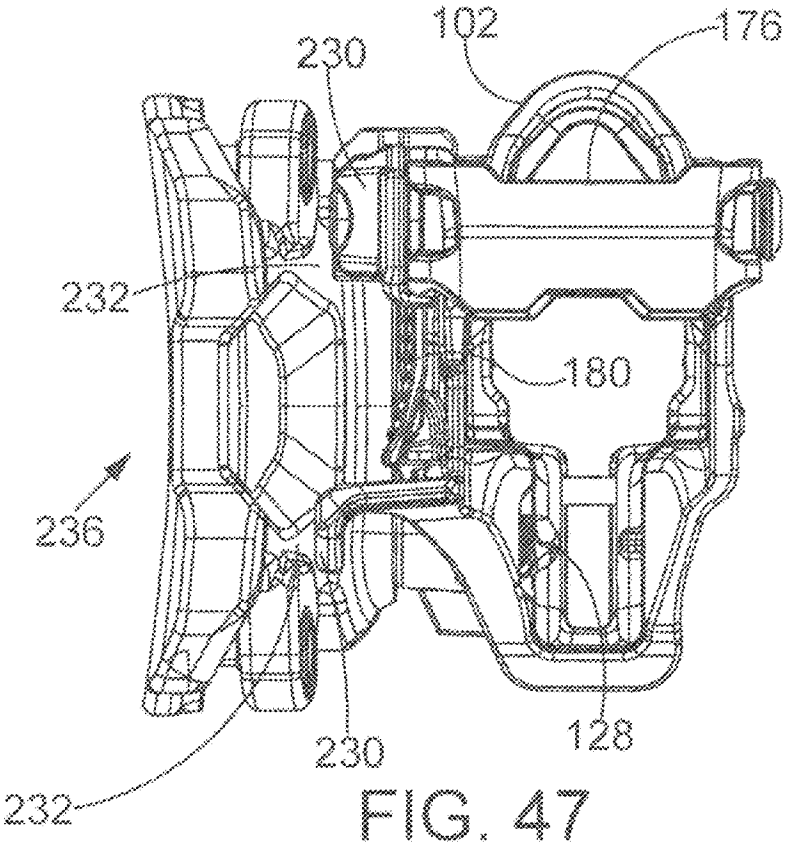
FIG. 47 is a top view showing the belt receiving member, the holster body and the locking mechanisms shown in FIG. 42.
Figure 46:
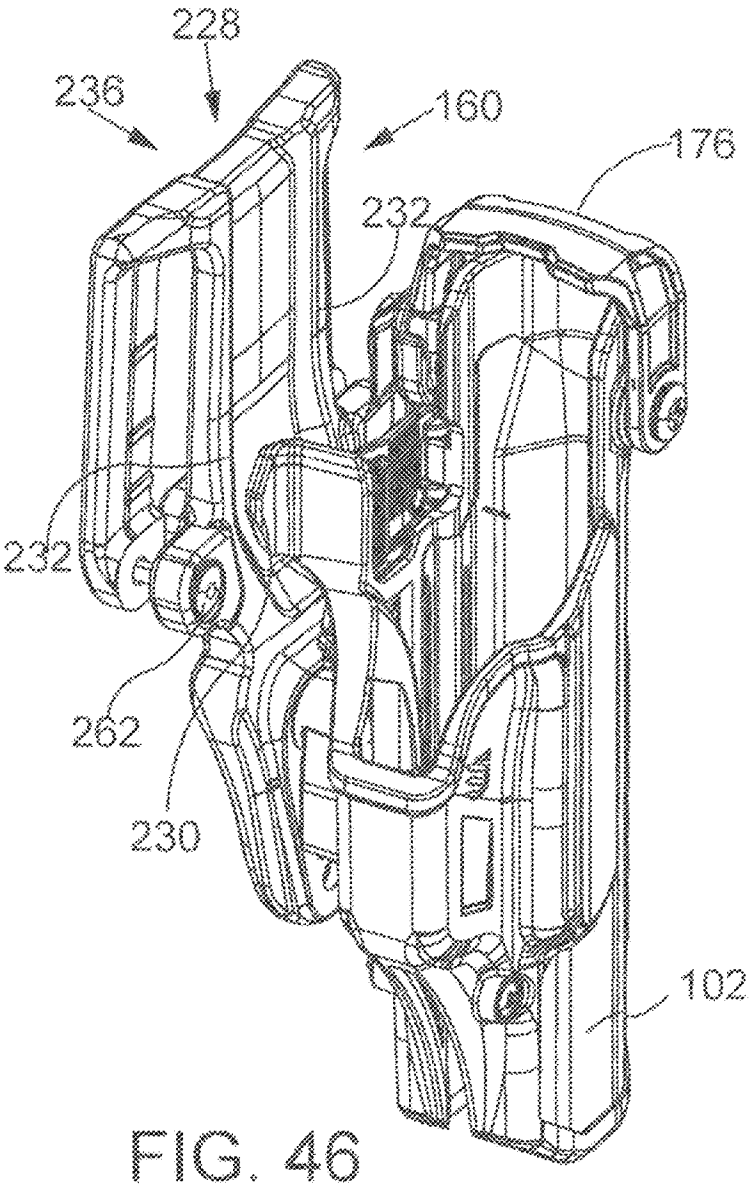
FIG. 46 is a perspective view showing the belt receiving member, the holster body and the locking mechanisms shown in FIG. 42.
Figure 48:
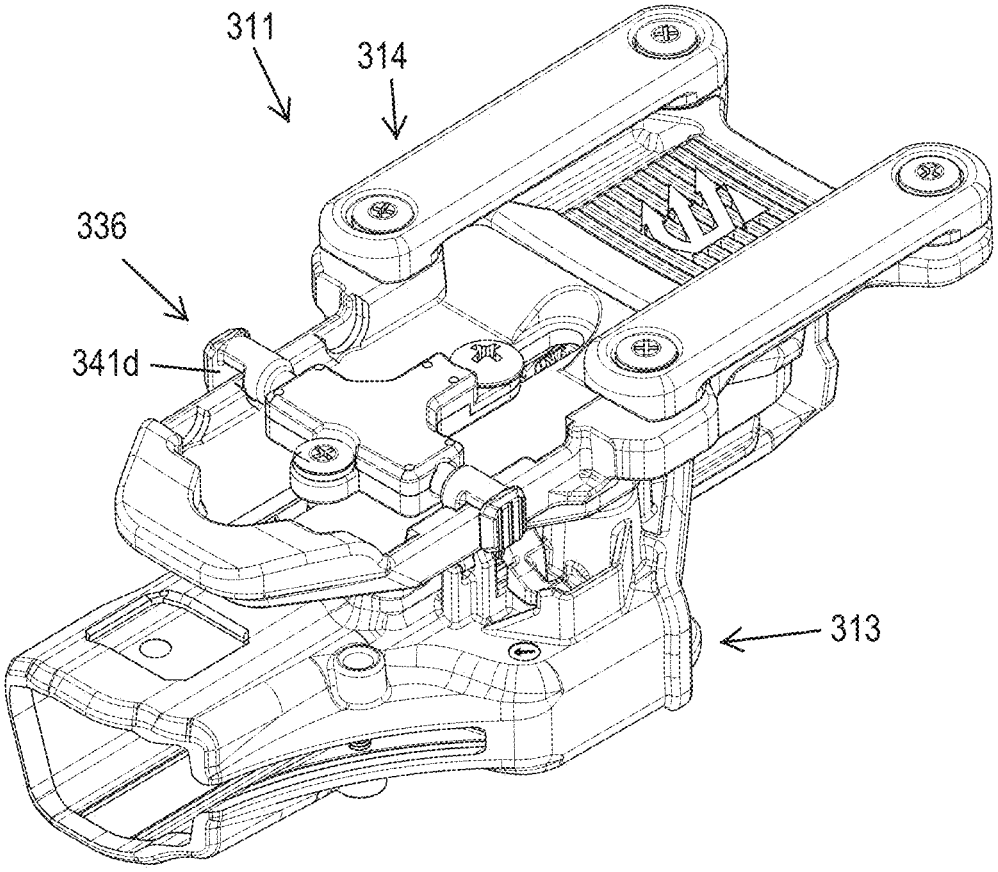
FIG. 48 is a rear perspective views of the holster assembly according to another embodiment.
Figure 49:
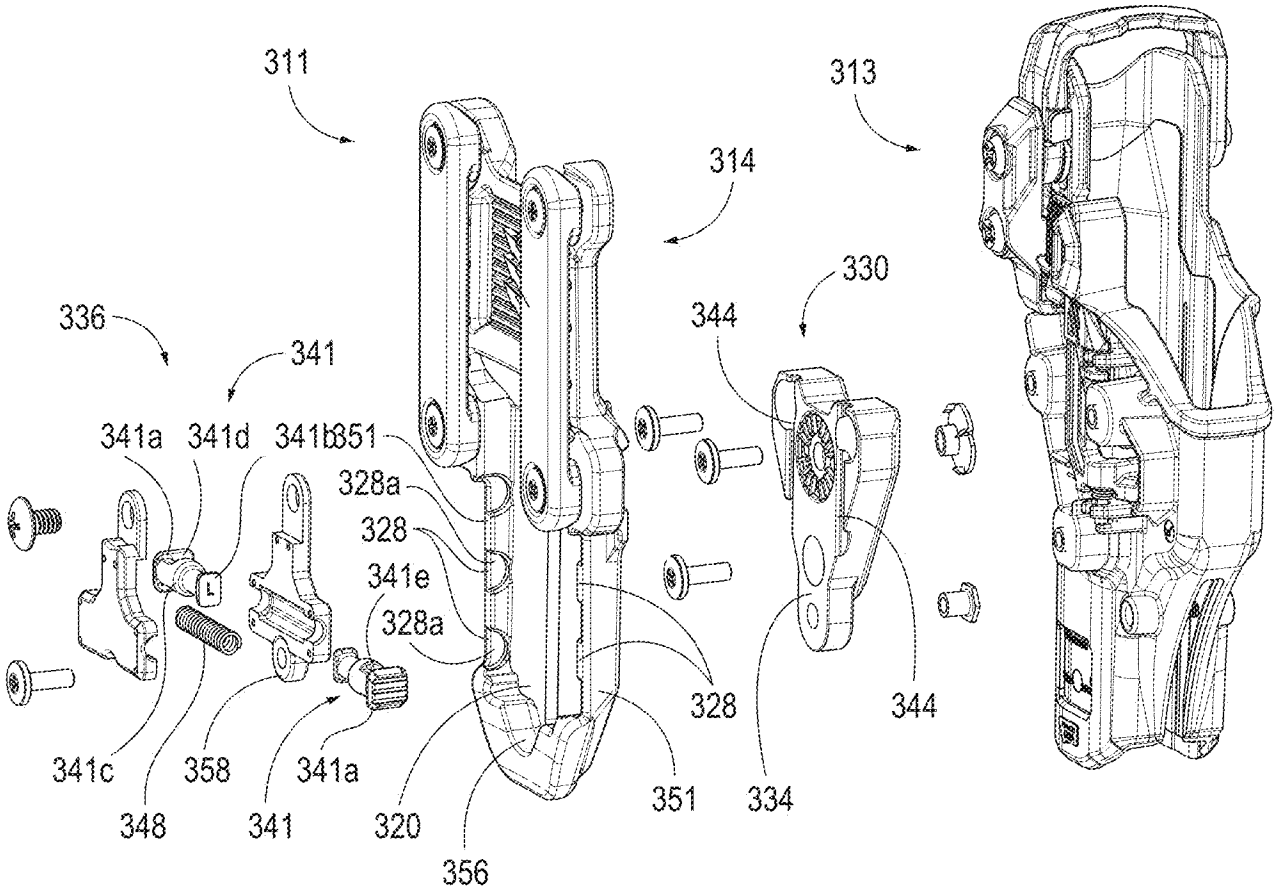
FIG. 49 is a rear perspective, exploded view of the holster assembly of FIG. 48.
Figure 50:
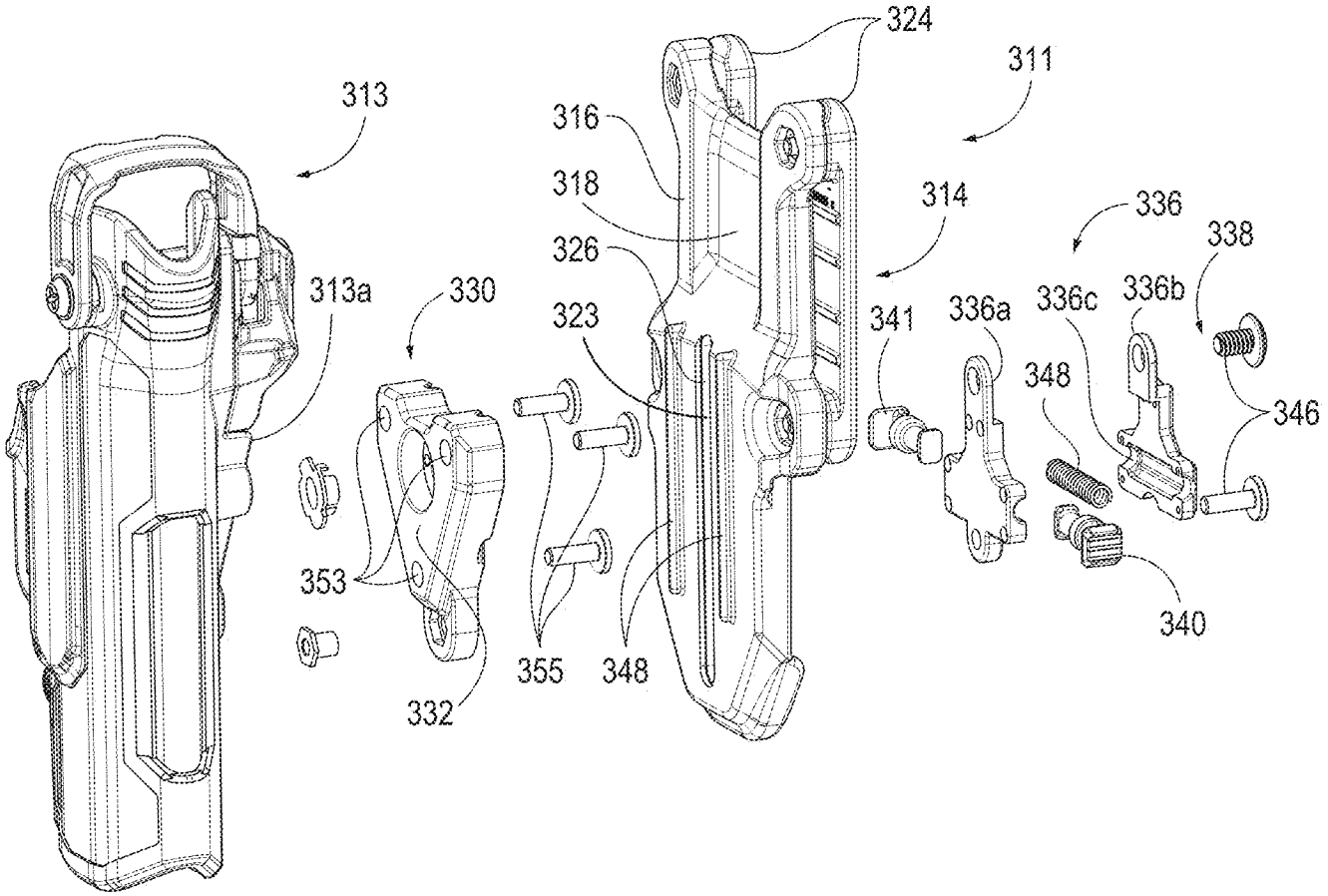
FIG. 50 is a front perspective, exploded view of the holster assembly of FIG. 48.
Figure 51A:
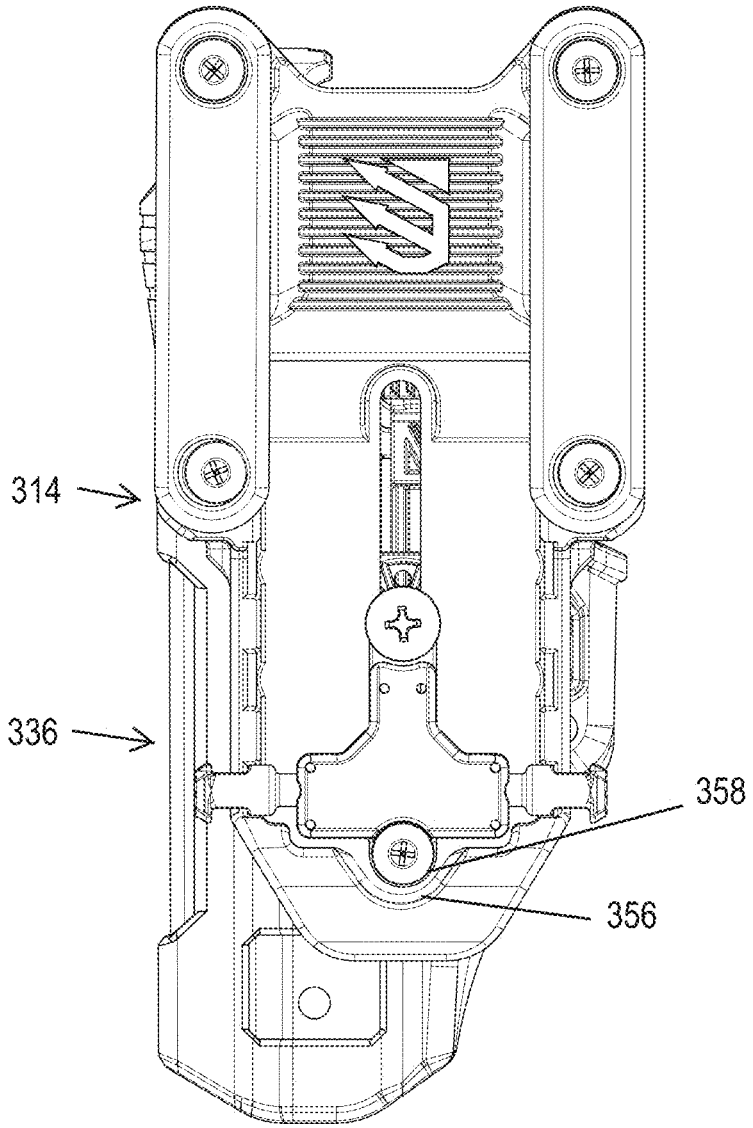
FIG. 51A is a rear view of the holster assembly of FIG. 48 showing the holster in the lowest ride height position.
Figure 51B:
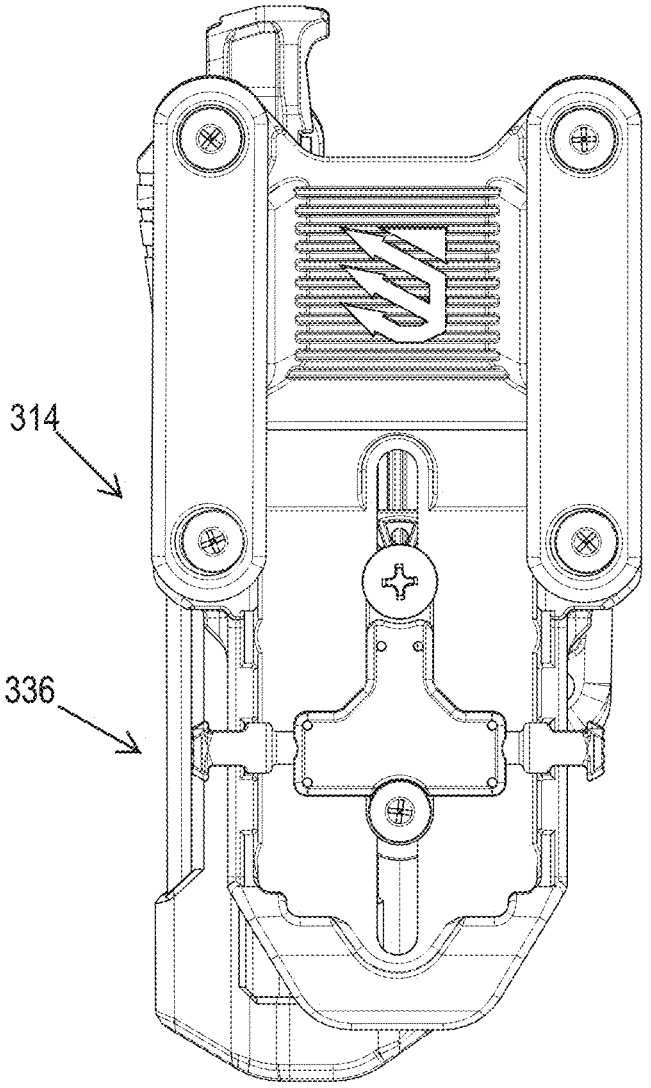
FIG. 51B is a rear view of the holster assembly of FIG. 48 showing the holster in the middle ride height position.
Figure 51C:
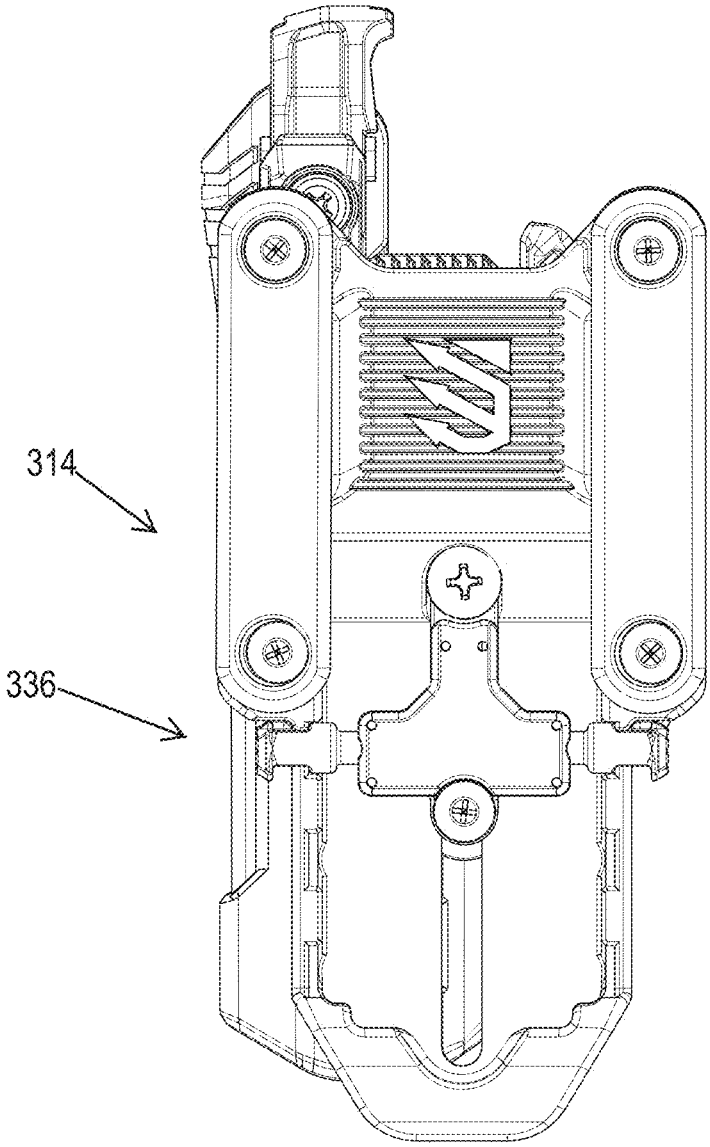
FIG. 51C is a rear view of the holster assembly of FIG. 48 showing the holster in the highest ride height position.
Figure 52:
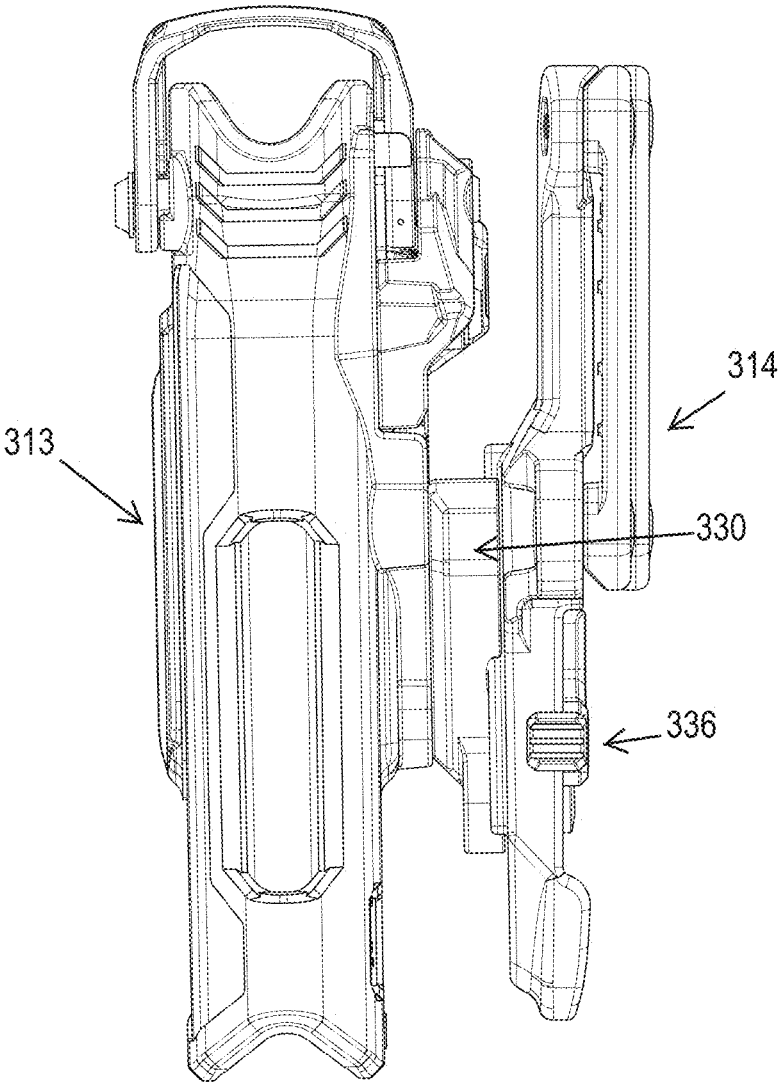
FIG. 52 is side view of the holster assembly of FIG. 48.
Figure 53:
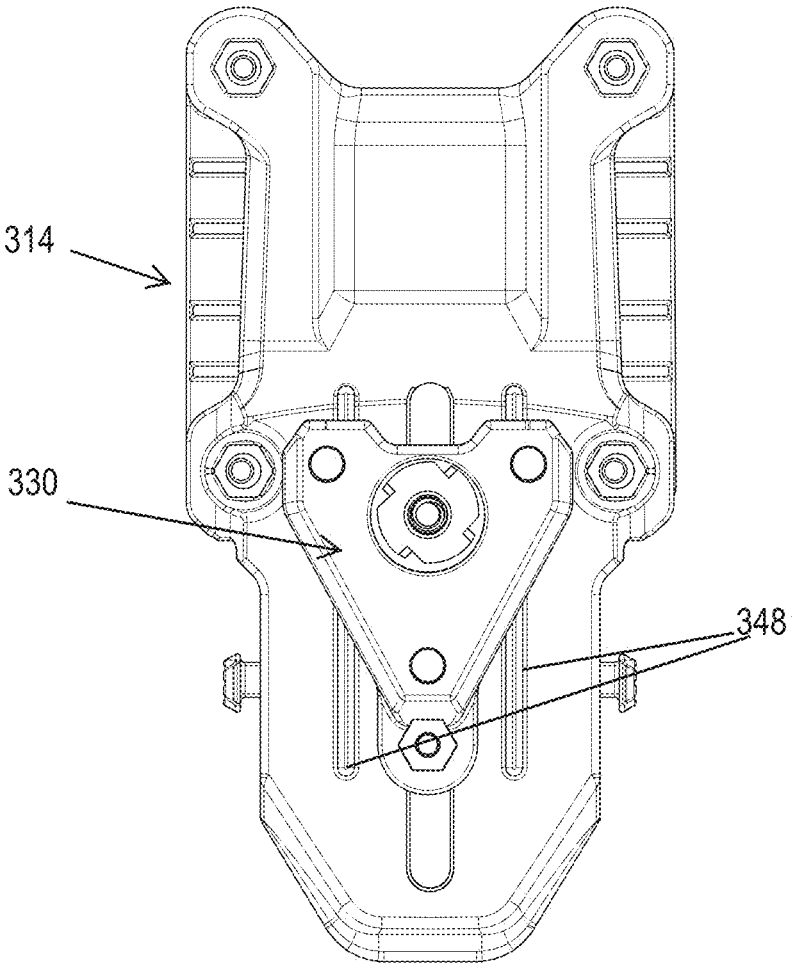
FIG. 53 is front view of the holster assembly of FIG. 48 without the holster.
Figure 54:
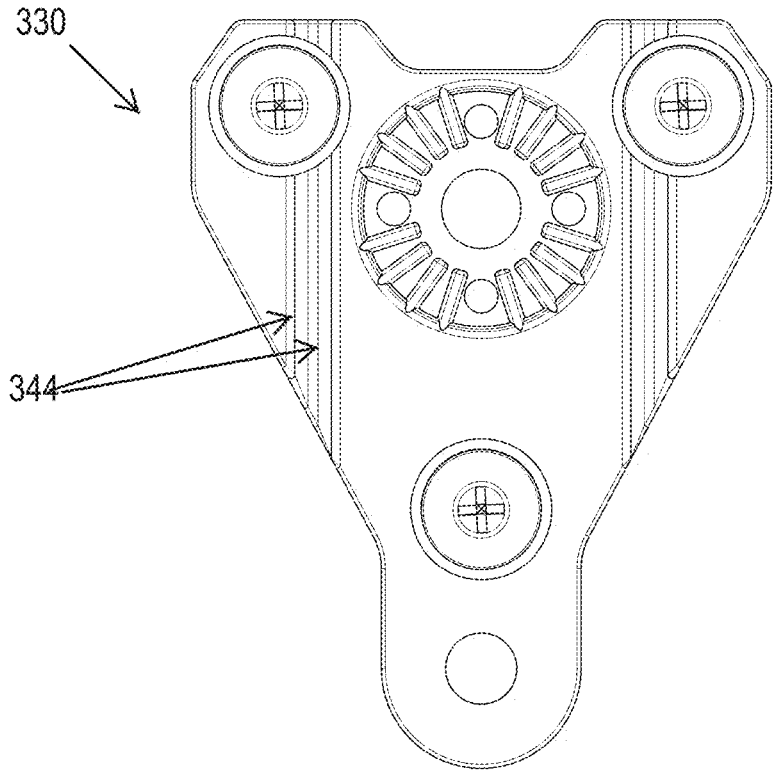
FIG. 54 is a rear view of the holster carrier of the holster assembly of FIG. 48.
Figure 55:
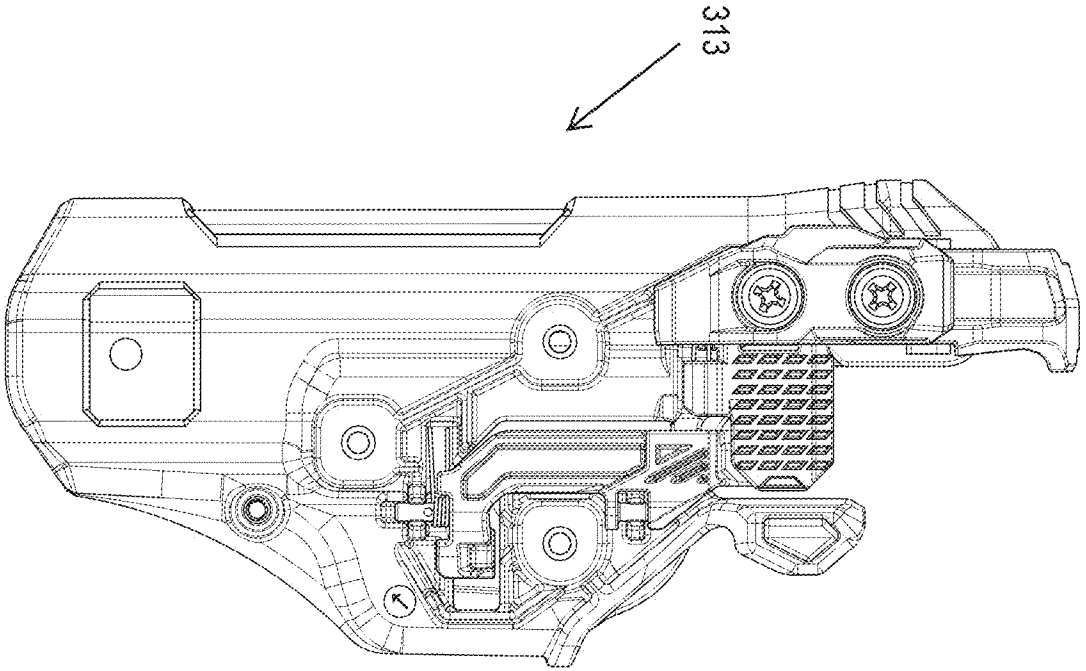
FIG. 55 is a rear view of the holster of the holster assembly of FIG. 48.
Figure 56:
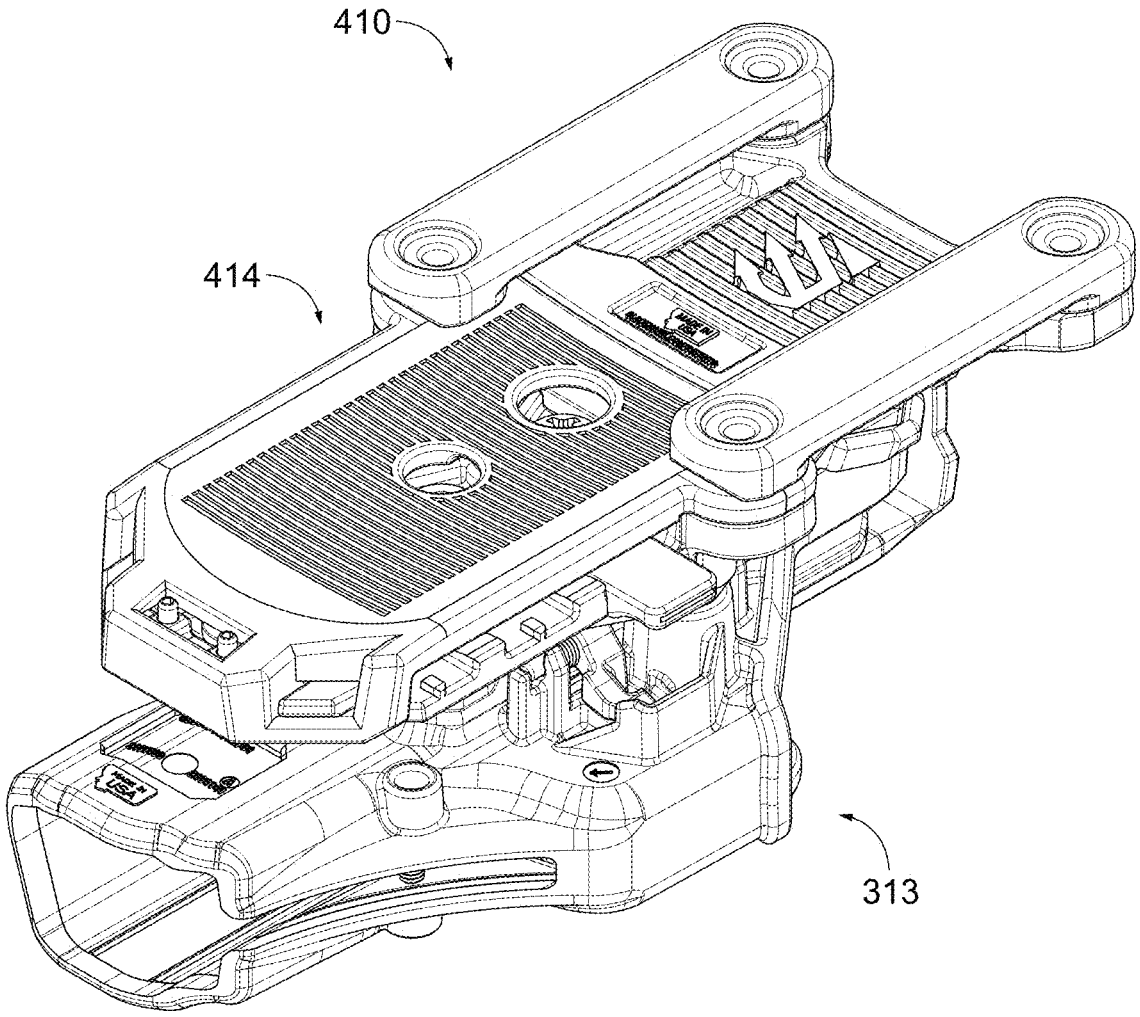
FIG. 56 is a rear perspective views of the holster assembly according to another embodiment.

Referring to FIGS. 33A and 33B, a feature and benefit of embodiments is a retention mechanism having a lever 104 that can be pivoted with little tension in the muscles and tendons of the forearm and thumb while the forearm is extending in a downward direction and the thumb is contacting a thumb receiving tab 180. In embodiments, the retaining mechanism comprises a thumb receiving tab 180 that pivots about a first axis and a lever 104 that pivots about a second axis that is parallel to the first axis. In embodiments, the lever 104 pivots about an axis that is parallel to a handgun insertion and withdrawal axis 110H of the holster 100. In embodiments, the thumb receiving tab 180 pivots about an axis that is parallel to a handgun insertion and withdrawal axis of the holster 100. FIGS. 33A and 33B are two perspective views showing a holster including a U-shaped shroud. In the embodiment of FIG. 33A, the U-shaped shroud is in a handgun retaining position. In the embodiment of FIG. 33B, the U-shaped shroud is in a release position.

Referring to FIGS. 1-47, in embodiments, an exteriorly worn holster 100 for receiving a handgun 80 has a holster body 102 having a plurality of unitary holster wall portions defining a handgun receiving cavity 108 and a rearward opening 88. In embodiments, the handgun has a handgun body 84, a handgrip 86, a slide 98, and a trigger guard 90. In embodiments, the holster body 102 has a handgun receiving and withdrawal axis 110H. In embodiments, the plurality of holster wall portions comprise a user proximal wall portion 113 and a user distal wall portion 115, the proximal wall portion 113 having thumb button recess 218 with a thumb button recess edge portion 220 defining the thumb button recess 218. In embodiments, the thumb button recess 218 extends forwardly from the rearward opening 88.

In embodiments, a first user actuatable handgun retention mechanism 106 of the holster 100 is located at the proximal wall portion 113 for selectively preventing the handgun 80, when in the cavity 108, from being withdrawn from the cavity 108. In embodiments, the first handgun retention mechanism 106 comprises a first lever 104 pivotally mounted on the proximal wall portion 113 of the holster body 102 with a first axis of rotation. In embodiments, the first lever 104 has an actuation tab 107 rearwardly positioned on the lever 104 and positioned within the thumb button recess 218. In embodiments, the actuation tab 107 has an upper margin 222, a rearward margin 224, and a lower margin 226. In embodiments, the lever 104 further has a trigger guard blocking portion 128 forwardly positioned on the lever 104, the lever 104 being configured and positioned such that depression of the actuation tab 107 rotates the lever 104 about its respective axis of rotation to move the trigger guard blocking portion 128 from a trigger guard blocking position to a non-blocking position.

In embodiments, an upper portion 242 of the thumb button recess edge portion 220 extends rearwardly of the actuation tab 107 along the upper margin 222 of the actuation tab 107 and a lower portion 246 of the thumb button recess edge portion 220 extends rearwardly of the actuation tab 107 at the lower margin 226 of the actuation tab 107.

In embodiments, the holster 100 has only a single user actuatable handgun retention mechanism 106 and the actuation tab is configured as an actuation tab 107. In embodiments, the holster 100 comprises a pair of thumb guides 230 positioned above and below the actuation tab 107, the thumb guides 230 projecting laterally outward from the holster body proximal wall portion 113 beyond an undepressed position of the actuation tab 107. In embodiments, the thumb guides 230 each extend laterally outward from an outward surface of the proximal wall portion 113 a distance of at least 0.35 inches.

In embodiments, the holster 100 has a second handgun retention mechanism 174 including a pivoting shroud 176 positioned rearwardly of the slide 98 of the handgun 80 holstered in the holster 100. In embodiments, the second handgun retention mechanism 174 comprises a second lever 104', the second lever 104' having an actuation tab configured as a thumb button 180, the actuation tab of the first lever position behind the thumb button 180 whereby depression of the thumb button 180 also depresses the actuation tab of the first lever.

In embodiments, the holster 100 further comprises a pair of thumb guides 230 positioned above and below the thumb button 180, the thumb guides 230 projecting laterally outward from the holster body 102 proximal wall portion 113 beyond an undepressed position of the thumb button 180.

In embodiments, one of the thumb guides 230 is positioned above the thumb button 180 and comprises a housing for the second handgun retention mechanism 174.

In embodiments, a belt engaging member 160 is attached to the holster body 102 with a plurality of threaded fasteners 162 extending into the holster body 102.

In embodiments, one of said threaded fasteners 162 is positioned above the first lever 104, one of the plurality of threaded fasteners 162 is positioned below the first lever 104, and one of the plurality of threaded fasteners 162 is positioned forward of the first lever 104, wherein the first lever 104 is captured between the holster body 102 and the belt engaging member 160.

In embodiments, a column portion 236 of the belt engaging member 160 extends rearwardly, wherein when the handgun 80 is holstered. In embodiments, the thumb button 180 is positioned between the handgun body 84 and the belt engaging member 160, wherein the belt engaging member 160 has a pair of ribs 232 having their elongate dimension extending forwardly and rearwardly and positioned to confront the thumb guides 230 whereby access to the thumb button 180 is restricted on four sides of the thumb button 180 and an access path 252 for the thumb is provided rearwardly of the thumb button 180. Ribs 232 and bottom rib 254 define a cavity 256 or recess with three sides in the column portion 236 of belt engaging member 160. By providing a cavity 256 in belt engaging member 160, an access path 252 is provided, while allowing the holster 100 to be positioned closer to the body of the user than if cavity 256 were not present and the fourth wall of the cavity 256 was instead provided by a surface coplanar with the rest of the column portion 236 of belt engaging member 160. The ribs 232 may provide structural strengthening of the lower plate portion 258 as well as providing access inhibiting structure to prevent access by others from front of the holster 100 or the back side of the holster 100, as the holster 100 is worn. The recess or cavity 256 opening upwardly providing access to the holster wearer as well as guide structure to easily and non-visually guide the user's thumb to the proper location both to actuate a thumb release button 180 and for the master grip.

In embodiments, the belt engaging member 160 comprises a jacket slot belt loop 228. In embodiments, the jacket slot belt loop 228 has a column portion 236 including a lower plate portion 258 having a holster attachment region 260, a mid level portion 302, and an upper portion 264 with a pair of clamping belt loop portions 234. The lower plate portion 258 having apertures 266 for receiving threaded fasteners 162 for attachment of the holster body 102. The mid level portion 302 may have a distal side 268 that cooperates with the holster body 102 to capture components of a retention mechanism 106 between the holster body 102 and the mid level portion 302 and thereabove a pair of upright ribs 232 protruding outwardly from the distal side 268 of mid level portion 302 defining recess or cavity 256 therebetween that extends upwardly to the upper portion 264 and is open upwardly. In embodiments, the jacket slot belt loop 228 having a pair of clamping belt loop portions 234 extending from the column portion 236, each of the clamping belt loop portions 234 being adjustable with respect to the column portion 236 by a respective threaded fastener 262. The upper portion 264 having a central column 272. A pair of belt loop portions 234 are displaced distally inward of the central column 272 and displaced laterally from the central column 272. The belt loop portions 234 connect to the central column 272 at upper connecting portions 274. In certain embodiments, the central column 272, the upper connection portions 274 and the belt portions 234 all unitary with each other. Each belt loop portion 234 having a lower end 276 not unitarily joined to the central column 272 but having a closable spacing therefrom. The central column 272 may have protruding portions configured as bosses 280 to cooperate with the lower ends 276 of the belt loop portions 234. Threaded fasteners 262 may be utilized to adjust the spacing between each belt loop portions 234 and the central column 272 effecting a clamping action onto a belt, such as a duty belt, whereby the jacket slot belt loop 228 is secured to a user's belt. Optional elastomeric bushings (not shown) may be utilized between the lower ends 276 of the belt loop portions 234 and bosses 280 of the central column 272 wherein the bushings comprise a bore in a central axis of bosses 280 for receiving the threaded fasteners 262. A feature and advantage of such embodiments is that the level of clamping of the jacket slot belt loop 228 and holster 100 are readily adjustable. Moreover, the lateral offset of the belt loop portions 234 from the central column 272 provides stability for the mounting system and holster 100 as the length of the engagement of the jacket slot belt loop 228 with the holster 100 is extended.

In certain embodiments, threaded fasteners 262 can be unscrewed from lower ends 276 of the belt loop portions 234 such that there is a gap 284 between lower ends 276 of the belt loop portions 234 and bosses 280. This gap 284 allows the jacket slot belt loop 228 to receive a belt of the user without the user needing to weave the belt through belt slots 286 formed by the openings in between belt loop portions 234 and central column 272. This allows user to receive a belt in the belt slots 286 without removing other accessories already attached to the belt. Alternatively, a user can weave a belt through belt slots 286 without fully unscrewing threaded fasteners 262. Once a belt is received in the belt slots 286, the threaded fasteners 262 can be re-engaged with the lower ends 276 of clamping belt loop portions 234. The belt can be more tightly secured by tightening threaded fasteners 262. In certain embodiments, if a belt is of a narrower width than belt slots 286, the action of tightening threaded fasteners 262 may force the belt up in the belt slots 286 so that the belt is biased against the upper margin 288 of upper portion 292 of belt slots 286 (FIGS. 35A and 35D)23. In this manner, belt slots 286 can accommodate a belt that has a width less than that of belt slots 286. In certain embodiments, the distance between the lower ends 290 of the belt slots 286 near the bosses 280 may be greater than the distance between the upper portion 292 of the belt slots 286 near upper margin 288.

In some embodiments, the outside face 294 of the clamping belt loop portions 234 may have protruding features 296, such as ribs or studs, in order to receive a belt more securely (FIG. 35B). On other embodiments, the back side 298 of column portion 236 of belt engaging member 160 may also have protruding features 300 such as ribs or studs, in order to receive belt more securely.

In embodiments, the thumb guides 230 each extend laterally outward from an outward surface of the proximal wall portion 113 a distance of at least 0.35 inches. In embodiments, the thumb guides 230 each extend laterally outward from an outward surface of the proximal wall portion 113 a distance of at least 0.35 inches and the ribs 232 extend outwardly from a surface of the column portion 236 a distance of at least 0.15 inches.

In embodiments, the first lever 104 is seated in a lever receiving region 238 on the proximal wall portion 113 of the holster body and the proximal wall portion 113 has three threaded bosses 240 dispersed around the lever receiving region 238 for receiving a belt engaging member 160. In embodiments, the proximal wall portion 113 further has a plurality of lever region containment wall portions 244 extending from the outer surface of the proximal wall portion 113 and each of the plurality of lever containment wall portions 244 connect to at least one of the three threaded bosses 240. In embodiments, the three threaded bosses 240 are positioned for receiving a belt engaging member 160 utilizing a plurality of threaded fasteners 162.

In embodiments, the first lever 104 is seated in a lever receiving region 238 on the proximal wall portion 113 and the proximal wall portion 113 has three threaded bosses 240 dispersed around the lever receiving region 238 for receiving a belt engaging member 160 and, when the belt engaging member 160 is attached, the first lever 104 is captured within the lever receiving region 238. In embodiments, the first lever 104 may be removed from an engagement with the proximal wall portion 113 when the belt engaging member is not attached to the proximal wall portion 113. In embodiments, the first lever 104 may be removed without tools when the belt engaging member is not attached. In embodiments, the first lever 104 may be removed by simply prying the first lever 104 outward when the belt engaging member 160 is not attached.

In embodiments, the holster body 102 has an upper wall portion having a pair of inclined wall portions defining a joint, a lower wall portion with a slit 250 extending from a forward opening to proximate a trigger guard receiving portion of the holster body defining a pair of forward clamping wall portions 248. In embodiments, a threaded fastener 142 is positioned so as to extend between the pair of forward clamping wall portions 248 for adjusting the forward clamping wall portions 248 about a forward portion of the handgun 80.

Referring to FIGS. 1-47, in embodiments, a holster 100 is provided for receiving a handgun 80 having a handgun body 84, a slide 98, and a trigger guard 90. In embodiments, the holster 100 comprises a holster body 102 having a plurality of holster wall portions defining a rearward opening cavity 108 extending along a handgun receiving and withdrawal axis 110H for receiving and holding the handgun 80. In embodiments, the plurality of holster wall portions comprise a user proximal wall portion 113 and a user distal wall portion 115. In embodiments, the holster includes a first handgun retention mechanism 106' and a second handgun retention mechanism 174, disposed at the proximal wall portion 113, each handgun retention mechanism selectively preventing the handgun 80, when in the cavity 108, from being withdrawn from the cavity 108. In embodiments, the first and second handgun retention mechanisms have a respective first lever 104' having a first axis of rotation and a second lever 180 with an axis of rotation, each lever having a respective actuation tab portion on one end of the lever where depression of the actuation tab rotates the lever about its respective axis of rotation, one of the two actuation tabs configured as a thumb receiving button with an outer thumb receiving surface, the other of the two actuation tabs positioned behind the thumb receiving button such that depression of the thumb receiving button effects a depression of the other of the two actuation tab portions, whereby depression of the thumb receiving button actuates both the first handgun retention mechanism 106' and the second handgun retention mechanism 174. In embodiments, the first lever 104' of the first handgun retention mechanism 106' is pivotally supported by the holster body 102. In embodiments, the first lever 104' comprises an elongate central portion 124 and a blocking portion 128 at an end opposite the respective actuation tab, the blocking portion 128 movable in and out of a handgun blocking position. In embodiments, the second handgun retention mechanism 174 comprising a U-shaped member 176 that is pivotally supported by the holster body 102 so that the U-shaped member 176 selectively pivots between a handgun retaining position in which the U-shaped member extends across a portion of a rearward opening of the cavity 108 and a release position in which the U-shaped member 176 is displaced from the portion of the rearward opening so that a withdrawal path of the handgun 80 is unobstructed by U-shaped member 176.

Another embodiment is shown in FIGS. 48-55. This embodiment may include a holster support assembly 311 for supporting a holster 313 on a user's belt, and allowing the user to raise or lower the holster 313, attached to a holster attachment portion 323 of a belt engaging member 314, by manipulating a slider 336 via two diametrically opposed dual release buttons 341 that interact with recesses 328 on the rear face 320 of the belt engaging member 314.

The belt engaging member 314 may include a column portion 316 having a front face 318 configured to face the holster 313; the rear face 320 configured to face the user; a holster attachment portion 323; and at least one belt loop portion 324 extending from the rear face of the column portion 316 and configured to engage the user's belt.

In certain embodiments, the holster attachment portion 323 may include a central slot 326; a plurality of pairs of diametrically opposed recesses 328 on the rear face, defining a plurality of ride height positions. The recesses 328 of each pair of diametrically opposed recesses 328 may be on opposite sides of the central slot 326.

In some embodiments, holster carrier 330 may include a front face 332 configured to be mounted to the holster 313; and a rear face 334 configured for sliding movement relative to the front face 318 of the column portion 316.

In certain embodiments, a slider 336 may be mounted to the rear face 334 of the holster carrier 330 and include a sliding element 338 configured for sliding movement within the central slot 326; and the pair of diametrically opposed dual release buttons 341 configured to be selectively engageable with and disengageable with the pairs of diametrically opposed recesses 328. The diametrically opposed dual release buttons 341 may be configured to be disposed between the rear face 320 of the column portion 316 and the user.

In further embodiments, the front face 318 of the column portion 316 may further include a pair of parallel rails 348. The pair of parallel rails 348 may be disposed parallel to and on opposite sides of the central slot 326; and the rear face 334 of the holster carrier 330 further includes a pair of parallel grooves 344 corresponding to the pair of parallel rails 348. The pair of parallel grooves 344 may be configured for sliding engagement with the pair of parallel rails 348.

In some embodiments, the front face 318 of the column portion 316 may alternatively include a pair of grooves (not shown) instead of rails 348. The pair of parallel grooves may be disposed parallel to and on opposite sides of the central slot 326; and the rear face 334 of the holster carrier 330 may further include a pair of parallel ribs (not shown) instead of grooves 344 corresponding to the pair of parallel grooves (not shown). The pair of parallel ribs may be configured for sliding engagement with the pair of parallel grooves.

In certain embodiments, the sliding element 338 may be configured for sliding movement within the central slot 326 and may further include at least one fastener 346 extending between the slider 336 and the holster carrier 330.

In some embodiments, the slider 336 may further include a compression spring 348 disposed between the pair of diametrically opposed dual release buttons 341 and configured to bias the pair of diametrically opposed dual release buttons 341 to engage the pairs of diametrically opposed recesses 328; certain embodiments may include a clam shell housing 336*a*, 336*b* having a cylindrical recess 336*c* configured for supporting the compression spring 48 and the pair of diametrically opposed dual release buttons 341. In some embodiments, the compression spring may be disposed within a clam shell housing 336*a*, 336*b*.

In some embodiments, the holster attachment portion 323 may further include a pair of rearwardly projecting side ribs 351 disposed parallel to the central slot 326. The rearwardly projecting side ribs 351 may include the plurality of pairs of diametrically opposed recesses 328.

In certain embodiments, each of the diametrically opposed dual release buttons 341 may include a button portion 341*a* disposed laterally outside the rearwardly projecting side ribs 351; a compression spring engagement portion 341*b* disposed laterally inside the rearwardly projecting side ribs 351; and a stem portion 341*c* disposed in between the button portion 341*a* and the compression spring portion 341*b*. The stem portion 341*c* may include a U-shaped channel 341*d* configured to slidingly engage one of the rearwardly projecting side ribs 351, In some embodiments, the U-shaped channel 341*d* may have an outwardly facing engagement surface 341*e* configured to engage a corresponding inwardly facing engagement surface 328*a* on one of the diametrically opposed recesses 328 when the pair of diametrically opposed dual release buttons 341 is engaged with one of the pairs of diametrically opposed recesses 328.

The U-shaped channel 341*d* may have a width greater than a width of the one of the rearwardly projecting side ribs 351 such that when the diametrically opposed dual release buttons 341 are compressed towards one another, the outwardly facing engagement surface 341*e* on the U-shaped channel and the corresponding inwardly facing engagement surface 328*a* on the diametrically opposed recesses 328 are disengaged with one another allowing the sliding element 338 to slide within the central slot 326.

In certain embodiments, each stem portion 341*c* may be flared to self center in the diametrically opposed recesses 328 and limit play.

In some embodiments, the diametrically opposed recesses 328 may further include one of a relief and a hole in the bottom of the diametrically opposed recesses 328 configured to allow sand and debris to escape the diametrically opposed recesses 328.

In further embodiments, the plurality of pairs of diametrically opposed recesses 328 may include three pairs of diametrically opposed recesses 328.

The sliding element 338 may be configured to slide within the central slot 326 only when both button portions 341*a* in the pair of diametrically opposed dual release buttons 341 are compressed towards one another.

The compression spring 348 may be configured to autolock the sliding element 338 relative to the belt engaging member upon release of the pair of diametrically opposed dual release buttons 341 when aligned with one of the pairs of diametrically opposed recesses 328.

In certain embodiments, the holster carrier 330 may further include at least one aperture 353 configured for receiving at least one threaded fastener 355 for attachment to a holster body 313*a*.

In certain embodiments, a front face 332 and the rear face 334 of the holster carrier 330 define a holster carrier depth. The holster 313 may be offset from the belt engaging member 314 a distance equal to the holster carrier depth. The slider 336 does not contribute to the offset.

The holster carrier 330 may include a rear holster carrier member and a forward carrier member. The rear carrier member may be configured to be mounted to the slider 336. The forward carrier member may be configured to be mounted to the holster 313. The forward holster carrier member may be configured to be rotatable relative to the rear carrier member to adjust the cant of the holster 313.

In certain embodiments, the central slot 326 defines upper and lower limits of travel of the slider 336 belt, wherein the lower limit of travel is further defined by a contoured stop projection 356 extending rearwardly from the rear face 320 of the column portion 316 configured to engage a bottom projection portion 358 of the slider clam shell housing 336*a*, 336*b*.

Another embodiment is shown in FIGS. 56-63. This embodiment may include a holster support assembly 410 for supporting a holster 313 on a user's belt, and allowing the user to raise or lower the holster 313, attached to a holster attachment portion 422 of a belt engaging member 414, by manipulating a slider 436 via a leaf spring 460 that interacts with recesses or slots 428 on the rear face 420 of the belt engaging member 414.

Figure 57:
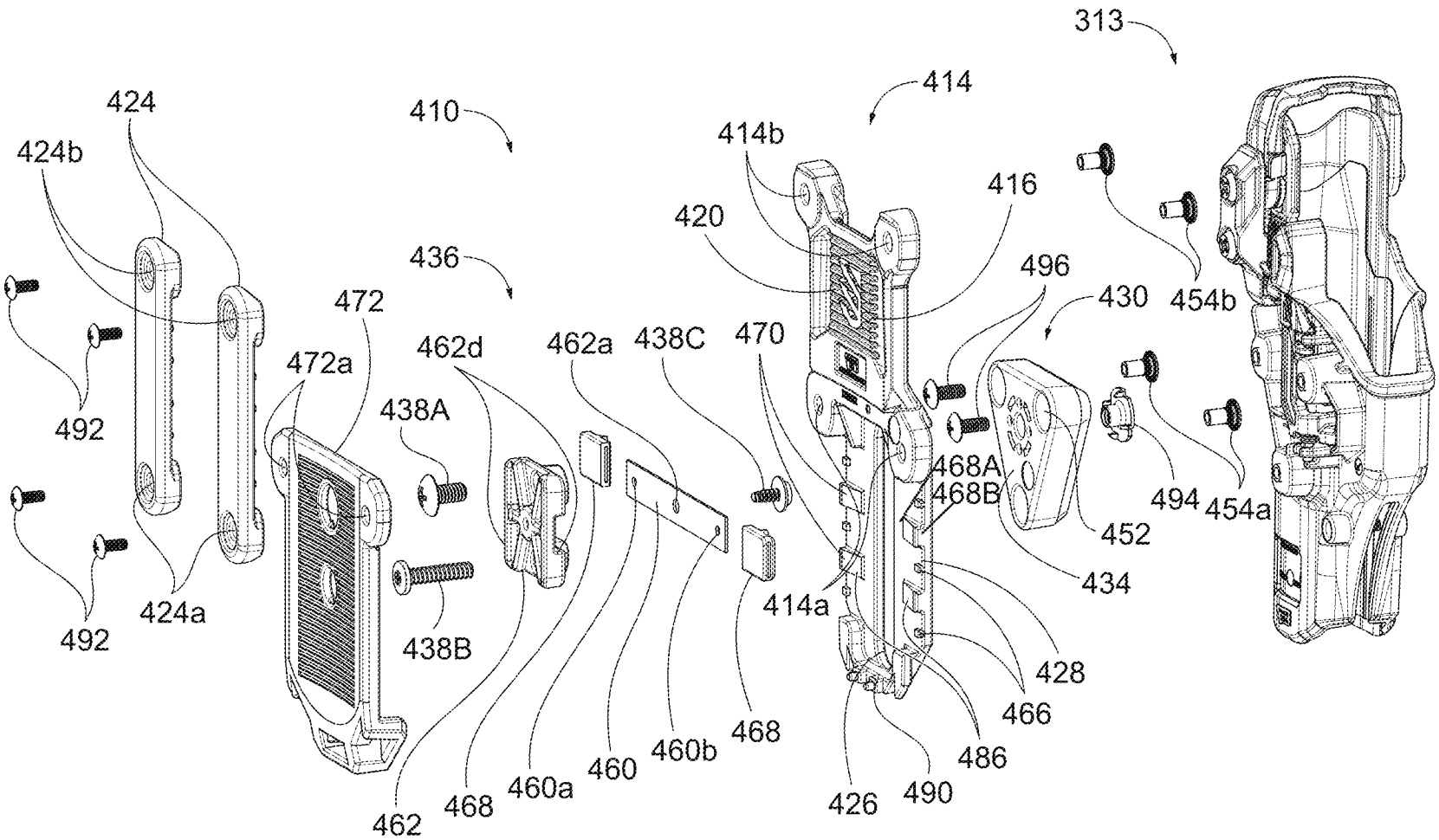
FIG. 57 is a rear perspective, exploded view of the holster assembly of FIG. 56.
Figure 58:
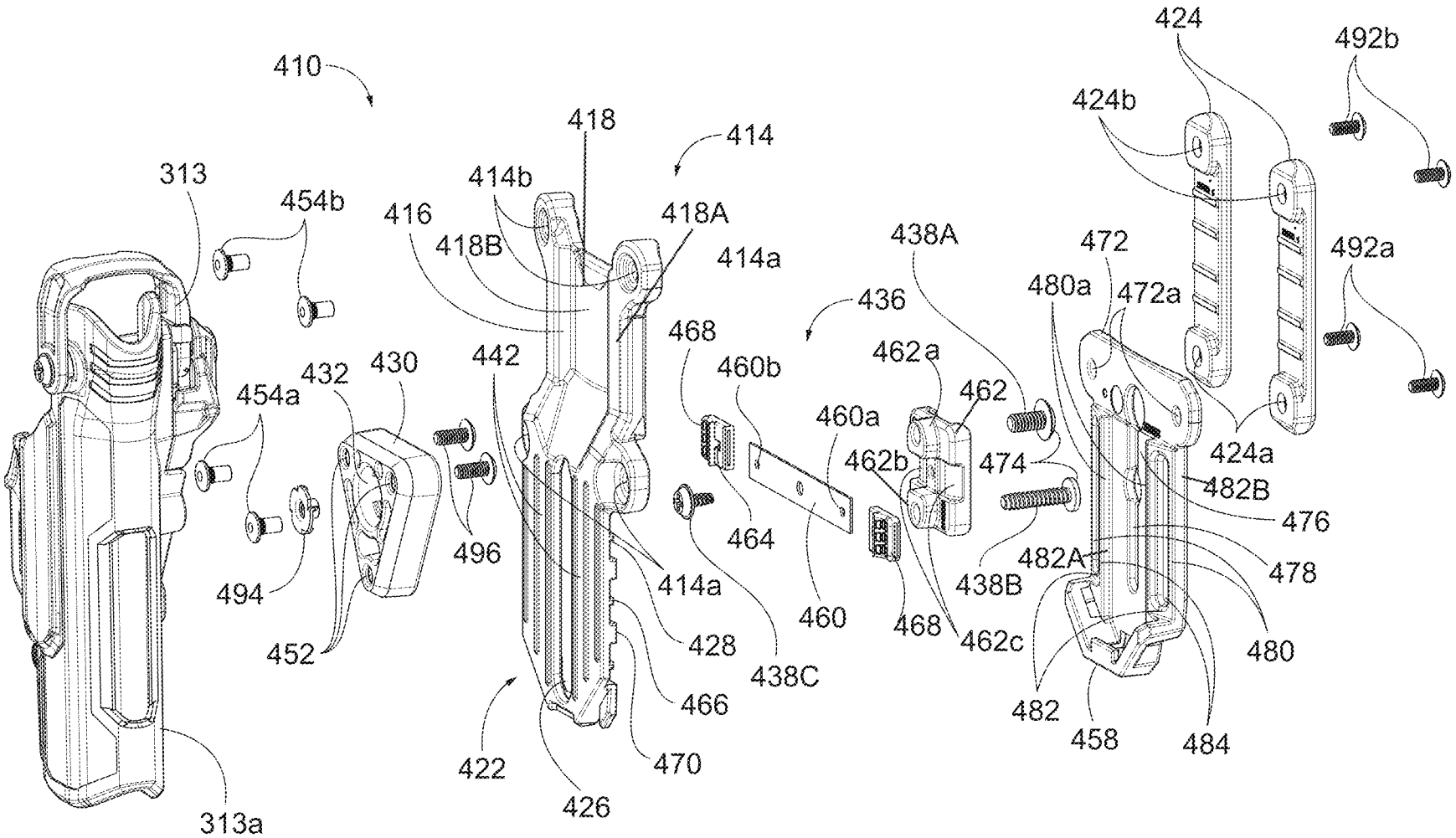
FIG. 58 is a front perspective, exploded view of the holster assembly of FIG. 56.

Referring to FIGS. 57-58, in certain embodiments, the belt engaging member 414 may include a column portion 416 having a front face 418 configured to face the holster 313; a rear face 420 configured to face the user; and a holster attachment portion 422. At least one belt loop portion 424 may extend from the rear face of the column portion 416 and be configured to engage the user's belt. Each belt loop portion 424 may include an upper hole 424*b* and a lower hole 424*a* in upper and lower portions thereof.

Figure 59A:
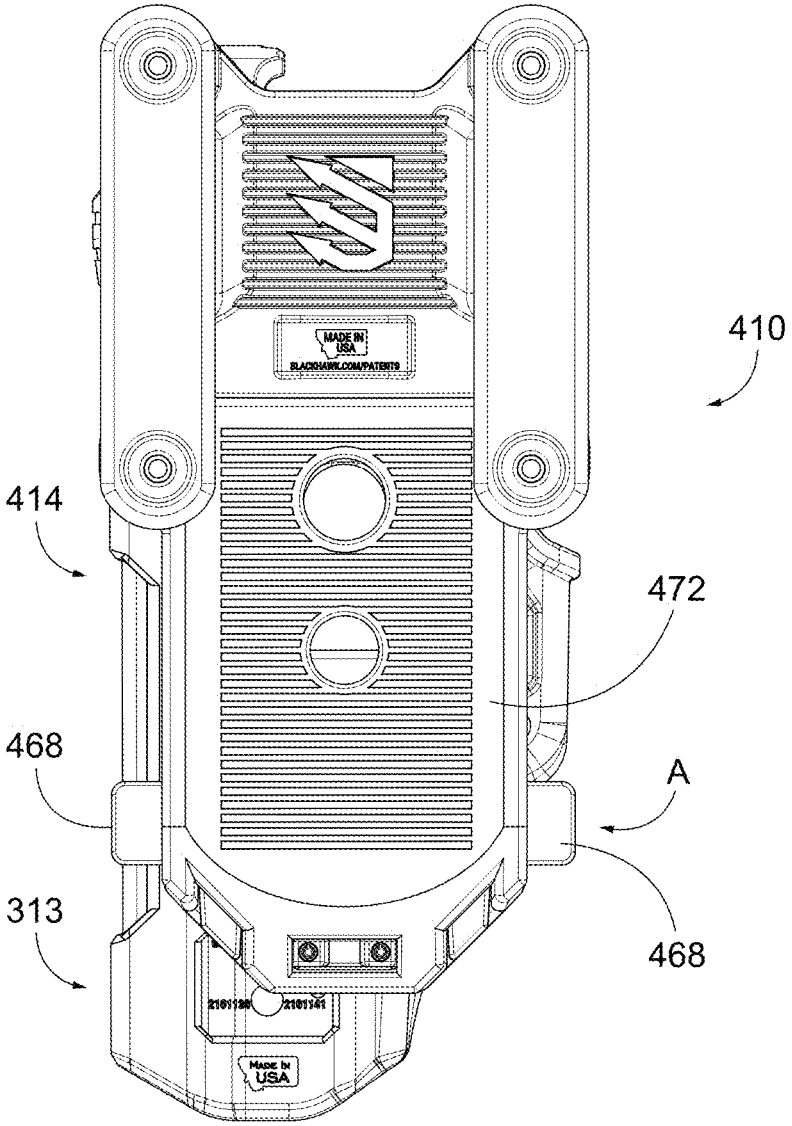
FIG. 59A is a rear view of the holster assembly of FIG. 56 showing the holster in the lowest ride height position.
Figure 59B:
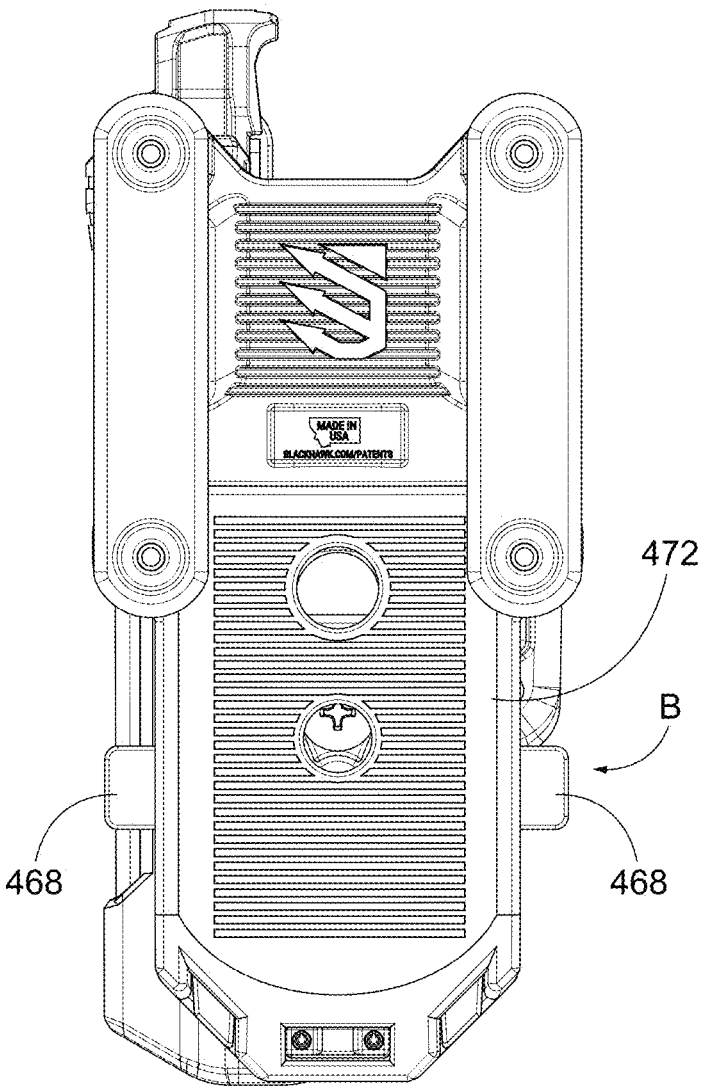
FIG. 59B is a rear view of the holster assembly of FIG. 56 showing the holster in the middle ride height position.
Figure 59C:
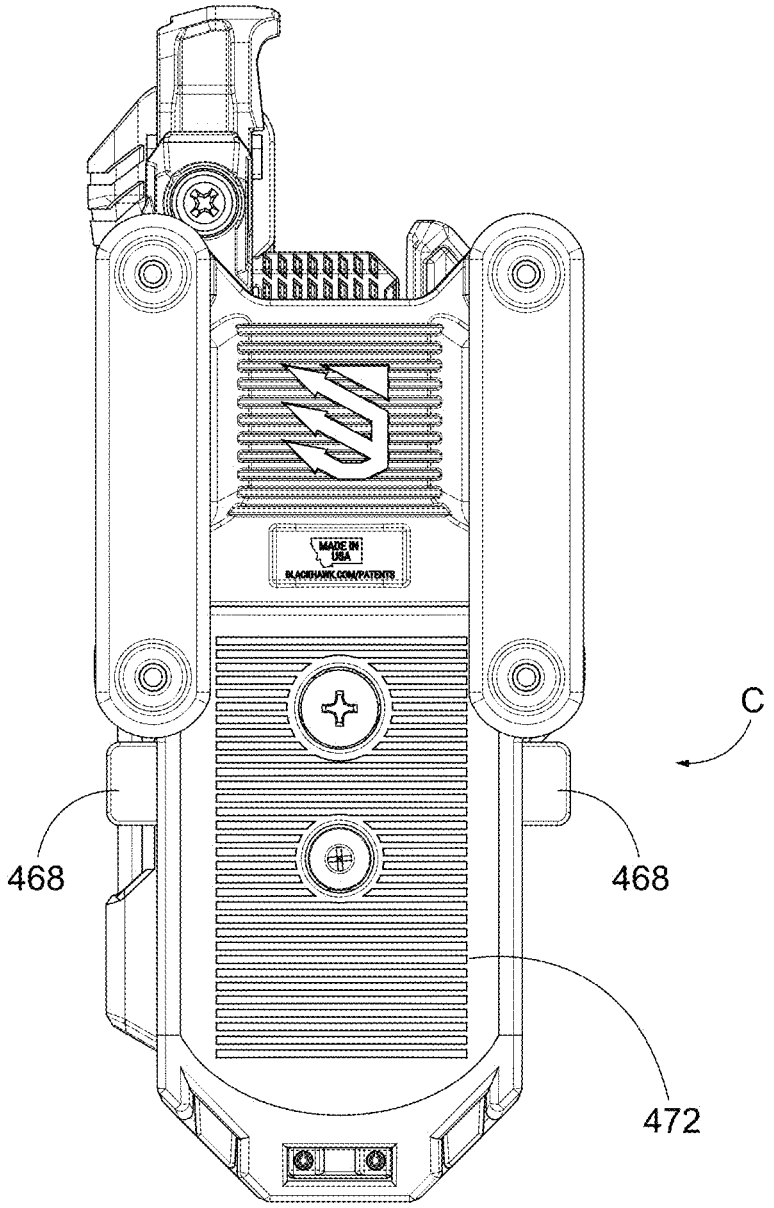
FIG. 59C is a rear view of the holster assembly of FIG. 56 showing the holster in the highest ride height position.
Figure 60A:
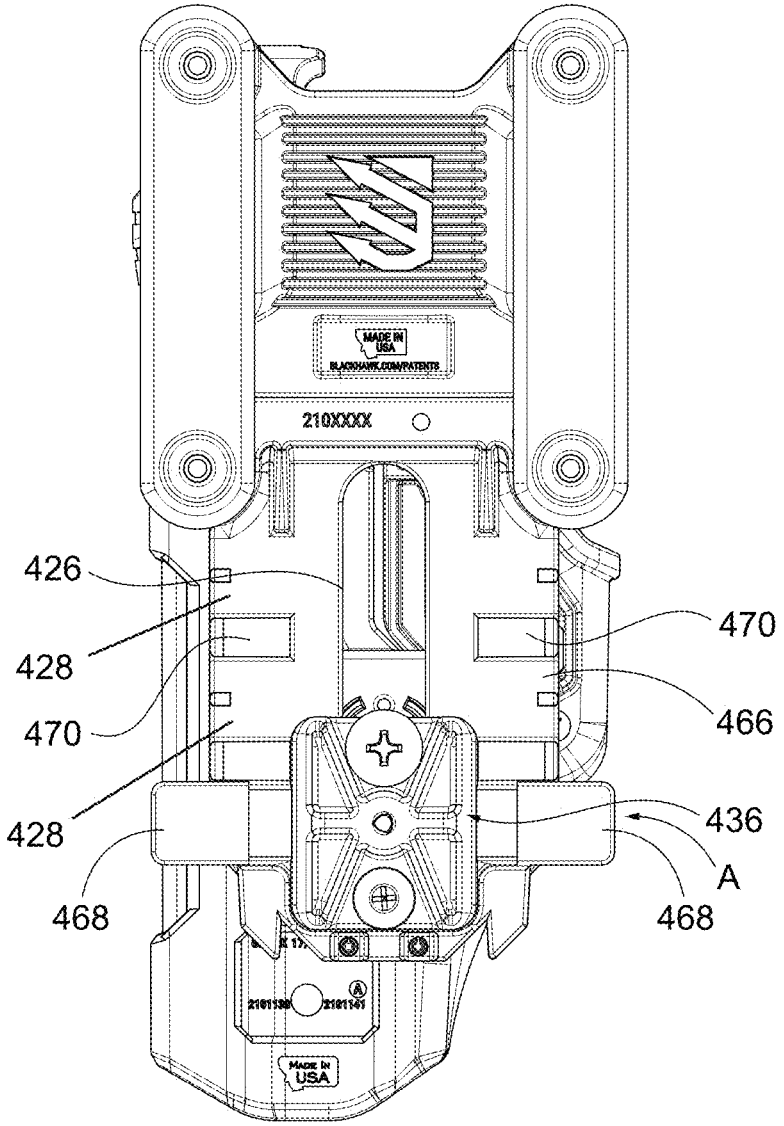
FIG. 60A is a rear view of the holster assembly of FIG. 56, without the backing plate, showing the holster in the lowest ride height position.
Figure 60B:
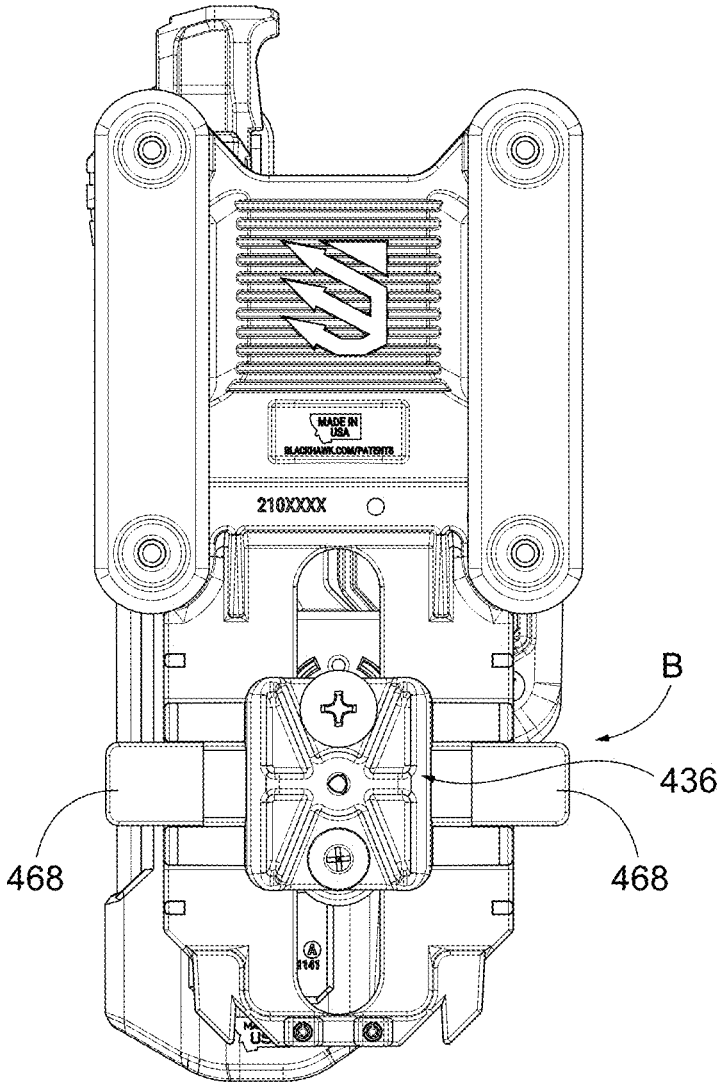
FIG. 60B is a rear view of the holster assembly of FIG. 56, without the backing plate, showing the holster in the middle ride height position.
Figure 60C:
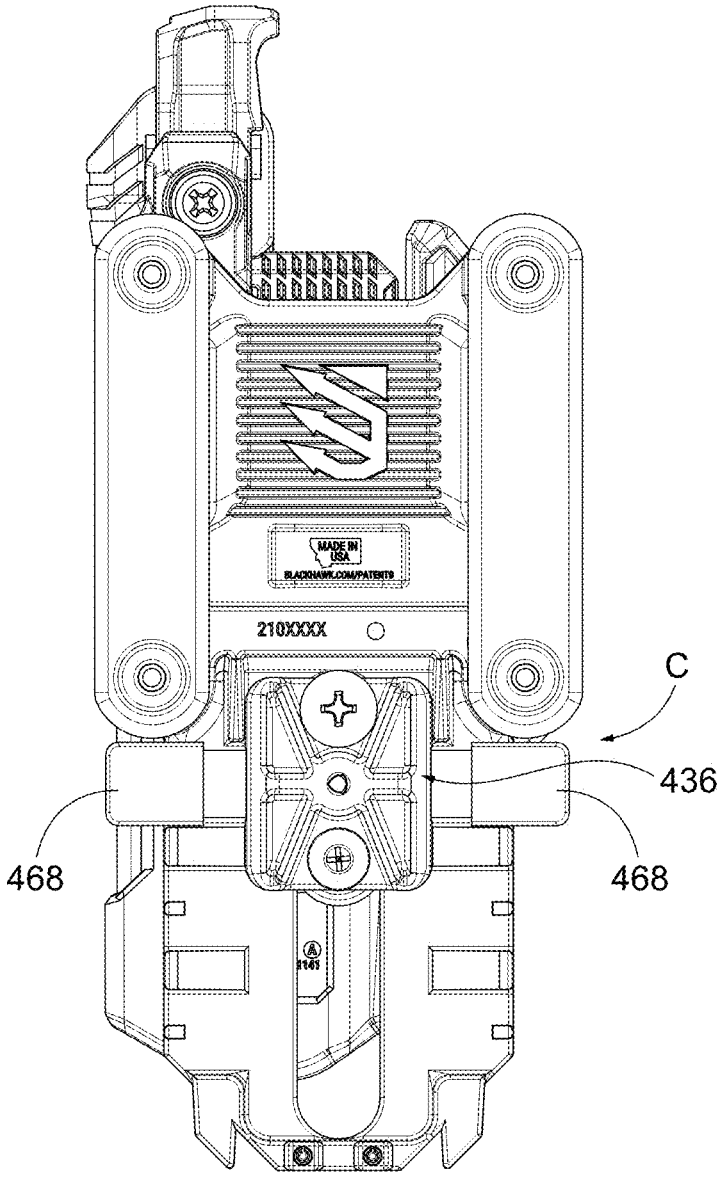
FIG. 60C is a rear view of the holster assembly of FIG. 56, without the backing plate, showing the holster in the highest ride height position.

In some embodiments, the holster attachment portion 422 may include a central slot 426; a plurality of pairs of diametrically opposed recesses or slots 428 on the rear face 420, defining a plurality of ride height positions, for example, referring to FIGS. 59-60, lowest A, middle B, highest C. The recesses or slots 428 of each pair of diametrically opposed recesses or slots 428 may be on opposite sides of the central slot 426. FIGS. 59A-59C show the holster 313 in different ride height positions (lowest A, middle B, highest positions C, respectively) with respect to the belt engaging member 414. Likewise, FIGS. 60A-60C show the positions of FIGS. 59A-59C with backing plate 472 removed.

In further embodiments, the holster carrier 430 may have a front face 432 configured to be mounted to the holster; and a rear face 434 configured for sliding movement relative to the front face 418 of the column portion 416.

In some embodiments, slider 436 may be slideably mounted to the rear face 434 of the holster carrier 430 such that the belt engaging member 414 is disposed between the slider 436 and holster carrier 430. Slider 436 may include a carrier sled 462. The carrier sled 462 may include at least two forwardly projecting risers or sliding elements 462*a*, 462*b* configured for sliding movement within the central slot 426. The sliding elements 462*a*, 462*b* are configured to prevent torqueing between the slider 436 and holster carrier 430. Slider 436 may also include at at least two sliding element fasteners 438A, 438B each extending through a corresponding hole in each sliding element 462*a*, 462*b* and configured for joining the slider 436 to the holster carrier 430. Slider 436 may further include leaf spring 460 attached to the carrier sled 462 by a fastener 438C, Leaf spring 460 may have first and second ends 460*a* and 460*b* be configured to be selectively engageable with and disengageable with the pairs of diametrically opposed recesses 428 at the lowest A, middle B, highest C ride height positions. The leaf spring 460 may be configured to be disposed between the rear face 420 of the column portion 416 and the user.

In certain embodiments, the front face 418 of the column portion 416 may further include at least one pair of parallel rails 442. The at least one pair of parallel rails 442 may be disposed parallel to and on opposite sides of the central slot 426 wherein the at least one pair of rails 442 may be configured for providing clearance for sand or other debris between the front face 418 of the column portion 416 and the rear face 434 of the holster carrier 430 shown in FIG. 63. Alternatively, instead of parallel rails 442, the front face 418 of the column portion 416 may further include at least one pair of parallel slots or recesses (not illustrated).

In some embodiments, as discussed above, the at least two sliding element fasteners 438A, 438B may extend through the at least two sliding elements 462*a*, 462*b* which are configured for sliding movement within the central slot 426 of the belt engaging member 414. At least one of the sliding element fasteners 438A may extend through sliding element 462*a* within central slot 426 of belt engaging member 414, through spacer block 430 and may engage a T-nut 494 disposed in a central recess of the spacer block 430. At least one of the sliding element fasteners 438B may extend through sliding element 462*b* extending through central slot 426, through spacer block 430 and may engage holster 313. In further embodiments, the at least one sliding element fastener 438A, 438B may extend between the slider 436 and the holster carrier 430 and may include at least two sliding element fasteners 438A, 438B each having a fastener head 474. In some embodiments, sliding element fasteners 438A, 438B may be threaded screws.

In further embodiments, the slider 436 may further include a detent recess or hole 464 disposed near each end of the leaf spring 460 and configured to be engageable with a detent projection 466 disposed in each recess or slot 428. In some embodiments, a finger tray 468, which may include the recess or slot 428, may be disposed on each end of the leaf spring 460 and configured to deflect the ends of the leaf spring 460, when pressed rearwardly by a user, to unlock the detent recesses or holes 464 from the detent projections 466 to adjust the holster 313 vertically to a desired ride height position. When the finger trays 468 are released by the user, they are biased forwardly by the leaf spring 460 back into engagement with a recess or slot 428 and detent projection 466. The leaf spring 460 may include a central though hole 460*c* for receiving a fastener 438*c* for mounting to carrier sled 462 and through holes 460*b*, 460*b* near each end for attachment to the finger trays 468.

In some embodiments, the slider 436 may further include a backing plate 472 attached to the rear face 420 of the column portion 416. In certain embodiments, backing plate 472 encapsulates slider 436, with the exception of finger trays 468, and protects slider 436 from engaging the user's leg or other equipment. Backing plate 472 and belt engaging member 414 may be attached at bottom portions thereof using locking tabs and fastened together at top using at least two lower fasteners 454*a*.

In certain embodiments, the backing plate 472 may have a front face 476 including a central groove 478 configured to provide clearance for the fastener heads 474 of the at least one sliding element fastener 438A, 438B when the at least one sliding element 462*a*, 462*b* moves within the central slot 426.

In other embodiments, the backing plate 472 may further have at least one ramped rib 480 on the front face 476 on either side of the central groove 478. Each ramped rib 480 may be sloped such that each ramped rib 480 forms a sloped surface 482 configured to slope away from the central groove and having an inner edge 482A having a forwardly measured thickness greater than a forwardly thickness of an outer edge 482B of the ramped rib 480. The ramped ribs 480 are configured to prevent the user from over bending and yielding the leaf spring 460 when the user presses rearwardly, towards the user, on the finger trays 468. Each ramped rib 480 may have a central groove 484 which may be configured to reduce material weight. Each ramped rib 480 may have an inwardly facing shoulder 480*a* configured to constrain movement of the sled 462 through engagement with the corresponding sides 462*d* of sled 462. In certain embodiments, the movement being constrained is rotational movement. In some embodiments, backing plate 472 is attached to rear face 420 of column portion 416 by at least two lower fasteners 454*a* extending through holes 424*a* in belt loop 424, holes 472*a* in backing plate 472*a* and corresponding holes 414*a* in belt engaging member 414, and also at contoured stop projection 490 which locks with a projection 458 on the back plate 472. In these embodiments, the backing plate 472 may impart additional structural rigidity to column portion 416, and eliminate interference with the slider 436. Sled 462 may have horizontally extending ramped grooves 462*c* which constrain deflection of the ends of leaf spring 460.

In certain embodiments, the holster attachment portion 422 of belt engaging member 414 may further include diametrically opposed ramps 470 (FIG. 57) on opposite sides of the central slot 426, wherein at least two the ramps 470 on one side of the central slot 426 define at least one of the recesses or slots 428 therebetween. Each ramp 470 may form a sloped surface 486 comprising an inner edge 486A having a thickness less than a thickness of an outer edge 486B of the ramp 470. The plurality of pairs of diametrically opposed recesses or slots 428 may include three pairs of diametrically opposed recesses or slots 428.

In some embodiments, the at least one sliding element 462*a*, 462*b* may be configured to slide within the central slot 426 only when both finger trays 468 on the leaf spring 460 are configured to be depressed rearwardly away from the holster towards the user to deflect the ends of the leaf spring 460 away from the recesses or slots 428, wherein the leaf spring is biased to return forwardly to the non-deflected position.

The sloped surfaces 486, 482 of the ramps 470 and ramped ribs 480 may provide clearance for the ends of the leaf spring 428 when the ends are deflected away from the recesses or slots 428 and the at least one sliding element 462*a*, 462*b* is slid within the central slot 426.

The leaf spring 460 is configured to auto-lock the slider 436 relative to the belt engaging member 414 upon release of the finger trays 468 when aligned with one of the pairs of diametrically opposed recesses or slots 428. Leaf spring wherein leaf spring 460 can only move vertically when the leaf spring 460 is deflected such that it clears ramps 470.

In some embodiments, at least two upper fasteners 454*b* engage holes 424*b* at upper portions of belt loops 424 and holes 414*b* at an upper portion of belt engaging member 414, and the at least two lower fasteners 454*a* engage holes 424*a* at lower portions of belt loops 424, holes 414*a* at a middle portion of belt engaging member 414 and holes 472*a* at an upper portion of the backing plate 472. Fasteners 454*a*, 454*b* may be press-in-fasteners which mate with corresponding screws 492*a* and 492*b*. The holster carrier 430 may further include at least one aperture 452 configured for receiving at least one threaded fastener 496 for attachment to the holster. In some embodiments, holster carrier 430 has a triangular shape with an aperture 452 at each corner.

Figure 61:
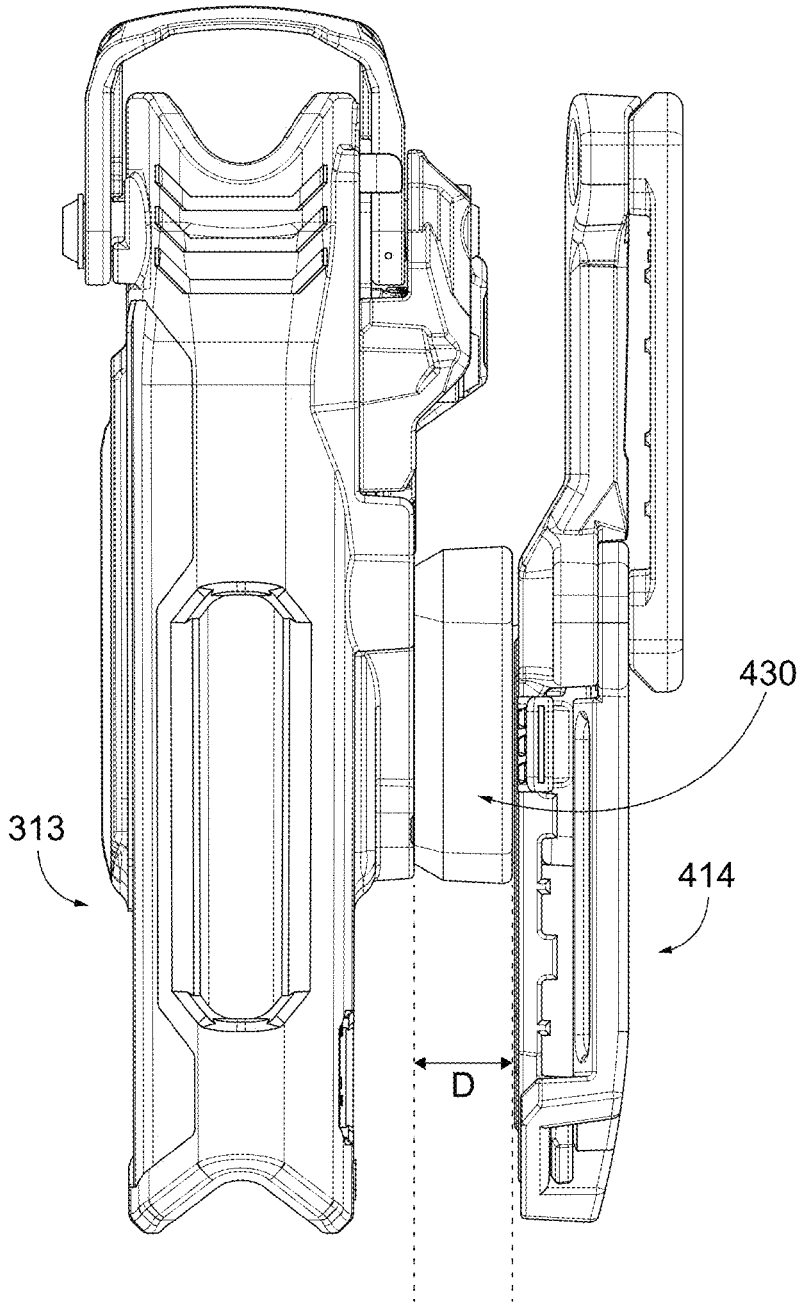
FIG. 61 is side view of the holster assembly of FIG. 56.
Figure 62:
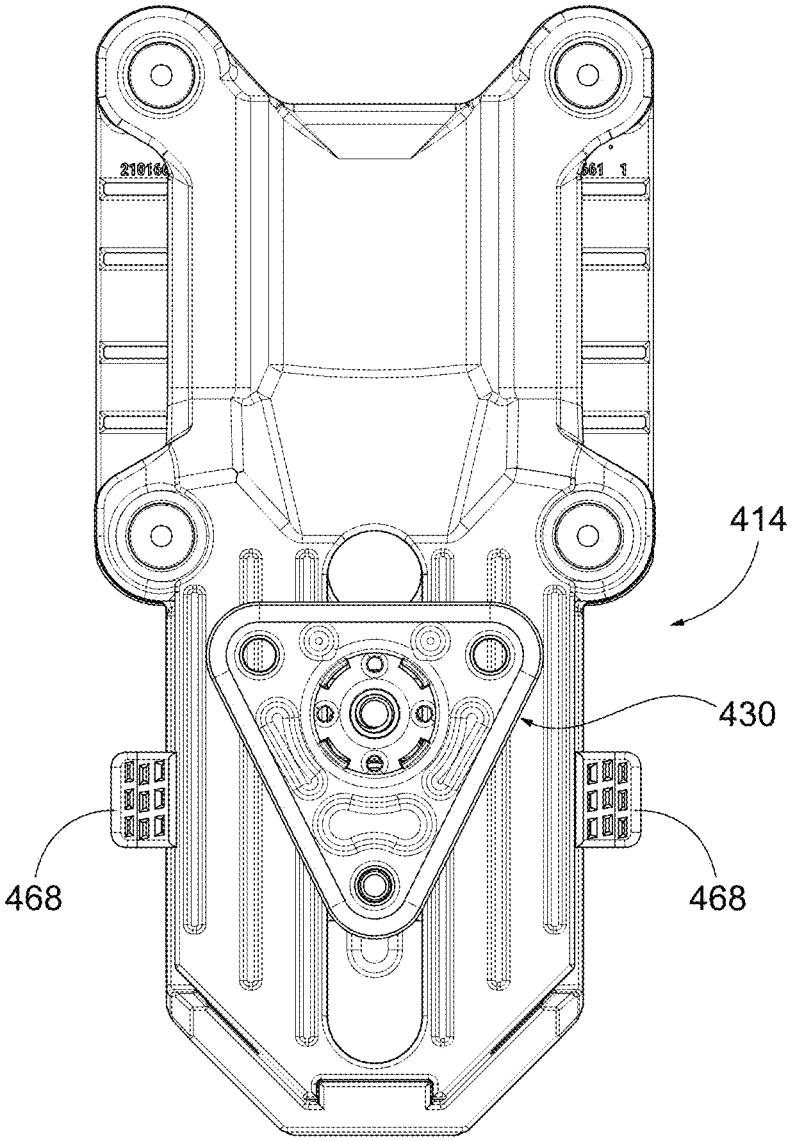
FIG. 62 is front view of the holster assembly of FIG. 56 without the holster.
Figure 63:
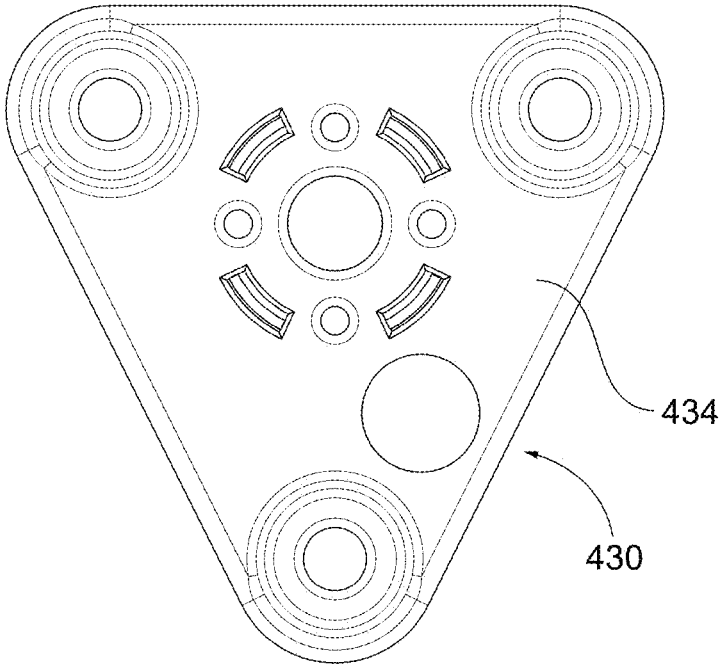
FIG. 63 is a rear view of the holster carrier of the holster assembly of FIG. 56.

In further embodiments, referring to FIG. 61, a distance between the front face 432 and the rear face 434 of the holster carrier 430 may define a holster carrier depth D. The holster 313 may be offset from the belt engaging member 414 a distance equal to the holster carrier depth D. In some embodiments, the slider 436 does not contribute to the offset. In other embodiments, the holster carrier depth does not include at least one of the slider, buttons or screw heads.

The holster carrier 430 may include a rear holster carrier member and a forward carrier member (not shown). The rear carrier member may be configured to be mounted to the slider 436; wherein the forward carrier member is configured to be mounted to the holster 313. The forward holster carrier member may be configured to be rotatable relative to the rear carrier member to adjust the cant of the holster 313.

In certain embodiments, the central slot 426 defines upper and lower limits of travel of the slider 436. The lower limit of travel may further be defined by a contoured stop projection 490 extending rearwardly from the rear face 420 of the belt engaging member 414. In certain embodiments, the front face 418 of the belt engaging member 414 includes parallel ribs 418A forming a thumb receiving recess 418B there between like that discussed above in earlier embodiments.

The following United States patents are hereby incorporated by reference herein: U.S. Pat. Nos. 5,048,735, 5,100,036, 5,129,562, 5,275,317, 5,284,281, 5,372,288, 5,395,021, 5,419,474, 5,449,103, 5,509,591, 5,573,157, 5,810,221, 5,810,221, 5,918,784, 5,918,784, 6,112,962, 6,189,751, 6,230,946, 6,267,279, 6,276,581, 6,533,149, 6,547,111, 6,547,111, 6,634,527, 6,641,009, 6,641,009, 6,752,300, 6,752,300, 6,769,582, 6,799,392, 6,854,626, 7,200,965, 7,434,712, 7,461,765, 7,461,765, 7,530,456, 7,530,456, 7,556,181, 7,556,181, 7,841,497, 7,841,497, 7,922,050, 7,922,050, 8,141,758, 8,141,758, 8,177,108, 8,235,263, 8,474,670, 8,517,235, 8,602,276, 8,602,276, 8,631,981, 8,631,981, 8,646,665, 8,720,753, 8,720,753, 8,720,754, 8,720,755, 8,851,344, 8,985,412, 9,022,262, 9,022,262, 9,057,579, 9,057,580, 9,134,093, 9,134,093, 9,175,925, 9,175,925, 9,228,802, 9,267,760, 9,347,741, 9,383,165, 9,410,767, 9,500,426, 9,777,986, and 9,835,400. Components illustrated in such patents may be utilized with embodiments herein. Incorporation by reference is discussed, for example, in MPEP section 2163.07(B).

The patents and other references mentioned above in all sections of this application are herein incorporated by reference in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

We claim:

1. A holster support assembly configured for supporting a holster on a user's belt, the holster support assembly comprising:

a belt engaging member comprising:
- a column portion comprising:
- a front face configured to face the holster;
- a rear face configured to face the user; and
- a holster attachment portion; and at least one belt loop portion extending from the rear face of the column portion and configured to engage the user's belt;

wherein the holster attachment portion comprises:
- a central slot;
- a plurality of pairs of diametrically opposed slots on the rear face, defining a plurality of ride height positions, wherein the slots of each pair of diametrically opposed slots are on opposite sides of the central slot;

a holster carrier comprising:
- a front face configured to be mounted to the holster; and
- a rear face configured for sliding movement relative to the front face of the column portion;

a slider slideably mounted to the rear face of the holster carrier and comprising:
- a carrier sled;
- at least two sliding elements forwardly projecting from the carrier sled and configured for sliding movement within the central slot and preventing torque between the slider and the holster carrier;
- at least two sliding element fasteners configured for joining the slider to the holster carrier;

a leaf spring attached to the carrier sled and having first and second ends configured to be selectively engageable with and disengageable with the pairs of diametrically opposed slots, wherein the leaf spring is configured to be disposed between the rear face of the column portion and the user; and a detent recess disposed near each end of the leaf spring and configured to be engageable with a detent projection disposed in each of the diametrically opposed slots;

wherein the holster support assembly further comprises a backing plate attached to the rear face of the belt engaging member and configured for encapsulating the carrier sled.

2. The holster support assembly of claim 1, the front face of the column portion further comprising at least one pair of parallel rails, wherein the at least one pair of parallel rails is disposed parallel to and on opposite sides of the central slot wherein the at least one pair of rails is configured for providing clearance for sand or other debris between the front face of the column portion and the rear face of the holster carrier.

3. The holster support assembly of claim 1, wherein a first one of the at least two sliding element fasteners extends through a first one of the sliding elements within the central slot, through the holster carrier and engages a T-nut disposed in a central recess of the holster carrier, and a second one of the at least two sliding element fasteners extends through a second one of the sliding elements within the central slot, through the holster carrier and engages the holster.

4. The holster support assembly of claim 1, wherein the slider further comprises:

a finger tray on each end of the leaf spring configured to deflect the ends of the leaf spring to lock and unlock the detent recesses from the detent projections to adjust the holster vertically to a desired location.

5. The holster support assembly of claim 4, wherein the finger trays are each configured to extend beyond respective sides of the backing plate such that they are not encapsulated by the backing plate encapsulating the carrier sled.

6. The holster support assembly of claim 5, wherein the at least one sliding element is configured to slide within the central slot only when both finger trays on the leaf spring are depressed away from the holster to deflect the ends of the leaf spring away from the slots.

7. The holster support assembly of claim 5, wherein the leaf spring is configured to auto-lock the slider relative to the belt engaging member upon release of the finger trays when aligned with one of the pairs of diametrically opposed slots.

8. The holster support assembly of claim 5, wherein the at least two sliding element fasteners each comprise a fastener head; wherein the backing plate comprises a front face comprising a central groove configured to provide clearance for the fastener heads when the at least two sliding element fasteners move within the central slot.

9. The holster support assembly of claim 8, wherein the backing plate further comprises at least one ramped rib on the front face on either side of the central groove.

10. The holster support assembly of claim 9, wherein each ramped rib is sloped such that each ramped rib forms a sloped surface configured to slope away from the central groove and comprising an inner edge having a forwardly measured thickness greater than a forwardly measured thickness of an outer edge of the ramped rib, the ramped ribs are configured to prevent the user from over bending and yielding the leaf spring.

11. The holster support assembly of claim 10, wherein each ramped rib comprises a central groove.

12. The holster support assembly of claim 11, wherein the holster attachment portion further comprises diametrically opposed ramps on the rear face of the belt engaging member on opposite sides of the central slot, wherein at least two of the ramps on one side of the central slot define at least one of the slots therebetween, wherein each ramp forms a sloped surface comprising an inner edge having a rearwardly measured thickness less than a rearwardly measured thickness of an outer edge of the ramp.

13. The holster assembly of claim 12, wherein the sloped surfaces of the ramps and ramped ribs provide clearance for the ends of the leaf spring when the ends are deflected away from the slots and the at least one sliding element is slid within the central slot.

14. The holster support assembly of claim 1, wherein the plurality of pairs of diametrically opposed slots comprises three pairs of diametrically opposed slots.

15. The holster support assembly of claim 1, further comprising at least two fasteners engaging upper portions of the belt loop portions and an upper portion of the belt engaging member, and at least two fasteners engaging lower portions of the belt loop portions, a middle portion of belt engaging member and an upper portion of the backing plate and, wherein the holster carrier further comprises at least one aperture configured for receiving at least one threaded fastener for attachment to the holster body.

16. The holster support assembly of claim 1, wherein the front face and the rear face of the holster carrier define a holster carrier depth; wherein the holster is offset from the belt engaging member a distance equal to the holster carrier depth; wherein the slider does not contribute to the offset.

17. The holster support assembly of claim 1, wherein the holster carrier comprises a rear carrier member and a forward carrier member; wherein the rear carrier member is configured to be mounted to the slider; wherein the forward carrier member is configured to be mounted to the holster; and wherein the forward carrier member is configured to be rotatable relative to the rear carrier member to adjust the cant of the holster.

18. The holster support assembly of claim 1, wherein the central slot defines upper and lower limits of travel of the slider, wherein the lower limit of travel is further defined by a contoured stop projection extending rearwardly from the rear face of the belt engaging member.

19. A holster system comprising:

a holster; and a holster support assembly according to claim 1.

20. A holster support assembly configured for supporting a holster on a user's belt, the holster support assembly comprising:

a belt engaging member comprising:

a column portion comprising:

a front face configured to face the holster;

a rear face configured to face the user; and a holster attachment portion; and at least one belt loop portion extending from the rear face of the column portion and configured to engage the user's belt;

wherein the holster attachment portion comprises:

a central slot;

a plurality of pairs of diametrically opposed slots on the rear face, defining a plurality of ride height positions, wherein the slots of each pair of diametrically opposed slots are on opposite sides of the central slot;

a holster carrier comprising:

a front face configured to be mounted to the holster; and a rear face configured for sliding movement relative to the front face of the column portion;

a slider slideably mounted to the rear face of the holster carrier and comprising:

a carrier sled;

at least two sliding elements forwardly projecting from the carrier sled and configured for sliding movement within the central slot and preventing torque between the slider and the holster carrier;

at least two sliding element fasteners configured for joining the slider to the holster carrier;

a leaf spring attached to the carrier sled and having first and second ends configured to be selectively engageable with and disengageable with the pairs of diametrically opposed slots, wherein the leaf spring is configured to be disposed between the rear face of the column portion and the user; and wherein the front face of the column portion further comprising at least one pair of parallel rails, wherein the at least one pair of parallel rails is disposed parallel to and on opposite sides of the central slot wherein the at least one pair of rails is configured for providing clearance for sand or other debris between the front face of the column portion and the rear face of the holster carrier.

* * * * *